US007212184B2

(12) United States Patent
Washio et al.

(10) Patent No.: US 7,212,184 B2
(45) **Date of Patent: *May 1, 2007**

(54) SHIFT REGISTER AND IMAGE DISPLAY DEVICE

(75) Inventors: Hajime Washio, Tenri (JP); Yasushi Kubota, Sakurai (JP); Kazuhiro Maeda, Tenri (JP); Yasuyoshi Kaise, Tenri (JP); Michael James Brownlow, Oxford (GB); Graham Andrew Cairns, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 417 days.

This patent is subject to a terminal disclaimer.

(21) Appl. No.: 10/800,352

(22) Filed: Mar. 12, 2004

(65) Prior Publication Data

US 2004/0174334 A1 Sep. 9, 2004

(51) Int. Cl.
*G09G 3/36* (2006.01)

(52) U.S. Cl. ..... 345/98; 345/100

(58) Field of Classification Search ..... 345/87, 345/94, 98, 99, 100

See application file for complete search history.

(56) References Cited

U.S. PATENT DOCUMENTS 5,128,974 A * 7/1992 Maekawa ..... 377/81
5,400,050 A 3/1995 Matsumoto et al.
6,140,159 A * 10/2000 Moon ..... 438/151
6,670,944 B1 * 12/2003 Ishii ..... 345/100

FOREIGN PATENT DOCUMENTS

EP 0 461 928 A2 12/1991
EP 0 730 258 A1 9/1996
EP 0 760 508 A1 3/1997

(Continued)

OTHER PUBLICATIONS

"Dual D-Type Positive Edge-Triggered Flip-Flops with Preset and Clear" (SN7474 data sheet), 1988, Texas Instruments Inc., p. 1.*

(Continued)

*Primary Examiner*—Dennis-Doon Chow
(74) *Attorney, Agent, or Firm*—David G. Conlin; John J. Penny, Jr.; Edwards Angell Palmer & Dodge LLP

(57) ABSTRACT

In a shift register provided with flip-flops that operate in synchronism with a clock signal, and a switching means, which is opened and closed in response to an output of the preceding stage of each of the flip-flops, is installed. The clock signal is selectively inputted by the switching means, and the selected clock signal is inverted and used as a shift register output from each of the stages. Moreover, two kinds of clock signals, each of which has a duty ratio of not more than 50% and which have no overlapped portions in their low-level periods, are used so as to prevent the outputs of the shift-register from overlapping each other. Thus, it is possible to provide a shift register which is preferably used for a driving circuit of an image display device, can miniaturize the driving circuit, and can desirably change the pulse width of the output signal, and also to provide an image display device using such a shift register.

28 Claims, 40 Drawing Sheets

FOREIGN PATENT DOCUMENTS

| | | | |
|---|---|---|---|
| EP | 0 789 345 | A1 | 8/1997 |
| EP | 0 869 472 | A1 | 10/1998 |
| EP | 0 903 722 | A2 | 3/1999 |
| JP | 02-054621 | | 2/1990 |
| JP | 03-147598 | | 6/1991 |
| JP | 09-153296 | | 6/1997 |
| JP | 10-334685 | | 12/1998 |
| JP | 2861951 | | 12/1998 |
| JP | 11-272226 | | 10/1999 |

OTHER PUBLICATIONS

Notice for Reasons for Refusal from Japanese Office Action pertaining to 2000-117073 (and English Translation).
Notice for Reasons for Refusal from Japanese Office Action pertaining to 11 311191 (and English Translation).
European Search Report dated Jul. 30, 2001 for European Patent Application No. EP 00 30 9617.

* cited by examiner

SHIFT REGISTER AND IMAGE DISPLAY DEVICE

BACKGROUND OF THE INVENTION

The present invention relates to a shift register which is preferably applied to, for example, a driving circuit of an image display device, and which makes it possible to miniaturize the driving circuit and also to desirably change the pulse width of an output signal, and also concerns an image display device using such a shift register.

BACKGROUND OF THE INVENTION

Conventionally, in a data signal line driving circuit and a scanning signal line driving circuit of an image display device, shift registers have been widely used so as to provide synchronized timing that is applied upon sampling inputted video image data, or so as to form a scanning signal to be applied to the scanning signal lines.

In the data signal line driving circuit, a sampling signal is generated so as to write video image data derived from a video image signal in pixels through a data signal line. In this case, when a sampling signal has an overlapped portion with a sampling signal from the preceding stage or the succeeding stage, the resulting video image data fluctuates greatly, causing erroneous image data to be outputted to the data signal line. In order to solve the above-mentioned problems, a conventional shift register 101 has a circuit construction, for example, as shown in FIG. 32.

The shift register 101, shown in FIG. 32, consists of n stages, and each stage is provided with a D-type flip-flop 102, a NAND circuit 103, inverters 104*a* and 104*b* and a NOR circuit 105. To the shift register 101, two clock signals SCK and SCKB which have phases different from each other, and a start pulse SSP are inputted.

Each of the clock signals SCK and SCKB is prepared so as to have half the sampling cycle of the inputted video image signal, and in synchronism with the clock signals SCK and SCKB, pulses are successively outputted from the shift registers 101 on the respective stages. With respect to the i-numbered stage ($1 \leqq i \leqq n$), an output Qi−1 of the D-type flip-flop 102 on the (i−1)-numbered stage and an output Qi of the D-type flip-flop 102 on the i-numbered stage are inputted to the NAND circuit 103 on the i-numbered stage so that an output signal NSouti is obtained.

Moreover, in order to prevent a sampling signal Si on the i-numbered stage and a sampling signal Si+1 on the (i+1)-numbered stage from overlapping each other, the output signal NSOUTi is not only directly inputted to one of the input terminals of the NOR circuit on the i-numbered NOR circuit 105, but also inputted to a delay circuit constituted by inverters 104*a* and 104*b* on two steps. Since the output of the delay circuit is inputted to the other input terminal of the NOR circuit 105, it is possible to shorten the width of the sampling signal Si outputted from the NOR circuit 105 on the i-numbered stage.

The same process as described above is carried out on each of the shift registers 101 on the respective stages so that as illustrated in FIG. 33, sampling signals. S1 to Sn having no overlapped portions with each other are obtained.

Next, referring to FIGS. 34 and 35, an explanation will be given of a conventional shift register 111 installed in a scanning signal line driving circuit.

The scanning signal line driving circuit outputs a scanning signal to each of the scanning signal lines so that video image data is successively written in pixels arranged on a display section. At this time, the pulse output has to be stopped so that the (i+1)-numbered scanning signal is not overlapped with the i-numbered scanning signal or so that a process for refreshing the video image data that has been written on the i-numbered data signal line is carried out.

Therefore, as illustrated in FIG. 34, the conventional shift register 111, installed in the scanning signal line driving circuit, consists of n stages, and each stage is provided with a D-type flip-flop 112, a NAND circuit 113 and a NOR circuit 114. Moreover, to the shift register 111, two clock signals GCK•GCKB, which have phases different from each other, a start pulse GSP and a pulse width control signal PWC are inputted.

In the shift register 111, pulses are successively outputted from the respective stages in synchronism with the clock signals GCK•GCKB. With respect to the i-numbered stage ($1 \leqq i \leqq n$), an output Qi−1 of the D-type flip-flop 112 on the (i−1)-numbered stage and an output Qi of the D-type flip-flop 112 on the i-numbered stage are inputted to the NAND circuit 113 on the i-numbered stage so that an output signal NOUTi is obtained. The output signals NOUT1 to NOUTn, thus obtained, are outputted in the same cycles as the respective scanning signals GL1 to GLn.

In the shift register 111, the pulse width control signal PWC is further inputted to one of the input terminals of the NOR circuit 114 on each stage. Moreover, to the other input terminal of the NOR circuit 114 on the i-numbered stage is inputted the output signal NOUTi of the NAND circuit 113 on the i-numbered stage. Consequently, a scanning signal GLi is outputted from the NOR circuit 114 from the i-numbered stage.

The same process as described above is carried out on each of the shift registers 111 on the respective stages so that as illustrated in FIG. 35, sampling signals GL1 to GLn having no overlapped portions with each other are obtained. Therefore, the (i+1)-numbered scanning signal GLi+1 is not overlapped with the i-numbered scanning signal GLi so that a process for carrying out a refreshing process, etc. on video image data that has been written on the i-numbered data signal is provided.

Here, as illustrated in FIG. 36, in the above-mentioned D-type flip-flops 102•112, when a signal A is inputted through the D terminal and two clock signals CK and CKB are inputted through the other terminal, a signal B is outputted from the Q terminal.

However, the conventional shift registers 101•111 require circuits as shown in FIGS. 32 and 34, resulting in a problem of a bulky driving circuit.

In recent years, there have been ever-increasing demands for image display devices having a wider display screen and a narrower frame width with high precision; therefore, it is necessary to make the area of the driving circuit smaller. Moreover, in applications other than image display devices, there are high demands for simplified circuit construction of shift registers. Moreover, with respect to a conventional shift register used for a data signal line driving circuit, an arrangement as shown in FIG. 37 is proposed. In the shift register shown in FIG. 37, an S clock signal SCK is applied with a cycle half the sampling cycle of the inputted video image signal, and an output of the shift register section P1S is successively outputted in synchronism with the clock signal.

With respect to an n-numbered stage of the shift register P1S, an output $Q_n$ on the n-numbered stage ($SSR_n$) and an output $Q_{n-1}$ on the (n−1)-numbered stage ($SSR_{n-1}$) are used in a $NAND_S_n$ so as to obtain $NSOUT_n$.

A sampling signal on the n-numbered stage is allowed to have a narrower sampling signal by using a $NOR_Sa_n$ which takes NOR between the $NSOUT_n$ and the sampling pulse width control signal SPWC for controlling the sampling pulse width, so as not to overlap the sampling signal on the (n−1) stage. The same process is carried out on each of the outputs of the shift registers PlS so that, as illustrated in a timing chart in FIG. 38, a sampling signal having no overlapped portion is obtained. In this case, the pulse width control signal SPWC has a frequency twice the frequency of the S clock signal SCK.

Moreover, with respect to a conventional shift register used for a scanning signal line driving circuit, an arrangement as shown in FIG. 39 is proposed. In the shift register shown in FIG. 39, a scanning signal, writes a video image signal applied to a data signal line on pixels arranged on a display section, is successively outputted. In this case, with respect to the n-numbered scanning signal, its output has to be stopped so that it is not overlapped with the (n−1)-numbered scanning signal or so that a process for refreshing the video image data that has been written on the (n−1)-numbered data signal line is carried out.

More specifically, referring to a circuit diagram of FIG. 39 and its timing chart of FIG. 40, an explanation will be given of the operation. In FIG. 39, the output of the shift register P1G is successively released in synchronism with a G clock signal GCK. With respect to an n-numbered stage of the shift register P1G, an output ($Q_n$) on the n-numbered stage ($GSR_n$) and an output ($Q_{n-1}$) on the (n−1)-numbered stage ($GSR_{n-1}$) are used in a $NAND_G_n$ so as to obtain $NOUT_n$. The $NOUT_n$ are respectively outputted with the same cycle as the scanning signal.

As described earlier, with respect to the n-numbered scanning signal, its output has to be stopped so that it is not overlapped with the (n−1)-numbered scanning signal or so that a process for refreshing the video image data that has been written on the (n−1)-numbered data signal line is carried out or so that a precharging process, etc. is carried out. For this reason, a scanning pulse width control signal GPWC is inputted, and this and $NOUT_n$ are used in a $NOR_G_n$ so as to obtain $GL_n$. The $GL_n$ forms a scanning signal for driving the n-numbered scanning signal line. At this time, the pulse width control signal GPWC has a frequency twice the frequency of the G clock signal GCK.

Here, in the flip-flop circuit (D-flip-flop) constituting the shift register of FIG. 37 and FIG. 39, as illustrated in FIG. 36, the circuit construction is designed so that, when a signal A is inputted to the D-terminal with two clock signals CK and CKB being inputted through the other terminals, a signal B is outputted.

In general, the power consumption increases in proportion to the frequency, the load capacitance and the square of the voltage. Therefore, for example, in circuits that are connected to an image display device, such as those for generating video image signals for the image display device, or in image display devices, there is a tendency to reduce the driving voltage as small as possible.

For example, in a circuit using monocrystal silicon transistors such as the above-mentioned generation circuit for video image signals, the driving voltage is set to, for example, 5 V or 3.3 V, or a value not more than this value, in most cases.

In contrast, in a circuit using polycrystal silicon thin-film transistors so as to ensure a wider display area, such as pixels, a data signal line driving circuit or a scanning signal line driving circuit, since a difference of threshold voltages between substrates tends to reach as high as several volts (for example, 15 V), the reduction of the driving voltage has not been sufficiently achieved. Therefore, in the case when an input signal lower than the driving voltage of a shift register is inputted to a shift register, a level shifter for voltage-raising the input signal is installed in the shift register. In general, with respect to the input signal for the level shifter, two kinds of signals having two phases are used, and the two kinds of signals have respectively reversed phases.

More specifically, as shown in FIGS. 37 and 39, for example, when an input signal having an amplitude of approximately 5V is inputted to each of shift registers PlS and P1G, two level shifters Ls of the three in the Figure voltage-raises clock signals SCK and GCK to reach the driving voltage (15 V) of the shift registers P1S and P1G. The outputs of these level shifters Ls are inputted to flip-flops $SSR_1$ to $SSR_x$ and $GSR_1$ to $GSR_x$ that constitute the shift registers P1S and P1G. In synchronism with the outputs of the level shifters Ls thus applied, the shift registers P1S and P1G are allowed to have respective outputs.

However, in various circuits using conventional shift registers as shown in FIGS. 37 and 39, that is, for example, in a data signal line driving circuit, logical circuits (NOR, etc.) are required so as to prevent the sampling signals from overlapped each other, resulting in a large driving circuit; and for example, in a scanning signal line driving circuit, logical circuits (NOR, etc.) are also required so as to prevent the scanning signals from overlapping each other, resulting in a large driving circuit.

Moreover, each of the above-mentioned pulse width control signals SPWC and GPWC has a frequency that is twice the frequency of each of an S clock signal SCK and a G clock signal GCK, resulting in a greater driving frequency.

Moreover, in the shift registers P1S and P1G, after the clock signals SCK, SCKB (with a phase reversed to SCK) and GCK, GCKB (with a phase reversed to GCK) have been shifted in their levels, they are supplied to respective flip-flops constituting the shift register; therefore, the resulting problem is that the greater the distance between the flip-flops SSR1 to SSRx and the distance between the GSR1 to GSR2, the greater the transmission distance, causing an increase in the power consumption. In other words, as the transmission distance becomes longer, the capacitance of the transmission-use signal lines becomes greater, with the result that the level shifters LS require a greater driving capability, thereby resulting in an increase in the power consumption.

Moreover, as in the case when the driving circuit containing level shifters LS is constructed by using polycrystal silicon thin-film transistors, when the level shifter LS has only an insufficient capability, a buffer BUF having a great driving capability needs to be installed immediately after the level shifter LS so as to transmit signal waveforms that are free from rounding; this further causes an increase in the power consumption.

In recent years, there have been ever-increasing demands for image display devices with high precision having a wider display screen and narrower portions other than the display area; therefore, the frequency of clock signals has to be increased, and in response to this, it is required that the number of the stages of the shift registers P1S and P1G be increased and that the area of the driving circuit be minimized.

SUMMARY OF THE INVENTION

The first objective of the present invention is to provide a shift register which has output pulses on respective stages that are free from overlapped portions and which makes it possible to miniaturize the driving circuit and also to desirably change the pulse width of an output signal, and an image processing apparatus which can achieve a narrower frame width with the driving circuit simplified by applying such a shift register.

Moreover, the second objective of the present invention is to provide a shift register which can achieve a narrower frame width by simplifying the driving circuit, and is operated normally even in the case of a low amplitude of a clock signal with reduced power consumption, and an image display device using such a shift register.

In order to achieve the first objective, the shift register of the present invention is provided with: flip-flops of a plurality of stages to which a clock signal is inputted and switching means that is installed in each of the flip-flops of a plurality of stages and that controls the input of the clock signal. In this arrangement, in response to the output signal of the flip-flop on the i-numbered stage (where i is an arbitrary integer) among the flip-flops of the stages, the switching means on the (i+1)-numbered stage is controlled so that the input of the clock signal to the flip-flop on the (i+1)-numbered stage is controlled and an output pulse having the same width as the pulse width of the clock signal is generated.

In the above-mentioned shift register, the output of the flip-flop that is operated in synchronism with the clock signal controls the clock signal to be supplied to the flip-flop on the next stage through the switching means. Here, this controlled clock signal forms an output on the corresponding stage, and the output is allowed to have the same pulse width as the clock signal.

Conventionally, the output of the flip-flop on the preceding stage and the output of that of the present stage have been subjected to a logical operation so as to generate a signal having the same pulse width as the clock signal; however, in the shift register of the present invention, it is not necessary to install the circuit for carrying out the above-mentioned logical operation. Moreover, in the logical operation section, the output from the logical operation section tends to have a partially overlapped portion due to delay (delay in the rising-edge or trailing-edge of the signal) of signals occurring in the logical operation section; however, the shift register of the present invention makes it possible to eliminate the partially overlapped portion of the output of the logical operation section. Furthermore, it is possible to eliminate a special circuit and a transmission line for a special signal for preventing the overlapped portion of the output pulse; therefor, it becomes possible to greatly reduce the size of the shift register.

Therefore, it is possible to provide a shift register which has no overlapped portion in the output pulses from the respective stages and which achieves a simplified circuit construction.

Moreover, in order to achieve the first objective, the image display device of the present invention, which is provided with a display section constituted by a plurality of pixels arranged in a matrix format, a data signal line driving circuit, connected to a plurality of data signal lines, for supplying to the respective data signal lines image data to be written in the pixels, and a scanning signal line driving circuit, connected to a plurality of scanning signal lines, for supplying to the scanning signal lines a scanning signal for controlling a writing operation of the image data to the pixels, is characterized in that the shift register of the present invention is installed at least in either the data signal line driving circuit or the scanning signal line driving circuit.

In the above-mentioned image display device, the application of the shift register of the present invention makes it possible to minimize the circuit scale of the driving circuit and consequently to provide an image processing apparatus which can achieve a narrower frame width.

Moreover, in order to achieve the second objective, the shift register of the present invention, which is provided with flip-flops of a plurality of stages that operate in synchronism with clock signals and level shifters for voltage-raising the clock signals to be inputted to the flip-flops on a plurality of stages, is characterized in that the level shifter is installed in each of the flip-flops on a plurality of stages, and in that supposing that n is an integer not less than 1, in accordance with the output signal of the flip-flop on the n-numbered stage, a pulse that is voltage-raised with the same width of the pulse width of the clock signal by the level shifter on the (n+1)-numbered stage is inputted to the flip-flop on the (n+1)-numbered stage, and is also outputted as an output signal of the shift register.

For example, the present shift register is provided with flip-flops of a plurality of stages that operate in synchronism with clock signals, level shifters, each of which, in the case when the clock signal has a voltage value lower than the power supply voltage, voltage-raises the clock signal for each of the flip-flops on a plurality of stages, and control means for controlling the operation of the level shifter, each of the level shifters and the control means being placed for each of the flip-flops on a plurality of stages. In this arrangement, in accordance with the output signal of the flip-flop on the n-numbered stage of a plurality of stages, the level shifter is controlled by the control means on the (n+1)-numbered stage and the clock signal is voltage-raised and inputted thereto so that the flip-flop on the (n+1) numbered stage is operated, and a pulse which has been voltage-raised so as to have the same width as the pulse width of the clock signal, is outputted.

In the above-mentioned shift register, the output of each of the flip-flops, which is operated in synchronism with the clock signal, is allowed to activate a level shifter that voltage-raises the clock signal to be supplied to the flip-flop on the next stage; thus, it is possible to activate only one portion of the level shifters installed inside the shift register. This voltage-raised clock signal is allowed to form an output (SL1, etc.) of the shift register, which has the same pulse width as the clock signal.

Conventionally, level shifters are installed outside a shift register, and the clock signal is once voltage-raised to a driving voltage, and this is supplied to a plurality of flip-flops constituting the shift register. Moreover, a large buffer is provided so as to prevent the voltage-raised clock signal from being subjected to rounding and delay due to the capacitance of transmission lines, the gate capacitance of transistors connected thereto, etc.; therefore, due to these capacitances and high electric potential after having been raised, as also described in the Prior Art section, the power consumption increases in accordance with the expression, Power P=Capacitance C×Frequency f×a square of Voltage V, resulting in a great increase in the power consumption of the circuit.

In contrast, in accordance with the construction of the present invention, a low-voltage clock signal is transferred and each flip-flop is installed immediately after a level shifter so that one portion of the level shifters placed inside the shift register are operated; thus, it becomes possible to greatly reduce the power consumption.

In addition, since it is not necessary to install a circuit (NOR, etc.) for carrying out logical operations, the size of the driving circuit can be reduced. Moreover, in the logical operation section, the output from the logical operation section tends to have a partially overlapped portion due to delay (delay in the rising-edge or trailing-edge of the signal) of signals occurring in the logical operation section; however, the present invention makes it possible to eliminate the partially overlapped portion of the output of the logical operation section.

Furthermore, it is possible to eliminate a special circuit and a transmission line for a special signal (SPWC, etc.) for eliminating the overlapped portion of the output pulse; therefore, it becomes possible to greatly reduce the size of the driving circuit.

In order to achieve the second objective, the image display device of the present invention is provided with a display section which is provided with: a plurality of pixels arranged in a matrix format; a plurality of data signal lines placed on the respective columns of the pixels and a plurality of scanning signal lines placed on the respective rows of the pixels and which displays an image on the pixel by a data signal that is sent from the data signal line to each pixel in synchronism with a scanning signal supplied from each scanning signal line so as to form an image; a scanning signal driving circuit for successively supplying scanning signals having different timing from each other to the scanning signal lines in synchronism with a first clock having a predetermined cycle; and a data signal line driving circuit for extracting data signals applied onto the respective pixels on the scanning signal line to which the scanning signal has been applied, from a video image signal that has been successively applied in synchronism with a second clock having a predetermined cycle and is representative of a display state of each pixel, and for outputting the resulting data to each of the data signal lines. In the image display device having the above-mentioned arrangement, at least either the data signal line driving circuit and the scanning signal line driving circuit is provided with either of the above-mentioned shift registers having the first or second clock signal as a clock signal.

For example, the above-mentioned scanning signal driving circuit successively outputs the scanning signal to the scanning signal lines in synchronism with a predetermined timing signal. Further, the data signal line driving circuit successively outputs the video image signal to the data signal lines in synchronism with a predetermined timing signal.

In general, in the image display device, as the number of data signal lines or the number of scanning signal lines increases, the number of the flip-flops for generating timing for each signal line increases, thereby making the distance between the two ends of the flip-flop longer. Here, in the shift register of each of the above-mentioned arrangements, the driving capability of the level shifter is small, and even when the distance between the two ends of the flip-flop is long, it is possible to eliminate a buffer, and consequently to reduce the power consumption. Therefore, by installing the shift register having any one of the above-mentioned arrangements in at least either the data signal line driving circuit or the scanning signal line driving circuit, it is possible to reduce the power consumption, to miniaturize the circuit scale of the shift register and also to provide a narrower frame width in the image display device.

For a fuller understanding of the nature and advantages of the invention, reference should be made to the ensuing detailed description taken in conjunction with the accompanying drawings.

DESCRIPTION OF THE EMBODIMENTS

[Embodiment 1]

The following description will discuss one embodiment of the present invention.

The shift register of the present invention is preferably applied to a data signal line driving circuit and a scanning signal line driving circuit of an image display device; however, the shift register can also be applied to apparatuses other than the image display device. In the following description, the shift register that is related to the embodiment of the present invention and that is applied to a data signal line driving circuit will be explained as Embodiment 1, and the shift register that is related to the embodiment of the present invention and that is applied to a scanning signal line driving circuit will be explained as Embodiment 2.

Figure 1:
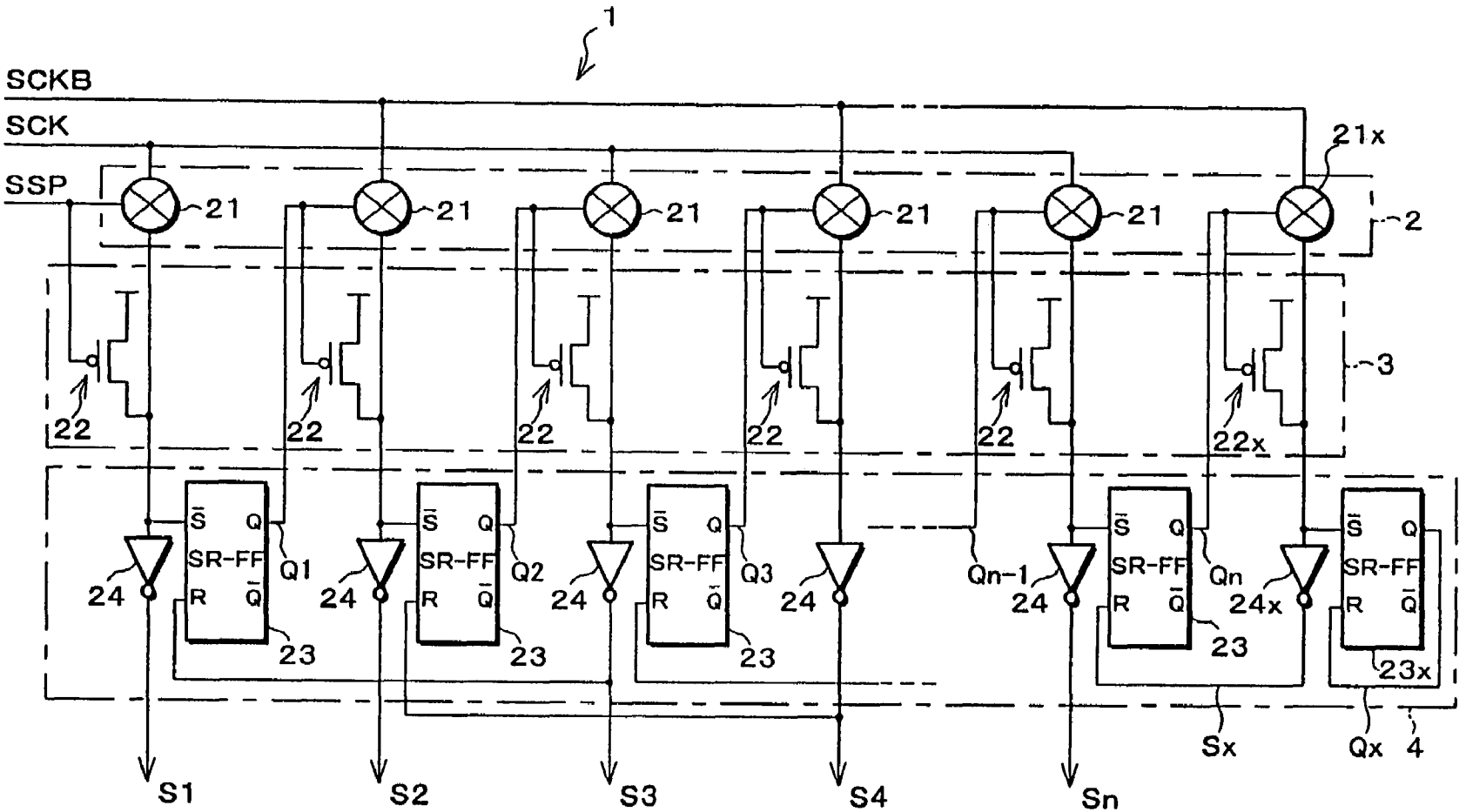
FIG. 1 is a circuit diagram that schematically shows the construction of a shift register in accordance with one embodiment of the present invention.
Figure 2:
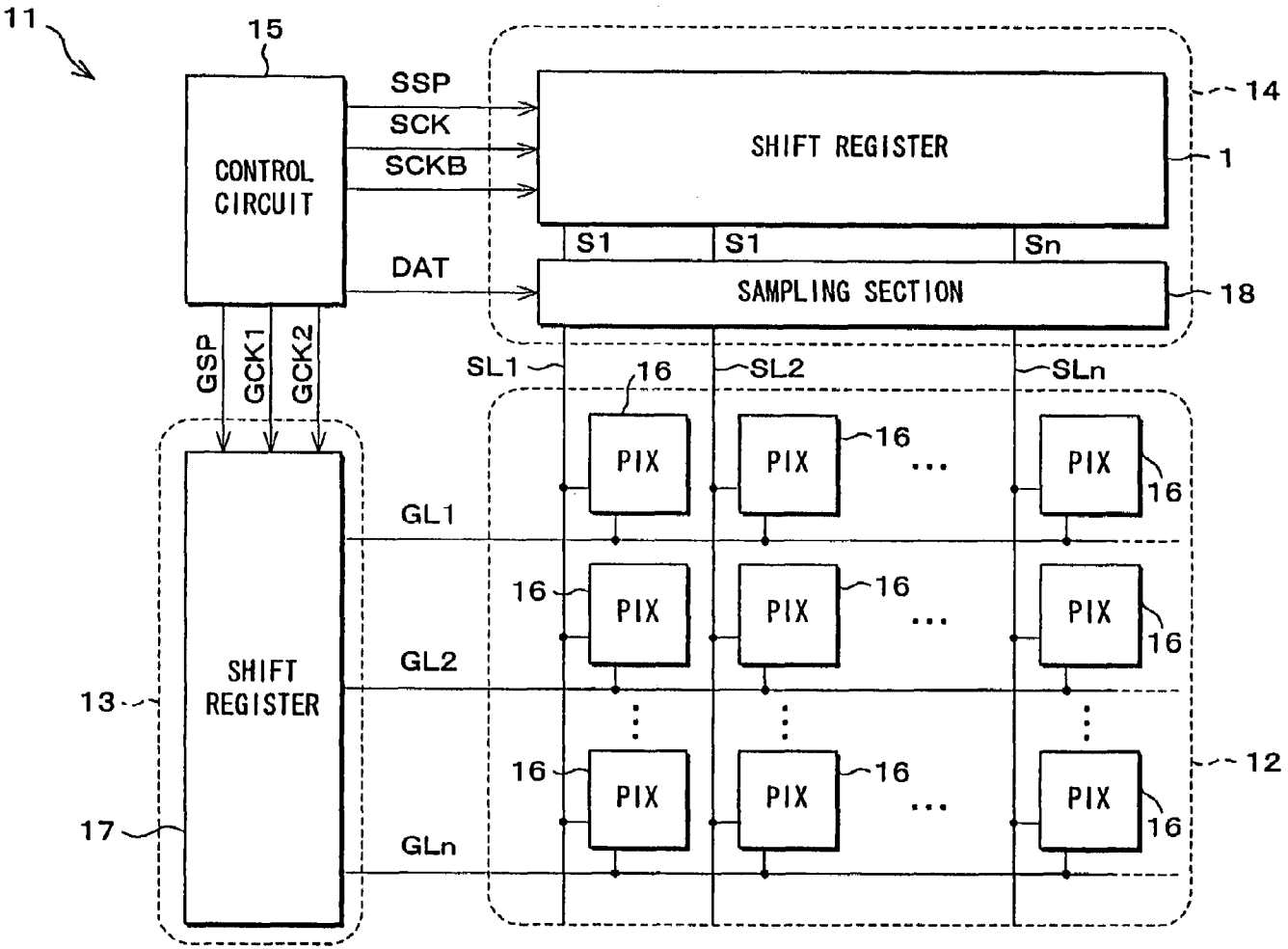
FIG. 2 is a drawing that shows a schematic construction of an image display device in which the above-mentioned shift register is used.

As illustrated in FIG. 1, the shift register 1 of the present embodiment, which is schematically constituted by a switch section 2, an input stability section 3 and a flip-flop section 4, is used as, for example, a data signal line driving circuit 14 in an image display device 11 shown in FIG. 2.

As illustrated in FIG. 2, the image display device 11 is provided with a display section 12, a scanning signal line driving circuit 13, a data signal line driving circuit 14 and a control circuit 15.

The display section 12 has n-number of scanning signal lines GL . . . (GL1, GL2, . . . GLn) that are mutually parallel to each other, n-number of data signal lines SL . . . (SL1, SL2, . . . SLn) that are mutually parallel to each other and pixels (PIX, in the Figure) 16 that are arranged in a matrix format. Each pixel 16 is formed in an area surrounded by two adjacent scanning signal lines GL•GL and two adjacent data signal lines SL•SL. Here, for convenience of explanation, the respective numbers of the scanning signal lines GLs and data signal lines SL are set to the same number; however, these numbers may of course be set to mutually different numbers.

The scanning signal line driving circuit 13 is provided with a shift register 17, and based upon two kinds of clock signals GCK1 and GCK2 inputted from a control circuit 15 and a start pulse GSP, the shift register 17 generates scanning signals successively so as to apply them to the respective scanning signal lines GL1, GL2, . . . , that are connected to the pixels 16 on respective rows. Additionally, with respect to the circuit construction of the shift register 17, a detailed description thereof will be given in the next Embodiment 2.

The data signal line driving circuit 14 is provided with a shift register 1 and a sampling section 18. Two kinds of clock signals SCK and SCKB having mutually different phases and a start pulse SSP are inputted from the control circuit 15 to the shift register 1. A video signal DAT is inputted from the control circuit 15 to the sampling section 18. Based upon signals S1 to Sn outputted from respective stages of the shift register 1, the data signal line driving circuit 14 sample the video signal DAT in its sampling section 18, and outputs the resulting image data to the data signal lines SL, SL2, . . . etc., connected to the pixels 16 in respective rows.

The control circuit 15 is a circuit that generates various control signals for controlling the operations of the scanning signal line driving circuit 13 and the data signal line driving circuit 14. As described above, the control signals include the clock signals GCK1, GCK2, SCK, SCKB, start signals GSP•SSP and video signal DAT, etc.

Here, switching elements are respectively installed in the scanning signal line driving circuit 13, the data signal line driving circuit 14, and the respective pixels 16 of the display section 12 in the present image display device 11. With respect to the manufacturing method of the switching elements, it will be explained in Embodiment 3 described later.

Figure 3:
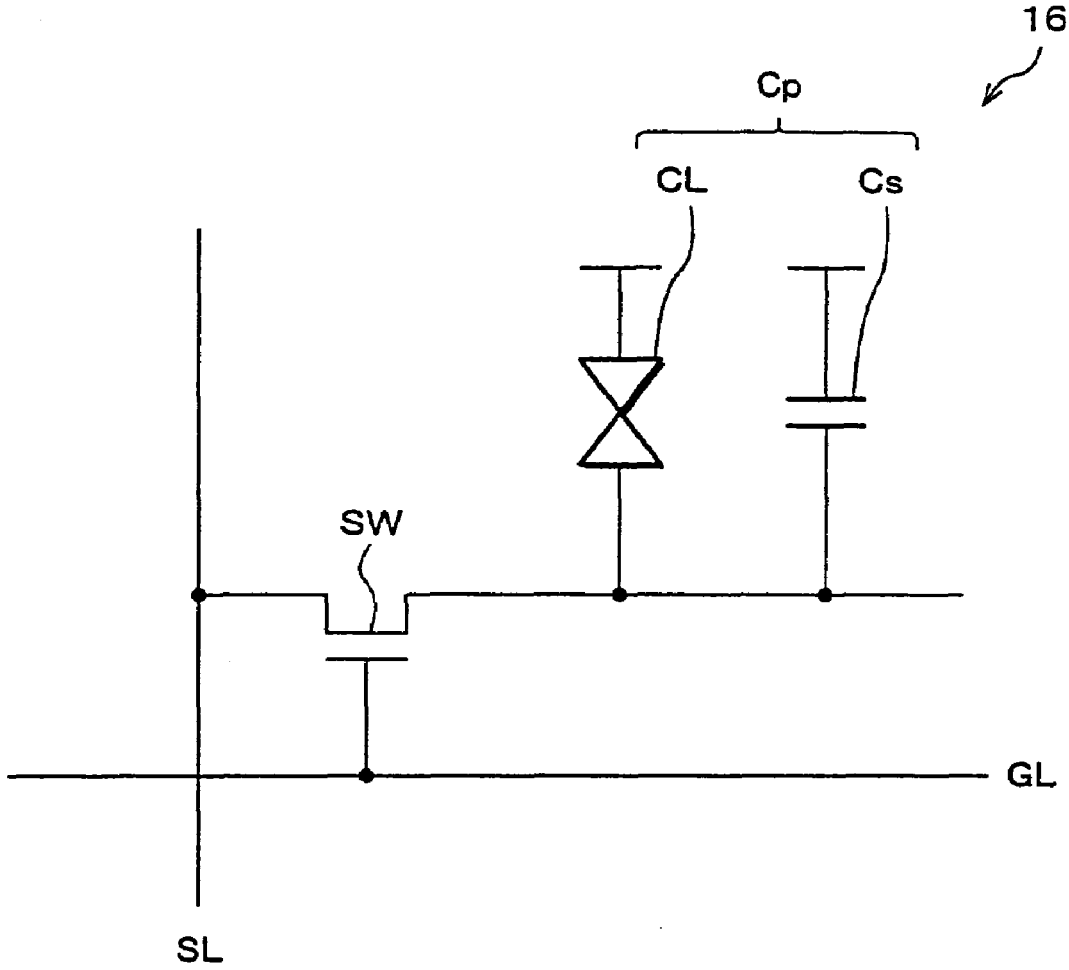
FIG. 3 is a drawing that shows the structure of a pixel in the above-mentioned image display device.

In the case when the present image display device 11 is provided as an active-matrix type liquid crystal display, as illustrated in FIG. 3, the pixels 16 is constituted by a pixel transistor SW formed by a field effect transistor, a pixel capacitor $C_P$ (added by an assist capacitor $C_S$, if necessary) containing a liquid crystal capacitance $C_L$. In this type of pixel 16, the data signal line SL and one of the electrodes of the pixel capacitor $C_P$ are connected through the drain and sauce of the pixel transistor SW, the gate of the pixel transistor SW is connected to the scanning signal line GL, and the other electrode of the pixel capacitor $C_P$ is connected to a common electrode line (not shown) that is commonly connected to all the pixels.

Here, in the case when it is assumed that a pixel 16, connected to the i-numbered data signal line SLi and the j-numbered scanning signal line GLj, is represented by PIX (i, j) (i and j are arbitrary integers in the ranges of $1 \leqq i$ and $j \leqq n$), upon selection of a scanning signal line GLj in the PIX (i, j), the pixel transistor SW is allowed to conduct so that a voltage, which has been applied to the data signal line SLi as image data, is applied to the pixel capacitor $C_P$. When a voltage is applied to the liquid crystal capacitance $C_L$ in the pixel capacitance $C_P$, the transmittance or reflectance of the liquid crystal display is modulated. Therefore, by applying a signal voltage corresponding to image data to a data signal line SLi while selecting a scanning signal line GLj, the display state of the corresponding PIX (i, j) can be changed in accordance with the image data.

In the image display device 11, the scanning signal line driving circuit 13 selects a scanning signal line GL, and image data for a pixel 16 corresponding to the combination of the selected scanning signal line GL and a data signal line SL is outputted to the corresponding data signal line SL by the data signal line driving circuit 14. Thus, the image data is written in the pixel 16 connected to the corresponding scanning signal line GL. Moreover, the scanning signal line driving circuit 13 successively selects the scanning signal lines GL, and the data signal line driving circuit 14 outputs image data to the data signal lines SL. As a result, the respective pieces of image data are written in all the pixels 16 of a display section 12 so that an image corresponding to the image signal DAT is displayed on the display section 12.

Figure 4:
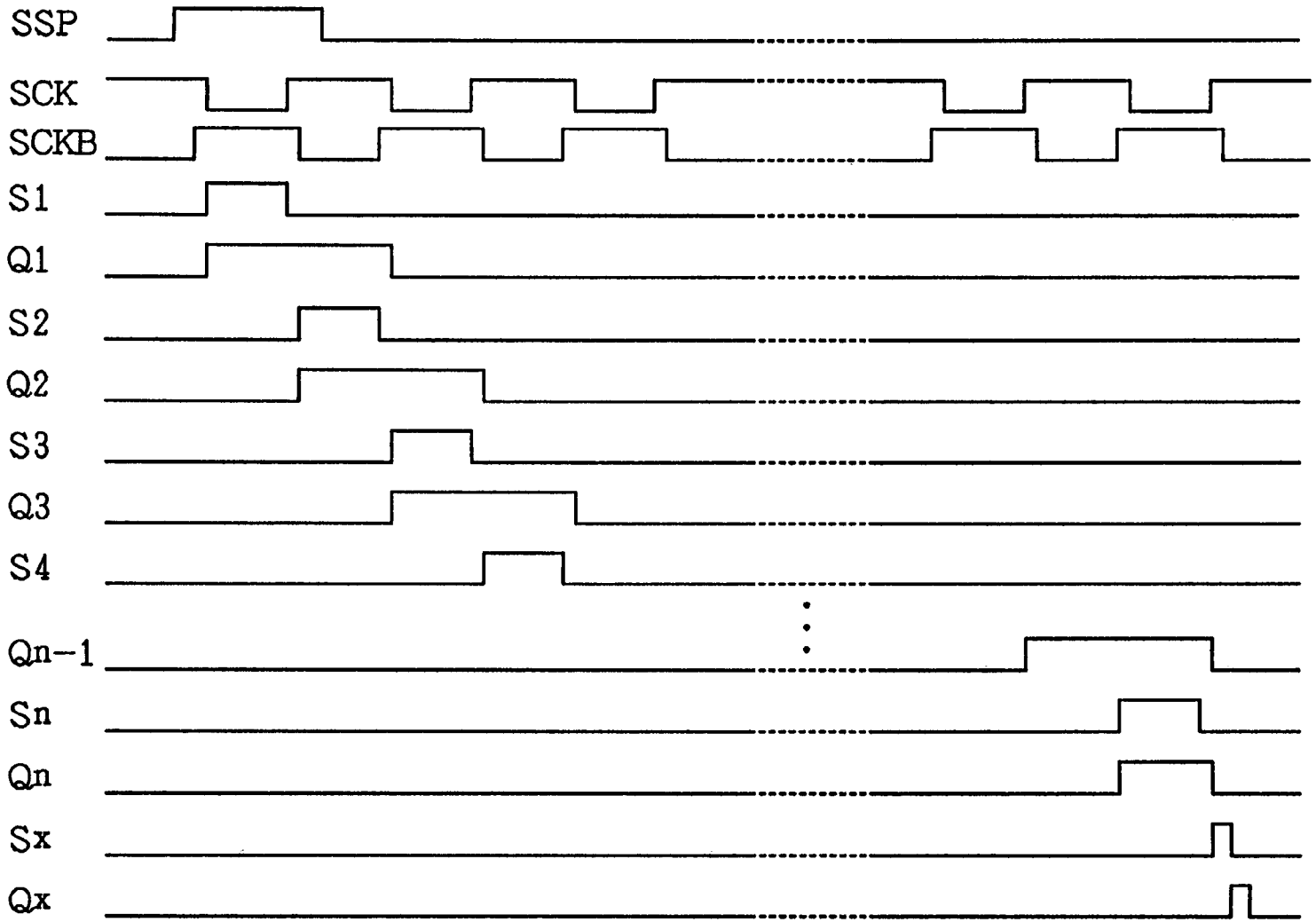
FIG. 4 is a timing chart that shows operations of the shift register.

The image data to the respective pixels 16 is transmitted from the control circuit 15 to the data signal line driving circuit 14 as a video signal DAT in a time-divided manner, and the data signal line driving circuit 14 extracts respective pieces of image data from the video signal DAT in synchronized timing with a clock signal SCK having a fixed cycle with a duty ratio of not more than 50% (in the present embodiment, Low period is shorter than High period), a clock signal SCKB (see FIG. 4) having a 180°-phase difference from the clock signal SCK and a start pulse SSP, which are timing signals.

More specifically, in response to the start pulse SSP that is inputted in synchronism with the clock signals SCK and SCKB, the shift register 1 of the data signal line driving circuit 14 successively outputs pulses, each corresponding to a half cycle of the clock, while shifting the pulses, thereby generating output signals S1 to Sn that are different from each other in timing by one clock. Moreover, the sampling section 18 of the data signal line driving circuit 14 extracts image data from the video signal DAT in synchronism with the respective output signals S1 to Sn.

In response to the start pulse GSP inputted in synchronism with the clock signal GCKl and GCK2, the shift register 17 of the scanning signal line driving circuit 13 successively outputs pulses, each corresponding to a half cycle of the clock, while shifting the pulses, thereby outputting scanning signals that are different from each other in timing by one clock to the respective scanning signal lines GL1 to GLn.

The following description will discuss the construction and operation of the shift register 1 of the present embodiment used in the data signal line driving circuit 14, and in Embodiment 2, an explanation will be given of the construction and operation of a shift register 17 used in the scanning signal line driving circuit 13.

As shown in FIG. 1, the shift register 1, which is constituted by n stages, has an arrangement in which, as described above, two kinds of clock signals SCK and SCKB having mutually different phases, and the start pulse SSP are inputted thereto. The clock signals SCK and SCKB are alternately inputted to the respective stages; that is, the clock signal SCK is inputted to odd stages and the clock signal SCKB is inputted to even stages.

The shift register 1 is provided with a switch 2, an input stabilizing section 3 and a flip-flop section 4. In the switch section 2, a switching means 21 is installed in each stage, and in the input stabilizing section 3, a p-type transistor (input stabilizing means) 22 is installed in each stage. Moreover, in the flip-flop section 4, a flip-flop (SR-FF, in the Figure) 23, which is a set-reset type flip-flop, and an inverter 24 are installed.

Figure 5:
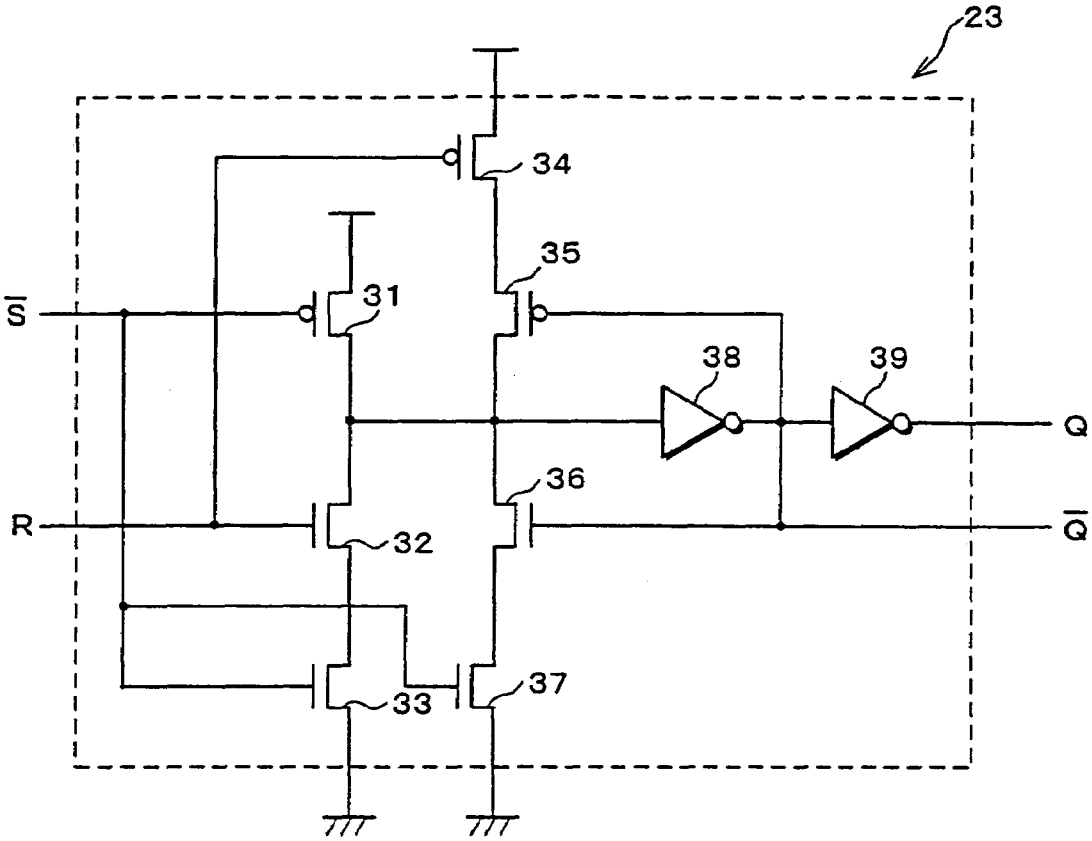
FIG. 5 is a circuit diagram that shows the construction of a set•reset type flip-flop that is used in the above-mentioned shift register.

For example, as illustrated in FIG. 5, the above-mentioned flip-flop 23 can be realized by an arrangement in which transistors 31, 34 and 35 that are p-type MOS transistors, transistors 32, 33, 36 and 37 that are n-type MOS transistors and inverters 38 and 39 are installed.

As illustrated in FIG. 5, in the flip-flop 23, the transistors 31, 32 and 33 are connected in series with each other between the driving voltage Vcc and the ground connection level, and a set signal /S of negative logic is applied to the gates of the transistors 31 and 33. Further, a reset signal R of positive logic is applied to the gate of the transistor 32. Moreover, the drain electric potentials of the transistors 31 and 32 mutually connected to each other are respectively inverted by the inverters 38 and 39, and outputted as output signals Q.

Furthermore, transistors 34, 35, 36 and 37 are connected in series with each other between the driving voltage Vcc and the ground connection level. The drains of the transistor 35 and 36 are connected to the input of the inverter 38, and the gates of the transistor 35 and 36 are connected to the output of the inverter 38. Here, the reset signal R is applied to the gate of the transistor 34 and the set signal /S is applied to the gate of the transistor 37.

Figure 6:
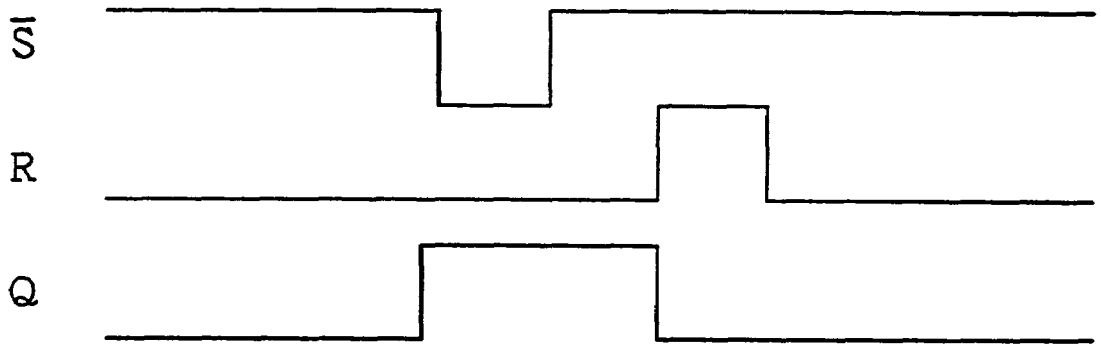
FIG. 6 is a timing chart that shows the operation of the set•reset type flip-flop.

As illustrated in FIG. 6, in the flip-flop 23, when the set signal /S is changed to be inactive (Low Level) while the reset signal R is inactive (Low Level), the transistor 31 is allowed to conduct, thereby changing the input of the inverter 38 to High Level. Consequently, the output signal Q of the flip-flop 23 is changed to High Level.

Moreover, in the above-mentioned state, the reset signal R and the output of the inverter 38 allow the transistors 34 and 35 to conduct. Moreover, the reset signal R and the output of the inverter 38 allow the transistors 32 and 36 to be cut off. With this arrangement, even when the set signal /S is changed to be inactive, the input of the inverter 38 is maintained in High Level, and the output signal Q is also maintained in High Level.

Thereafter, when the reset signal R becomes inactive, the transistor 34 is cut off, while the transistor 32 is allowed to conduct. Here, since the set signal /S is maintained inactive, the transistor 31 is cut off, thereby allowing the transistor 33 to conduct. Therefore, the input of the inverter 38 is driven to Low Level, thereby changing the output signal Q to Low Level.

As illustrated in FIG. 1, an output signal Q (Q1, Q2 . . . , etc.) of the flip-flop 23 on each stage is inputted to the switching means 21 on the next stage, and also inputted to the gate of the p-type transistor 22 on the next stage. Each switching means 21 controls the input of the clock signal SCK or SCKB to each stage by its opening and closing operations; thus, while the output signal Q of the flip-flop 23 on the previous stage is maintained in Low Level, it is opened (switched off), and while the output signal Q is maintained in High Level, it is closed (switched on). The clock signal SCK or SCKB, inputted to each stage, is inputted to the flip-flop 23 as the set signal/S, and also inputted to the inverter 24.

The p-type transistor 22 is used for stabilizing the input of the flip-flop 23 in the case when the clock signal SCK and SCKB is not inputted. While the output signal Q is maintained in High Level, the p-type transistor 22 becomes nonconductive between its source and drain, and while the output signal Q is in Low Level, it becomes conductive between its source and drain.

The flip-flop 23 is arranged so that each time the clock signal SCK and SCKB falls, it outputs the start signal SSP having a width of one-clock cycle to the next stage. More specifically, the clock signal SCK and SCKB, which is controlled by the switching means 21 that is opened and closed by the output signal Q (the start signal SSP in the first stage) on the previous stage, is applied to the flip-flop 23 as a set signal /S of negative logic, and at the first stage, is outputted as the output S1 of the shift register 1 through the inverter 24. The output signal Q1 of the flip-flop 23 on the first stage is applied to the switching means 21 on the next stage as a switching signal thereof.

Moreover, to each flip-flop 23, a signal, which is delayed by a pulse width to be transmitted to the inverter 24 as an output of the shift register 1 through the inverter 24, is applied to a reset signal R. In the present shift register 1, since a pulse having a width of one-clock cycle is transmitted, the switching is made by a signal having a delay of one-clock cycle, that is, by the switching means 21 located at two stages after the present stage, and the output signal of the shift register 1 released from the inverter 24 of the corresponding stage is applied as the reset signal R of positive logic.

Moreover, in order to set the flip-flop 23 on the odd stage in response to the trailing-edge of the clock signal SCK, the clock signal SCK is inputted to the switching means 21 on the odd stage. On the other hand, in order to set the flip-flop 23 on the even stage upon receipt of the trailing-edge of the clock signal SCKB, the clock signal SCKB is inputted to the switching means 21 on the even stage.

Therefore, the shift register 1 is operated as described below.

When the start signal SSP goes high, the switching means 21 on the first stage, to which it is connected, is switched correspondingly, with the result that the clock signal SCK is inputted to the flip-flop 23. At this time, in the p-type transistor 22 on the first stage of the input stabilizing section 3, since the start signal SSP is inputted to the gate, the nonconductive state is provided between the source and drain. Therefore, the signal, inputted by the switchover of the switching means 21 on the first stage, is sent through the inverter 24 as an output S1 that forms a sampling signal for extracting image data from the video signal DAT.

In response to the trailing-edge of the input clock signal SCK, the output signal Q1 of the flip-flop 23 on the first stage is allowed to go high. The high-level output signal Q1 turns on the switching means 21 on the next stage (second stage), thereby allowing the clock signal SCKB to be inputted. The clock signal SCKB is inputted to the flip-flop 23 on the second stage so that an output signal Q2 is generated, and is also sent through the inverter 24 to be released as an output S2 that forms a sampling signal for extracting image data from the video signal DAT.

Moreover, when the output signal Q2 turns on the switching means 21 on the next stage (third stage), the clock signal SCK is inputted to the corresponding stage. The clock signal SCK is inputted to the flip-flop 23 on the third stage so that an output signal Q3 is generated, and is also sent through the inverter 24 to be released as an output S3 that forms a sampling signal for extracting image data R from the video signal DAT.

Here, the signal S3 on the third stage is inputted to the flip-flop 23 on the first stage as a reset signal R, thereby allowing the output signal Q1 to go low. When the output signal Q1 goes low, the switching means 21 on the second stage is turned off. At this time, the p-type transistor 22 on the second stage becomes conductive between its source and drain so that the input section of the flip-flop 23 on the second stage is set to High Level, and stabilized.

In the case of the flip-flop 23 on the first stage, when the start signal SSP goes low, the switching means 21 on the first stage turns off, thereby stopping the input of the clock signal SCK. At this time, the p-type transistor 22 on the first stage becomes conductive between its source and drain so that the input section of the flip-flop 23 on the first stage is set to High Level, and stabilized.

Thereafter, sequential signals are generated in the same manner as described above, and as illustrated in FIG. 4, based upon the clock signals SCK and SCKB, it is possible to obtain the output signals S1 to Sn that are not overlapped with each other. In other words, since each of the output signals S1 to Sn has a pulse width with a sufficiently long period of conductive state, the rising-edge or trailing-edge timing of the clock signals SCK or SCKB are allowed to pass through the switch without hardly any delay, with the result that the output signals S1 to Sn are not overlapped with each other.

Figure 32:
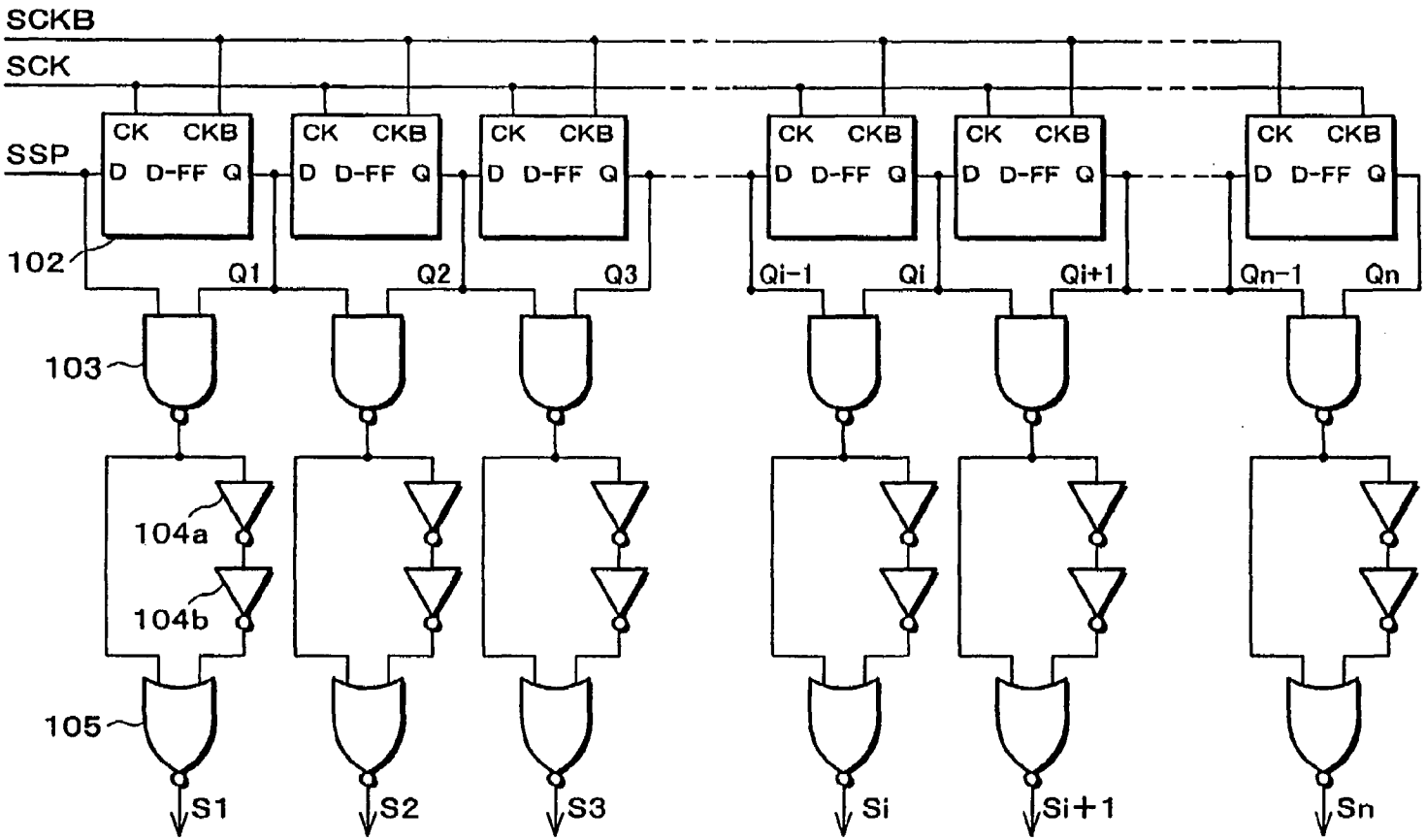
FIG. 32 is a circuit diagram that shows a construction of a conventional shift register used in a data signal line driving circuit.
Figure 33:
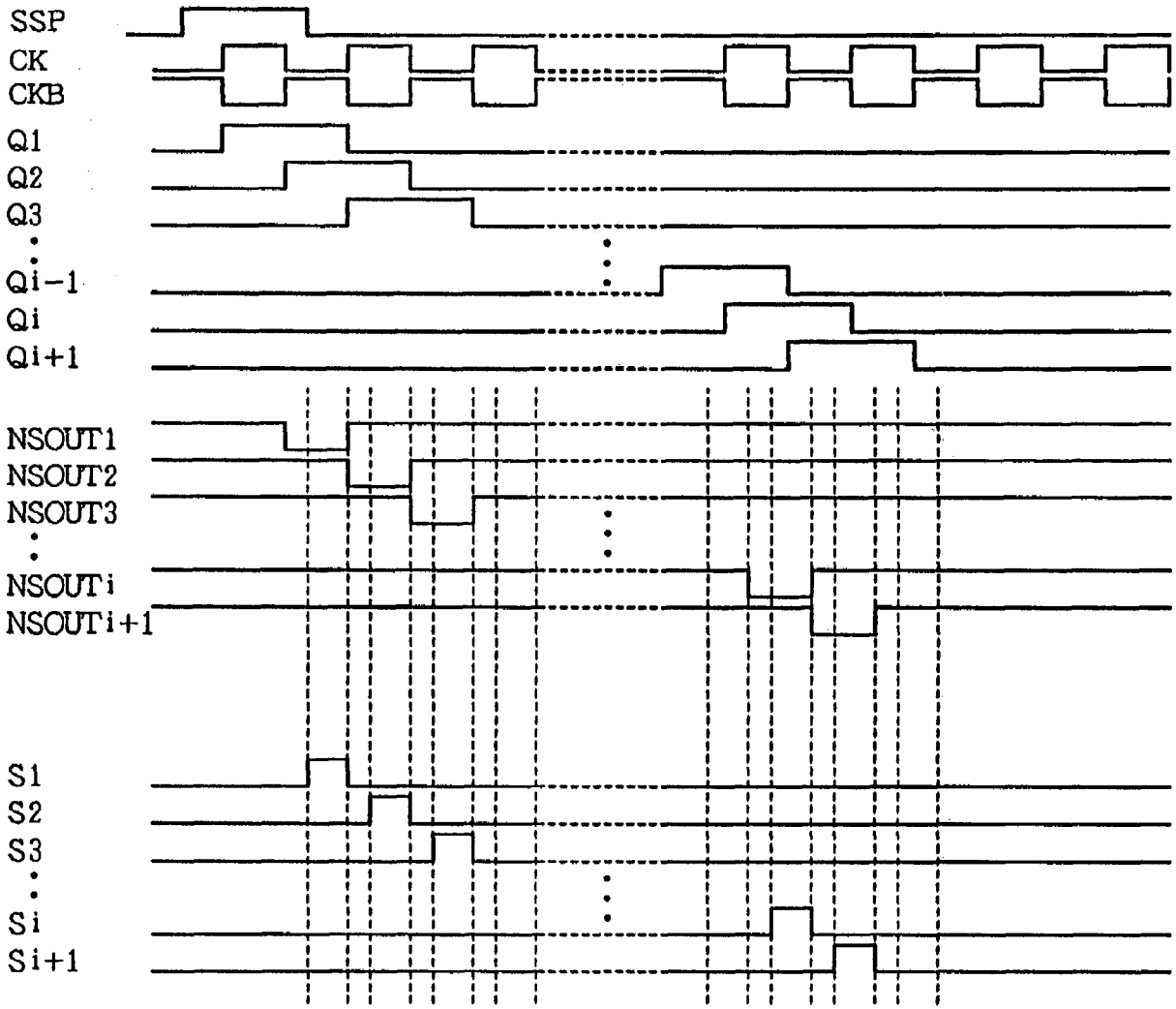
FIG. 33 is a timing chart that shows the operation of the conventional shift register.
Figure 34:
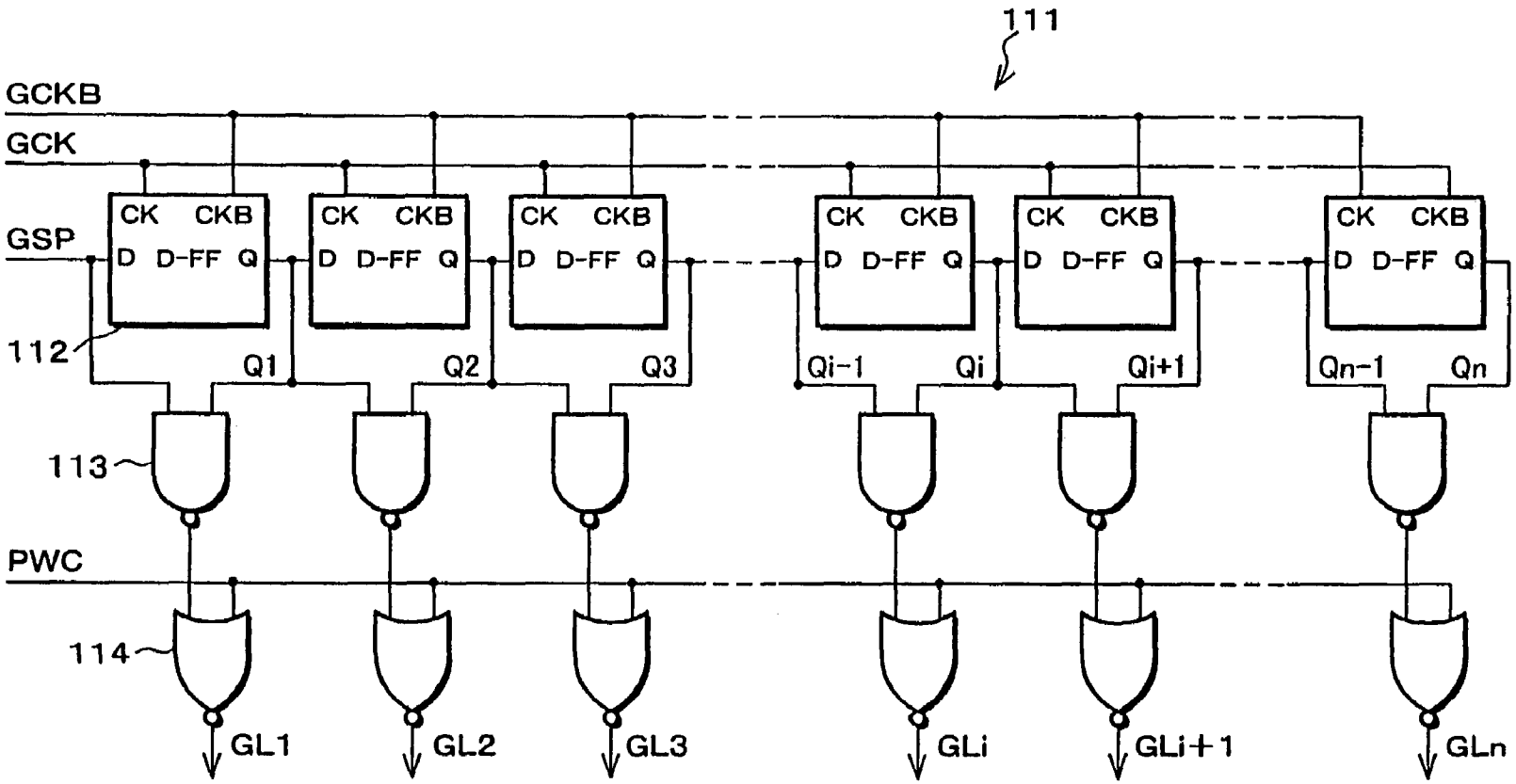
FIG. 34 is a circuit diagram that shows a construction of a conventional shift register used in a scanning signal line driving circuit.
Figure 35:
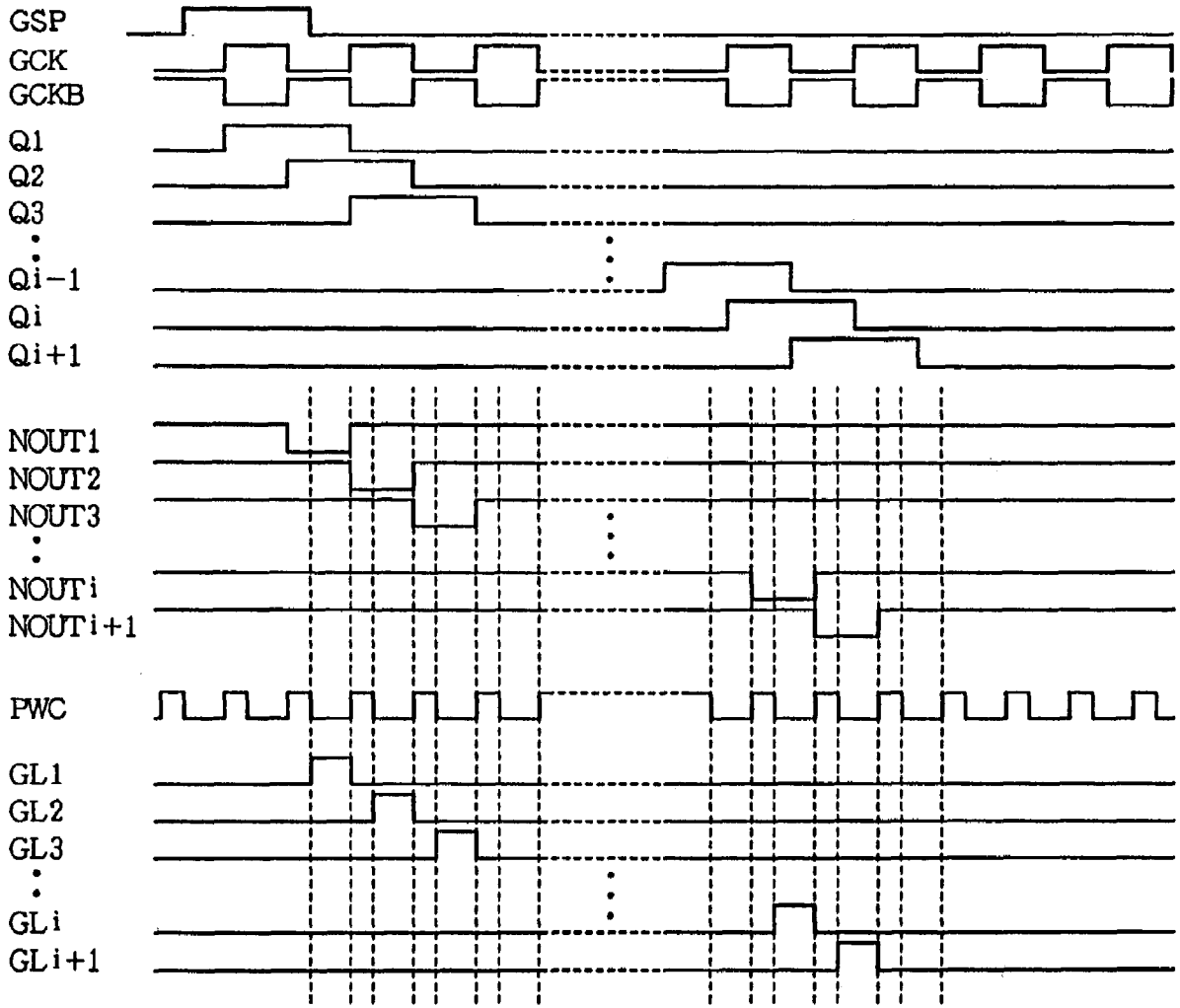
FIG. 35 is a timing chart that shows the operation of a shift register in the conventional scanning signal driving circuit.
Figure 36:
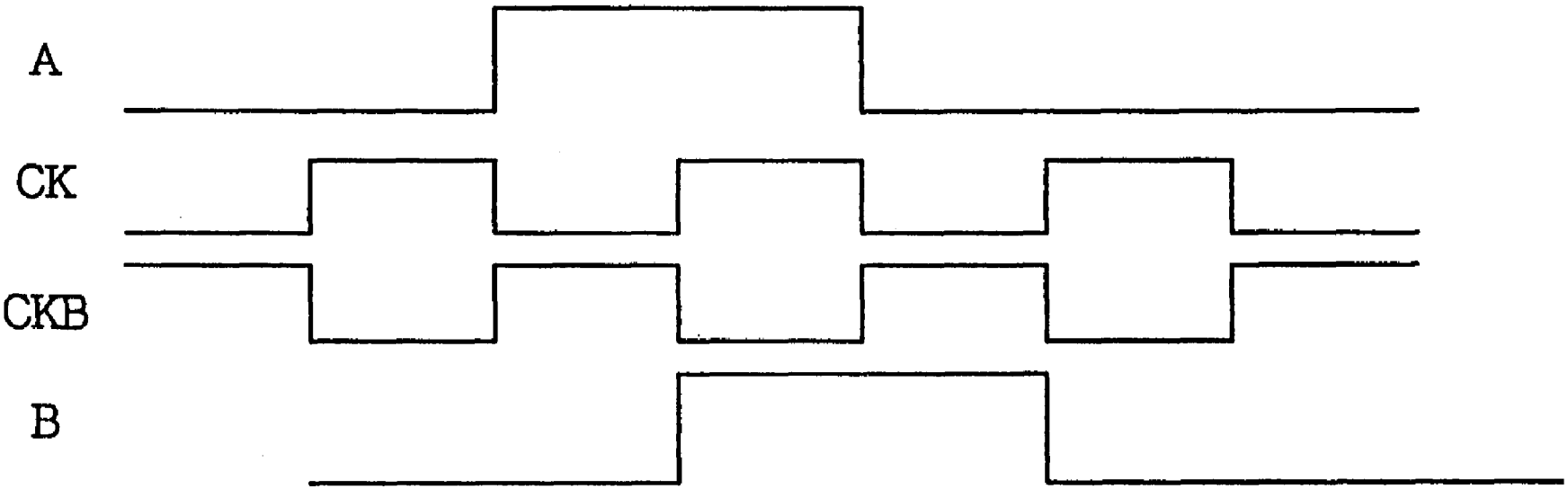
FIG. 36 is a timing chart that shows the operation of a D-type flip-flop.
Figure 37:
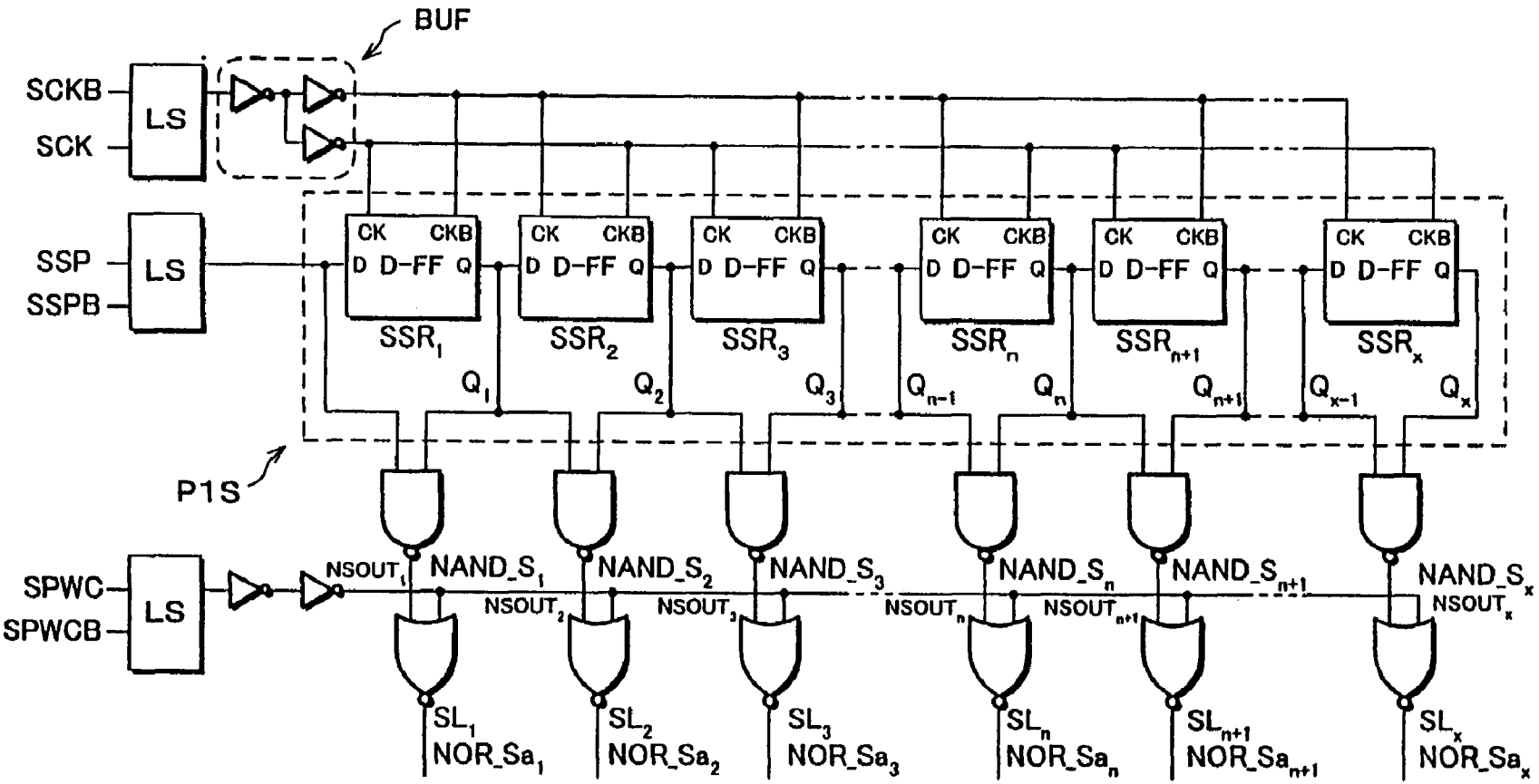
FIG. 37 is a circuit diagram that shows the construction of a shift register section of a conventional data signal line driving circuit.
Figure 38:
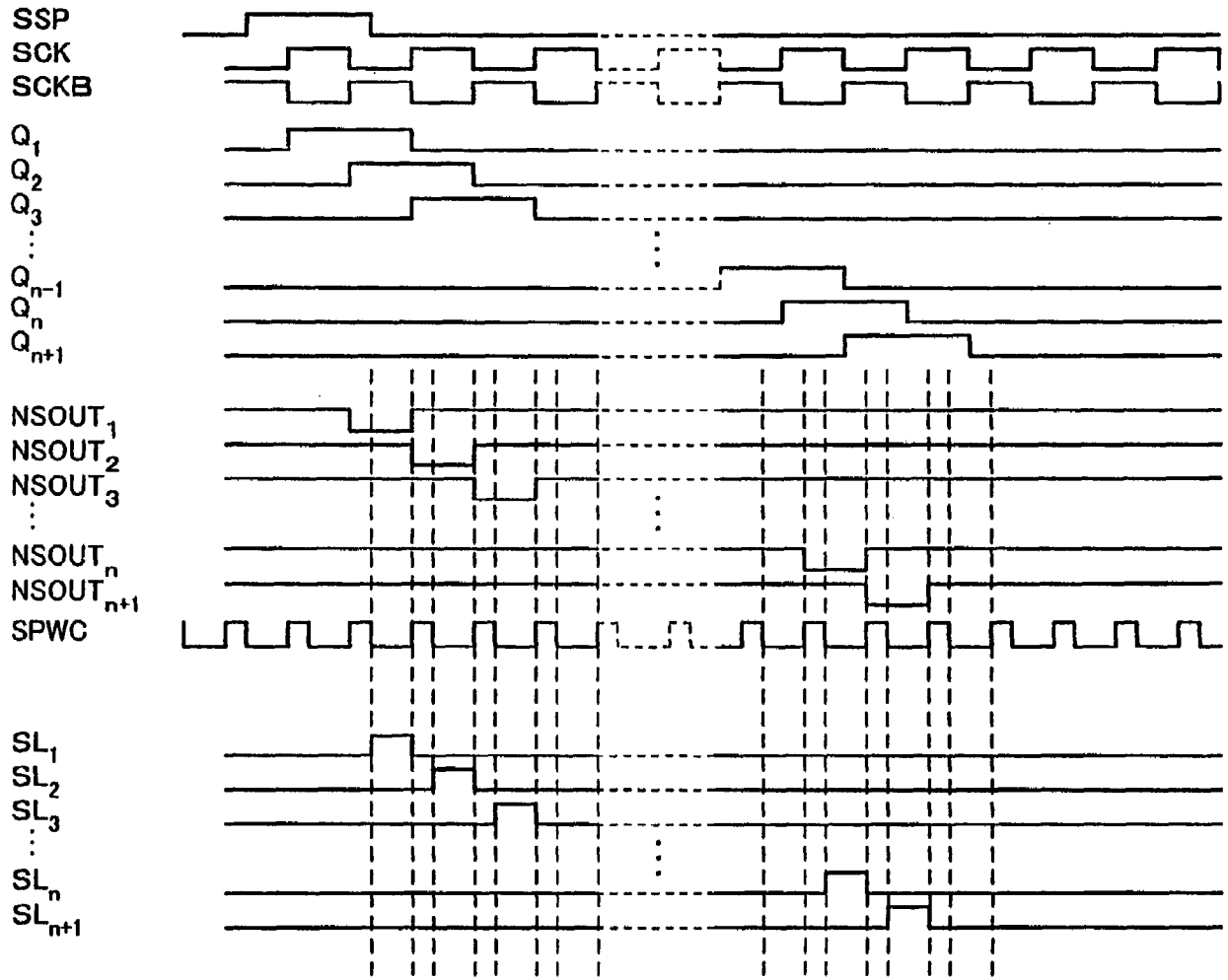
FIG. 38 is a timing chart that shows the operation of the shift register section of the conventional data signal line driving circuit.
Figure 39:
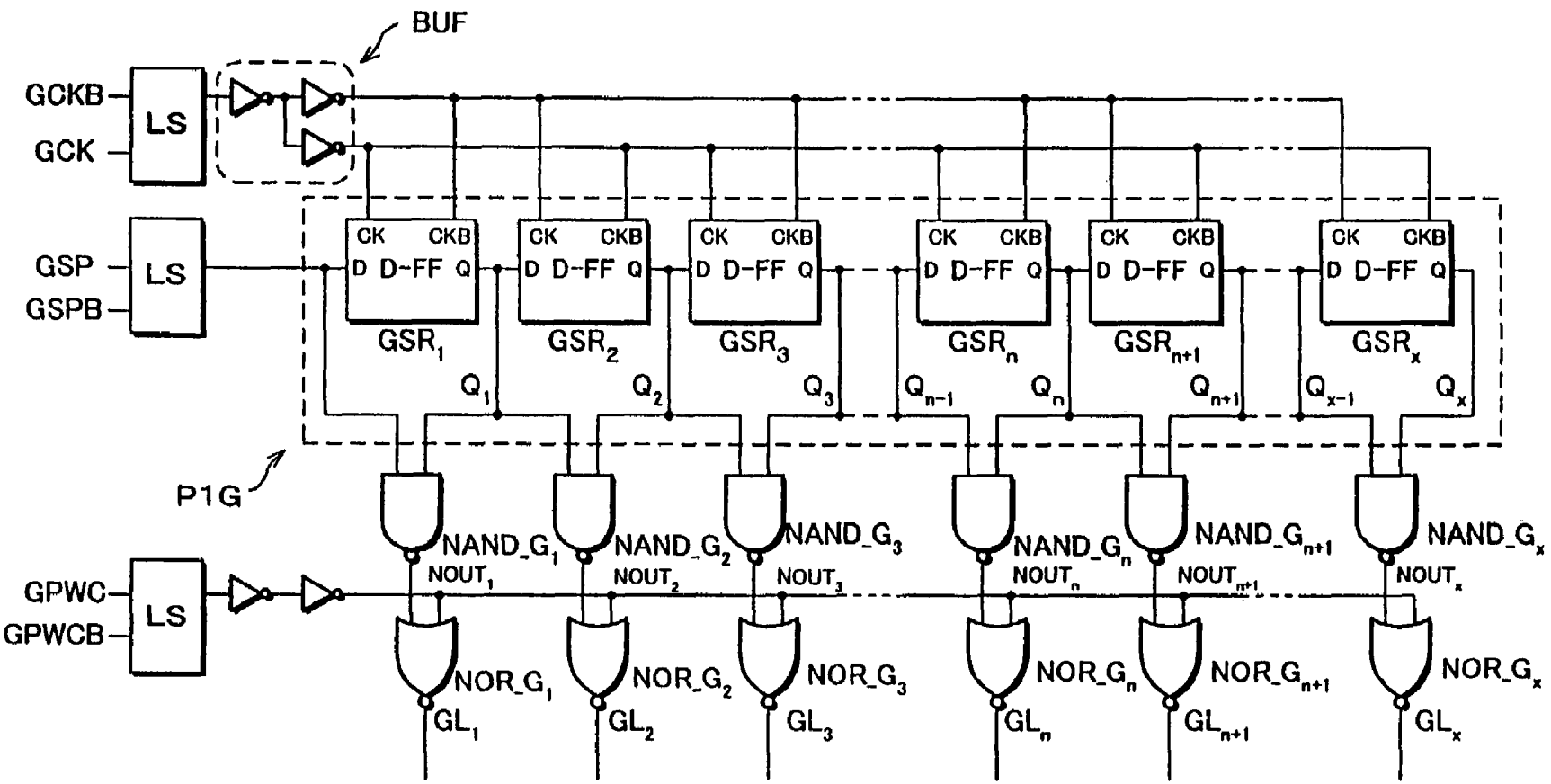
FIG. 39 is a circuit diagram that shows the construction of a shift register section of a conventional scanning signal line driving circuit.
Figure 40:
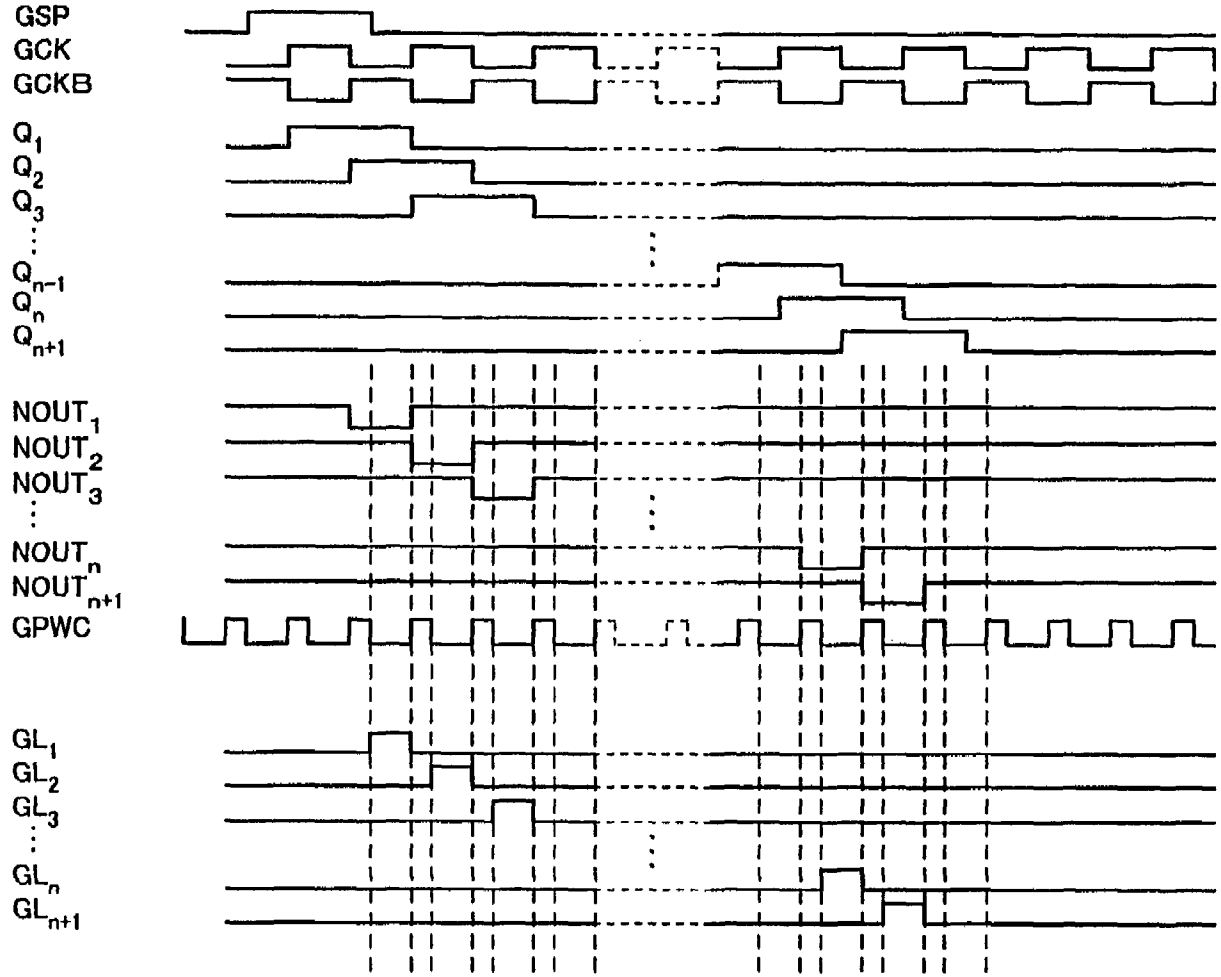
FIG. 40 is a timing chart that shows the operation of the shift register section of the conventional scanning signal line driving circuit.

In contrast, in a conventional arrangement which forms output pulses by using logic devices as shown in FIG. 32, delay tends to occur in the pulse rising-edge or trailing-edge timing due to deviations in the switching time, etc. of the transistors constituting the logic devices, resulting in a problem of overlapped output pulses.

Here, in the shift register 1 of the present embodiment, as illustrated in FIG. 1, dummy-use devices, such as a switching means 21*x*, a p-type transistor 22*x*, a flip-flop 23*x* and an inverter 24*x*, are installed. Then, an output signal Sx from the inverter 24*x* is inputted to the reset terminal of the flip-flop 23 on the n-numbered stage, and the output signal Qx of the flip-flop 23*x* is inputted to the reset terminal of the flip-flop 23*x* on the final stage. Therefore, the flip-flop 23*x* on the final stage is set so as to generate an output signal Qx, and is also reset simultaneously so that the output signal Qx comes to have a waveform shown in FIG. 4.

Here, the output signal Sx from the inverter 24*x* is inputted to the reset terminal of the flip-flop 23 on the n-numbered stage; however, instead of this arrangement, the output signal Qx of the flip-flop 23*x* on the final stage may be inputted to the reset terminal of the flip-flop 23 on the n-numbered stage.

As described above, in the shift register 1 of the present embodiment, since the output pulses of the respective stages are not overlapped with each other and since no logic devices, etc. are required, it is possible to simplify the circuit construction. Moreover, the application of such a shift register 1 makes it possible to simplify the driving circuit, and consequently to provide an image display apparatus with a thinner frame portion.

Here, in the present embodiment, two kinds of clock signals are inputted to the shift register 1; however, the present invention is not intended to be limited by this arrangement, and not less than three kinds of clock signals may be inputted thereto.

Moreover, in the clock signals SCK and SCKB to be inputted to the shift register 1, the Low period is set to be shorter than the High period; however, the present invention is not intended to be limited by this arrangement, and a clock signal with the Low period and High period having the same length may be inputted thereto.

Furthermore, in the present embodiment, the output signal from the inverter 24 located two stages after the present stage is inputted to the reset terminal of each flip-flop 23 of the shift register 1; however, the present invention is not intended to be limited thereby. In other words, any of the following arrangements may be adopted: M kinds (M≧2) of clock signals are inputted, and supposing that k is an arbitrary integer not less than 1, an output pulse of the (i+k×M)-numbered stage (an output signal of the inverter 24 on the (i+k×M)-numbered stage) may be inputted to the reset terminal of the flip-flop 23 on the i-numbered stage. For example, as in the case of the shift register 25 of FIG. 7, an output signal of the inverter 24 located four stages after the present stage may be inputted to the reset terminal of each flip-flop 23.

The shift register 1, shown in FIG. 1, has an arrangement in which k=1 and M=2 are set, and for example, an output pulse of the third stage is inputted to the reset terminal of the flip-flop 23 on the first stage. In the case of the shift register 25 shown in FIG. 7, k=2 and M=2 are set, and for example, an output pulse of the fifth stage is inputted to the flip-flop 23 on the first stage.

Figure 8:
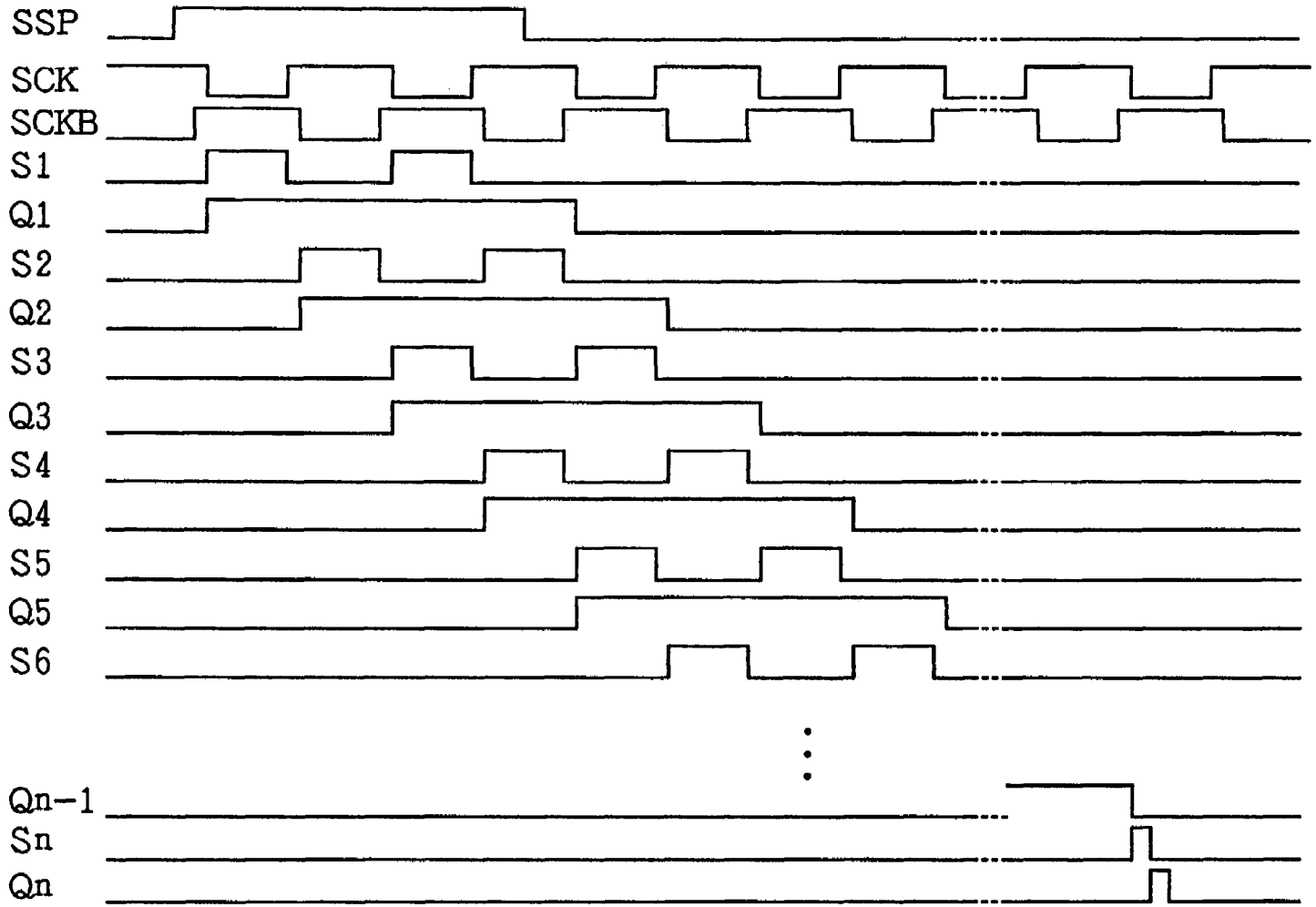
FIG. 8 is a timing chart that shows the operation of the shift register of FIG. 7.

FIG. 8 is a timing chart that shows the operation of the shift register 25. As shown in this Figure, the output signal Q1 of the flip-flop 23 on the first stage is reset by the output pulse S5 of the fifth stage, and the output signal Q2 of the flip-flop 23 on the second stage is reset by the output pulse S6 on the sixth stage. Here for example, as in the case of the output pulse S1, set signals are inputted to the flip-flop 23 twice; however, no adverse effect is given to the operation of the flip-flop 23. Moreover, the output pulse S5 on the fifth stage is used so as to reset the flip-flop 23 on the first stage; however, even when the reset signals are inputted twice in this manner, no adverse effect is given to the operation of the flip-flop 23.

Figure 7:
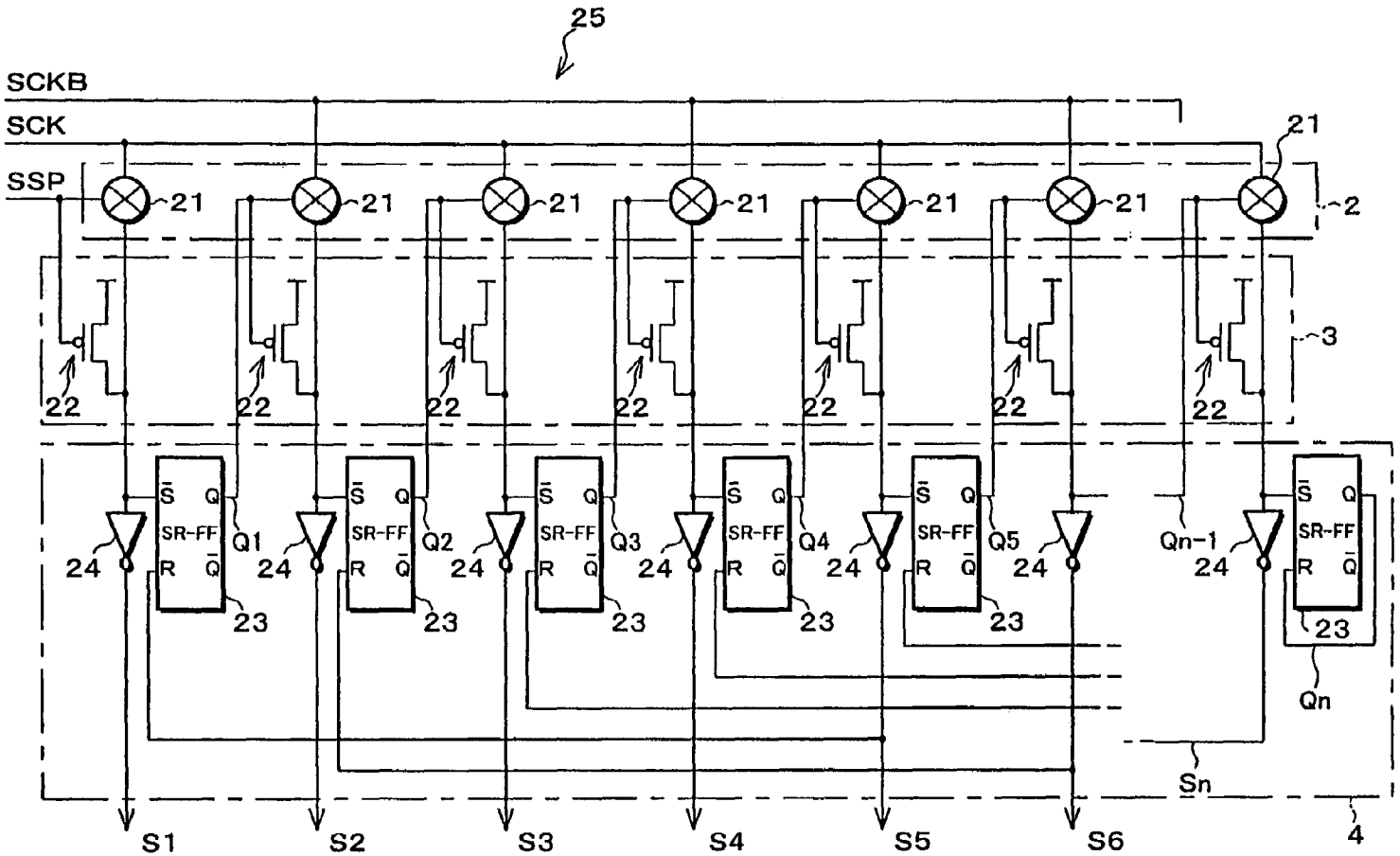
FIG. 7 is a circuit diagram that shows a structural example in which the input to the reset terminal of each flip-flop is altered.

Moreover, in the case when the shift register 25 shown in FIG. 7 is used in the data signal line driving circuit 14, the video signal DAT can be sampled twice by the output pulses. In other words, provision can be made so that the first sampling process is provided as a preliminary sampling process and the second sampling process is carried out so as to allow the data signal line to sample a desired video signal DAT. Moreover, the preliminary sampling process also has an effect to aid the second charging process.

Figure 11:
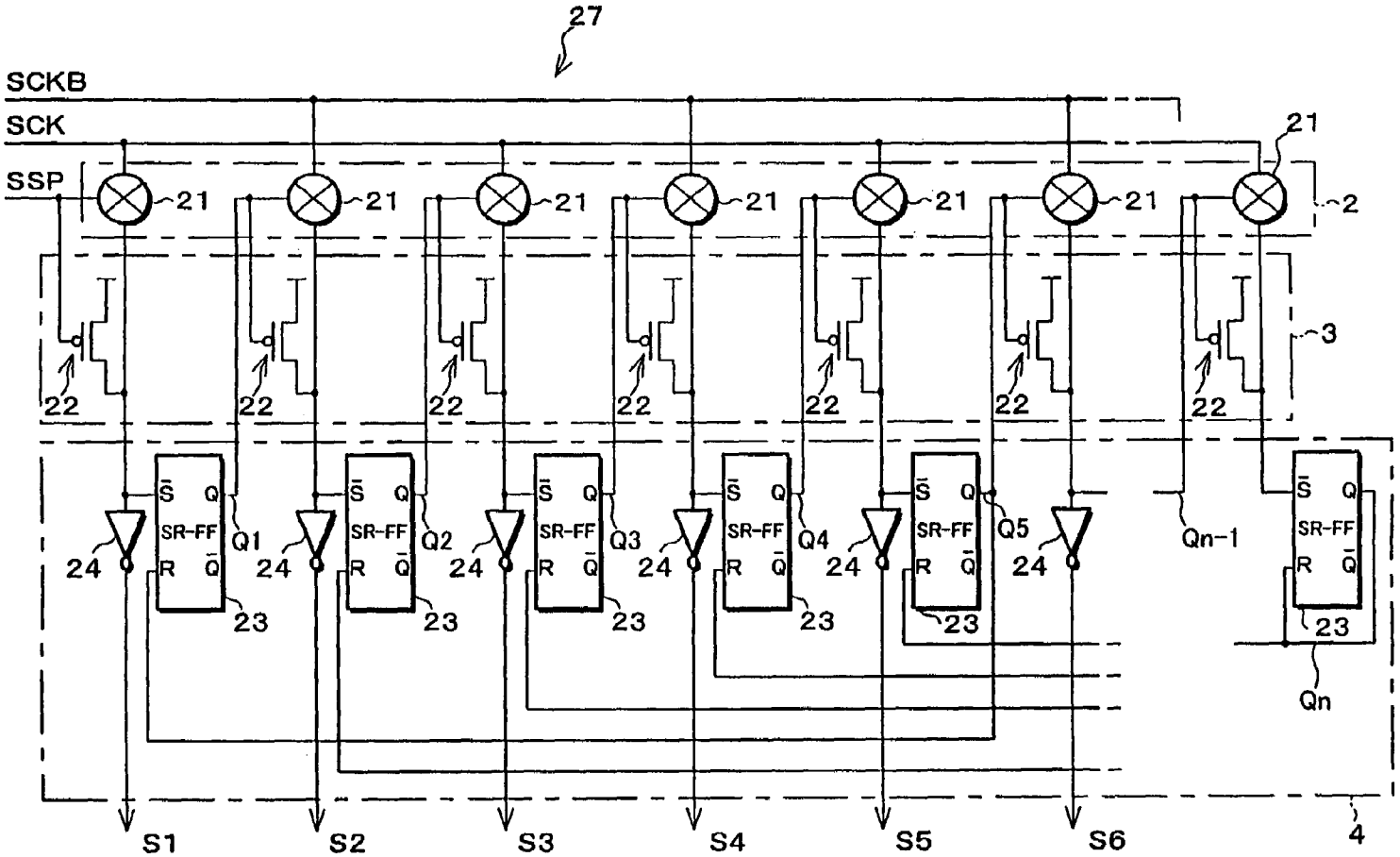
FIG. 11 is a circuit diagram that shows still another structural example in which the input to the reset terminal of each flip-flop is altered.

Moreover, in the shift register of the present invention, M kinds (M≧2) of clock signals are inputted, and supposing that k is an arbitrary integer not less than 1, an output signal of the flip-flop 23 on the (i+k×M)-numbered stage may be inputted to the reset terminal of the flip-flop 23 on the i-numbered stage. For example, as in the case of the shift register 26 of FIG. 9, an output signal of the flip-flop 23 located two stages after the present stage may be inputted to the reset terminal of each flip-flop 23. Moreover, as in the case of the shift register 27 of FIG. 11, an output signal of the flip-flop 23 located four stages after the present stage may be inputted to the reset terminal of each flip-flop 23.

Figure 9:
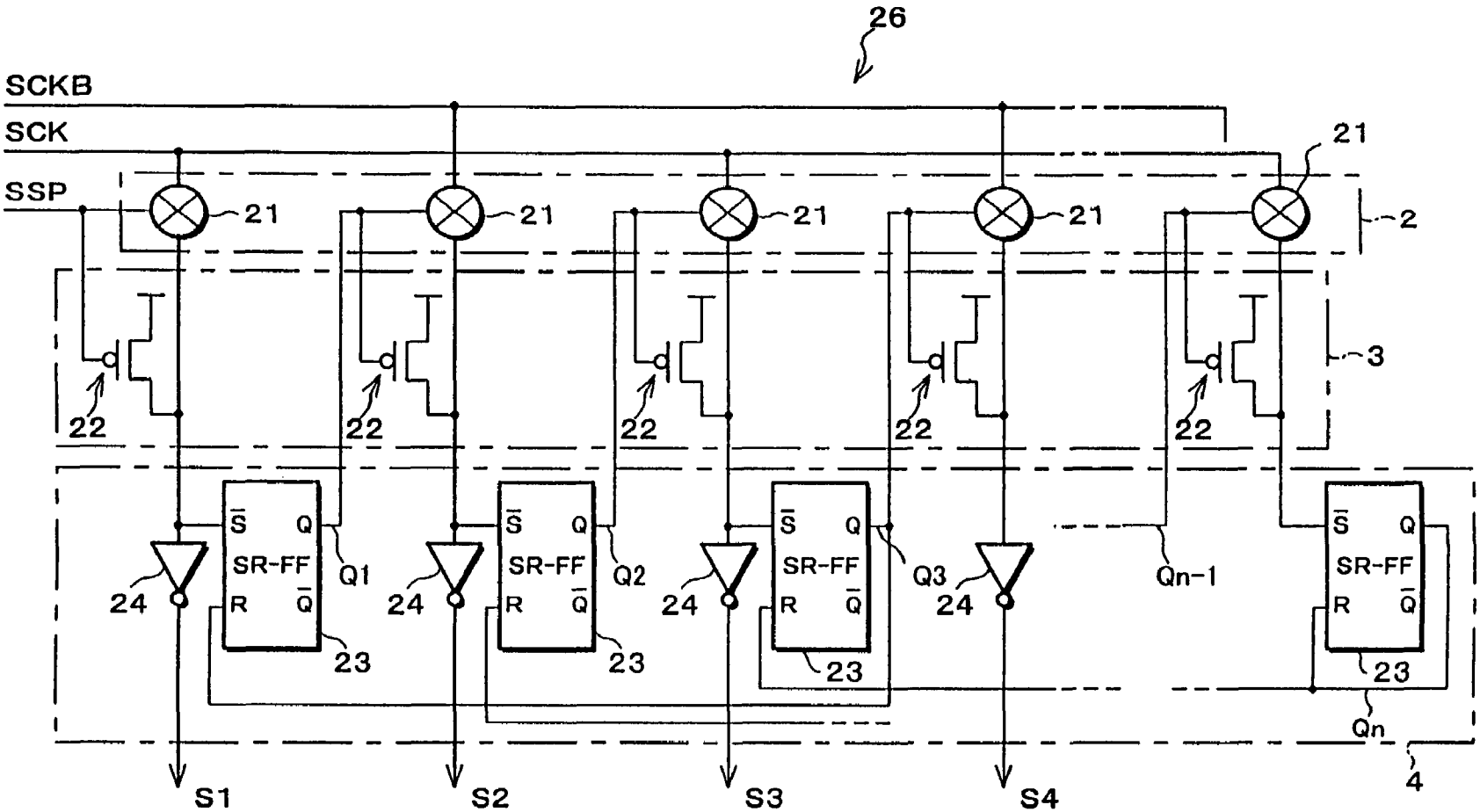
FIG. 9 is a circuit diagram that shows another structural example in which the input to the reset terminal of each flip-flop is altered.

The shift register 26, shown in FIG. 9, has an arrangement in which k=1 and M=2 are set, and for example, the output signal Q3 of the flip-flop 23 on the third stage is inputted to the reset terminal of the flip-flop 23 on the first stage. In the case of the shift register 27 shown in FIG. 11, k=2 and M=2 are set, and for example, the output signal Q5 on the fifth stage is inputted to the flip-flop 23 on the first stage.

Figure 10:
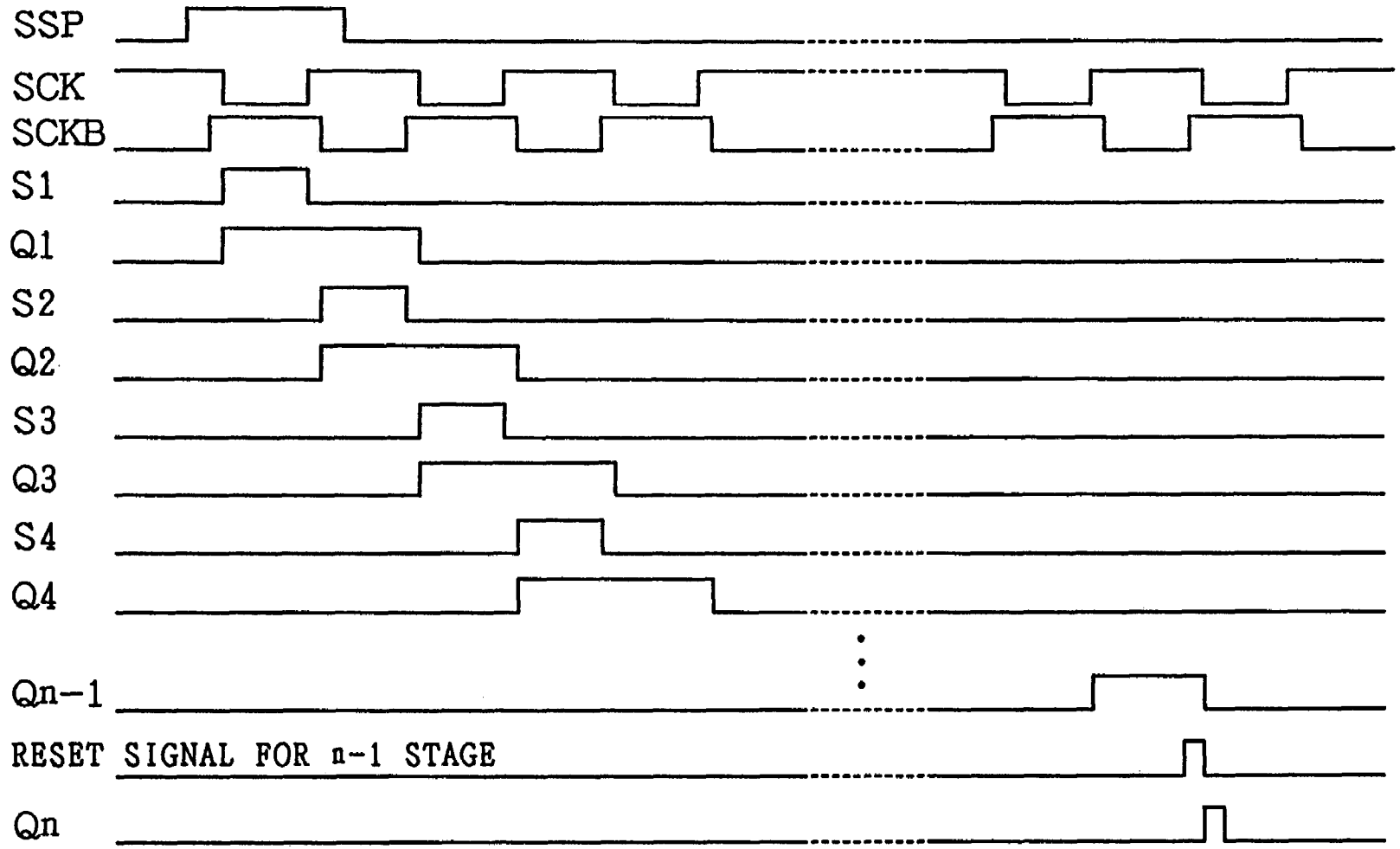
FIG. 10 is a timing chart that shows the operation of the shift register of FIG. 9.
Figure 12:
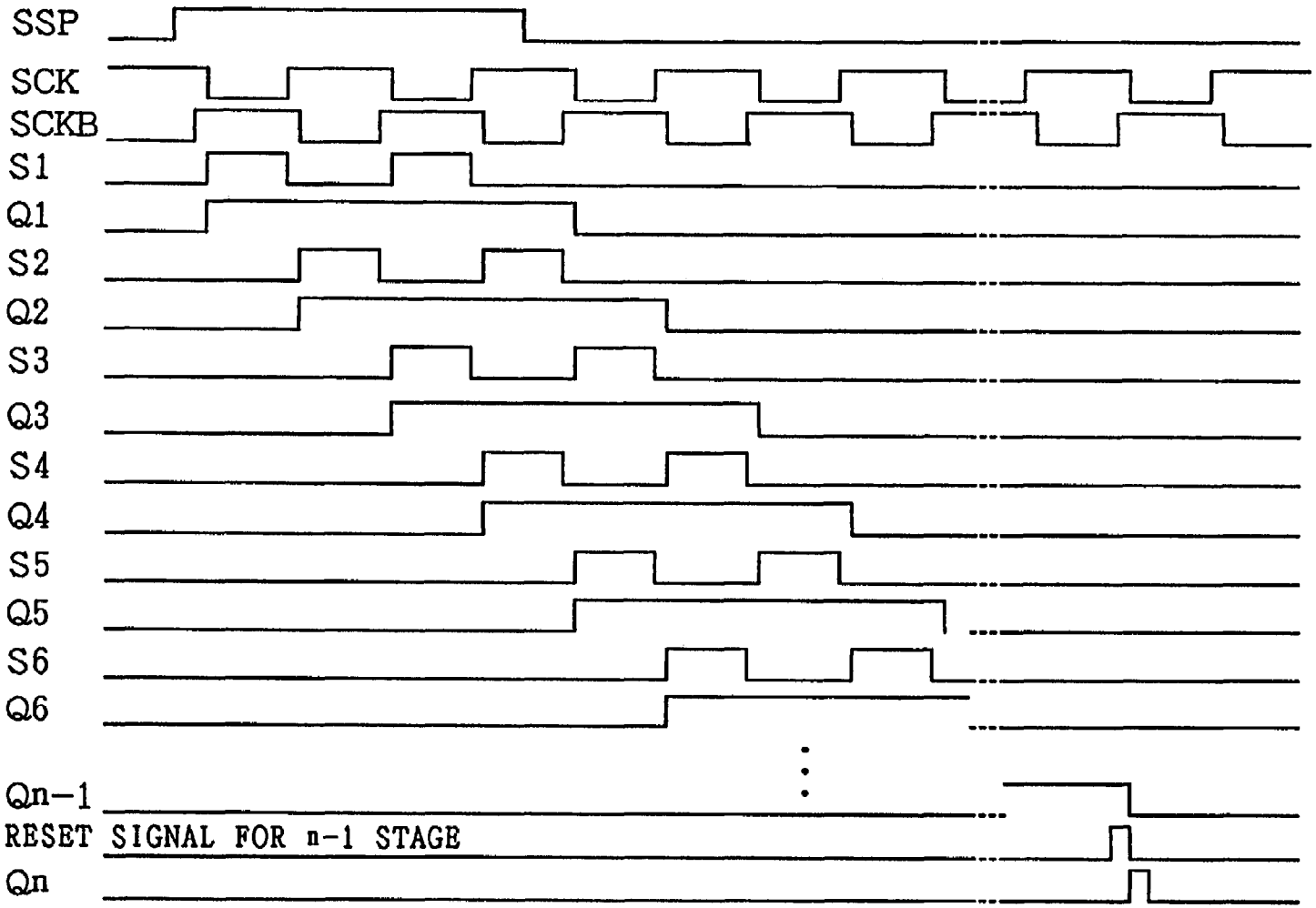
FIG. 12 is a timing chart that shows the operation of the shift register of FIG. 11.

FIG. 10 is a timing chart that shows the operation of the shift register 26. As shown in this Figure, the flip-flop 23 on the first stage is reset by the output signal Q3 of the flip-flop 23 on the third stage, and the flip-flop 23 on the second stage is reset by the output signal Q4 of the flip-flop 23 on the fourth stage. Moreover, FIG. 12 is a timing chart that shows the operation of the shift register 27. As shown in this Figure, the flip-flop 23 on the first stage is reset by the output signal Q5 of the flip-flop 23 on the fifth stage, and the flip-flop 23 on the second stage is reset by the output signal Q6 of the flip-flop 23 on the sixth stage. With these arrangements, the shift registers 26 and 27 have the same functions as the above-mentioned shift registers 1 and 25.

Here, in FIGS. 7 through 12 that show the constructions and operations of the shift registers 25, 26 and 27, the dummy-use final stage is referred to as n-numbered stage. Thus, in the shift register 25, the output signal Sn from the inverter 24 on the final dummy-use n-numbered stage is inputted to the reset terminal of the flip-flop 23 on the (n−1)-numbered stage, and in the shift registers 26 and 27, the output signal Qn of the flip-flop 23 on the final n-numbered stage is inputted to the reset terminal of the flip-flop 23 on the (n−1)-numbered stage.

[Embodiment 2]

Figure 13:
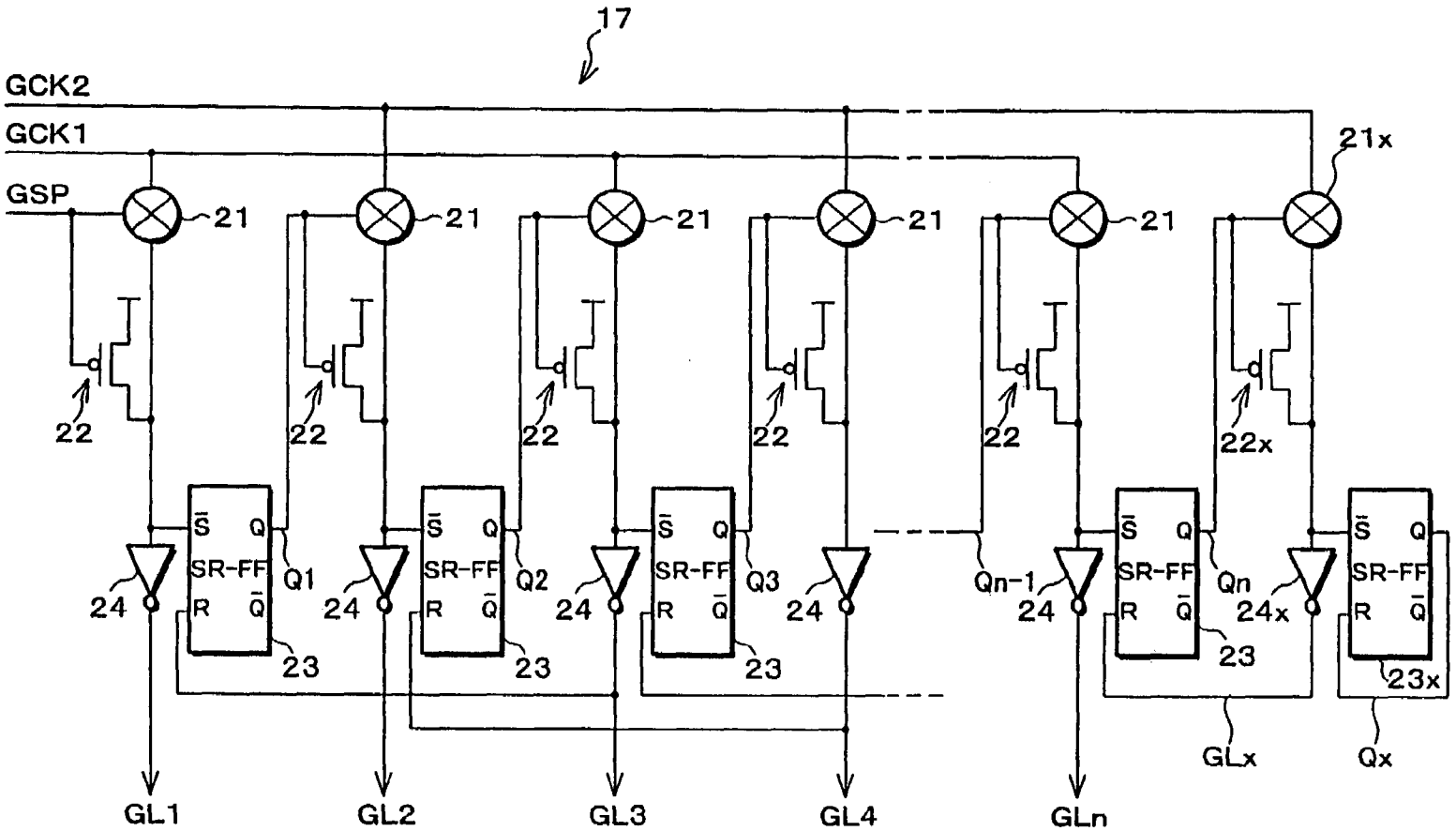
FIG. 13 is a circuit diagram that schematically shows the construction of a shift register in accordance with another embodiment of the present invention.
Figure 14:
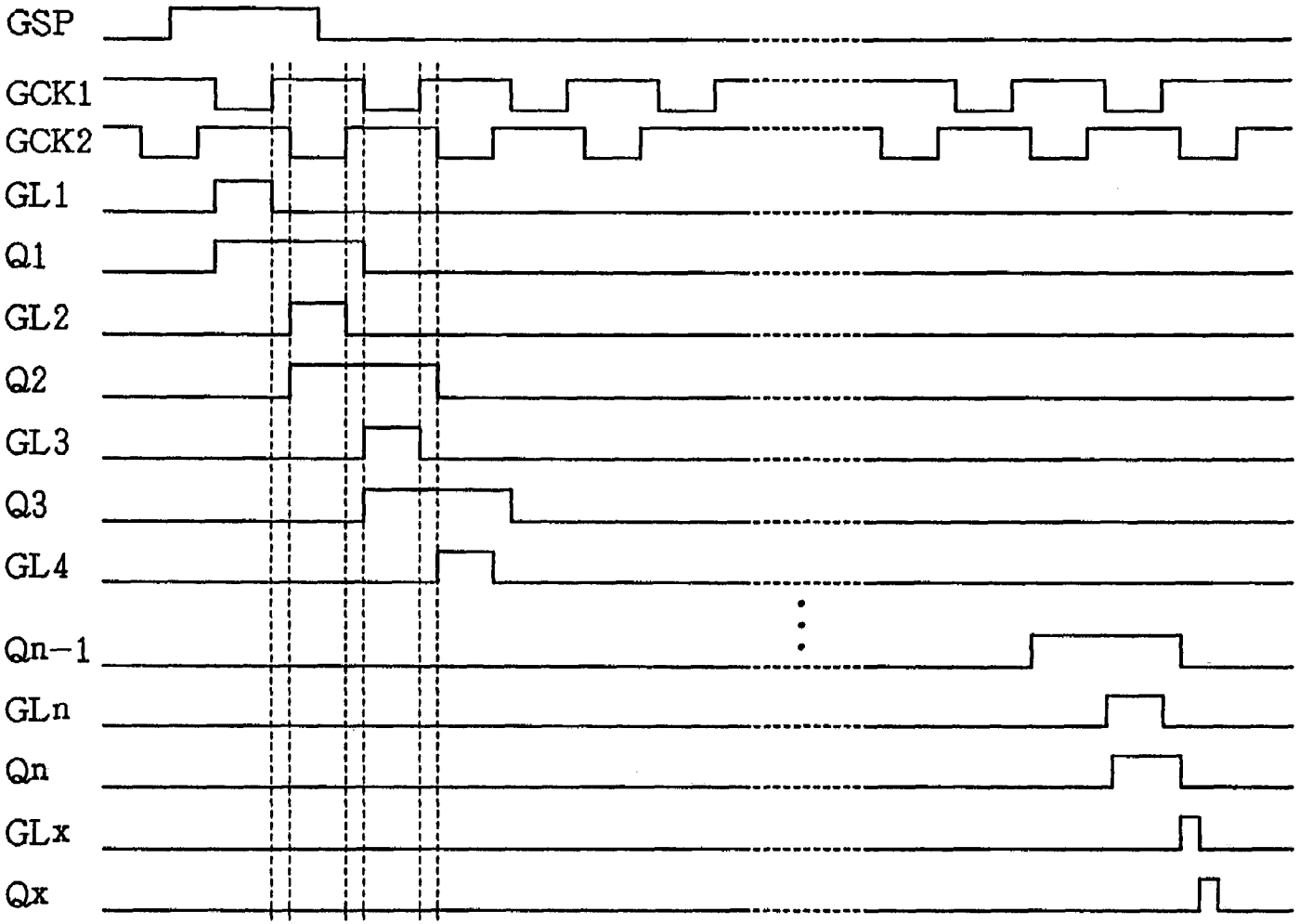
FIG. 14 is a timing chart that shows the operation of the above-mentioned shift register.

Referring to FIGS. 13 and 14, the following description will discuss the second embodiment of the present invention. Here, in the present embodiment, those members that have the same functions and that are described in Embodiment 1 are indicated by the same reference numerals, and the description thereof is omitted.

As described earlier, the shift register 17 of the present embodiment is a shift register that is used in the scanning signal line driving circuit 13. As illustrated in FIG. 13, the shift register 17 has the same construction as the shift register 1 of Embodiment 1 except that two kinds of clock signals GCK1 and GCK2 are inputted thereto, and that the start pulse GSP is inputted as a start pulse.

As illustrated in FIG. 14, the clock signals GCK1•GCK2 have such phases that the respective low-level periods are not overlapped with each other; that is, their phases are offset from each other by 180°. Each of the clock signals GCK1 and GCK2 is set to have a sufficiently short low-level period, as compared with a high-level period.

In the case of the scanning signal line driving circuit 13, when successive scanning signals overlap with each other, there will be extreme degradation in the display quality. Therefore, conventionally, a pulse-width control signal PWC is, for example, used so as to prevent the scanning signals from overlapping with each other.

In the shift register 17 of the present embodiment, the above-mentioned clock signals GCK1 and GCK2 are used. Moreover, the inputs of the clock signals GCK1•GCK2 to each flip-flop 23 are controlled by each switching means 21 in the same operation as that of the above-mentioned shift register 1, and the signals GL1 to GLn are outputted from the respective stages through the respective inverters 24. Therefore, as illustrated in FIG. 14, based upon the clock signals GCK1 and GCK2, it is possible to obtain the output signals GL1 to GLn that are not overlapped with each other.

Thus, this arrangement makes it possible to eliminate the pulse width control signal PWC and the logic device so that it becomes possible to provide an image display apparatus with a thinner frame portion.

Additionally, with respect to the input to the reset terminal of each flip-flop 23 in the shift register 17, it may of course be changed to the construction as explained in each of the shift registers 25, 26 and 27.

[Embodiment 3]

Figure 15:
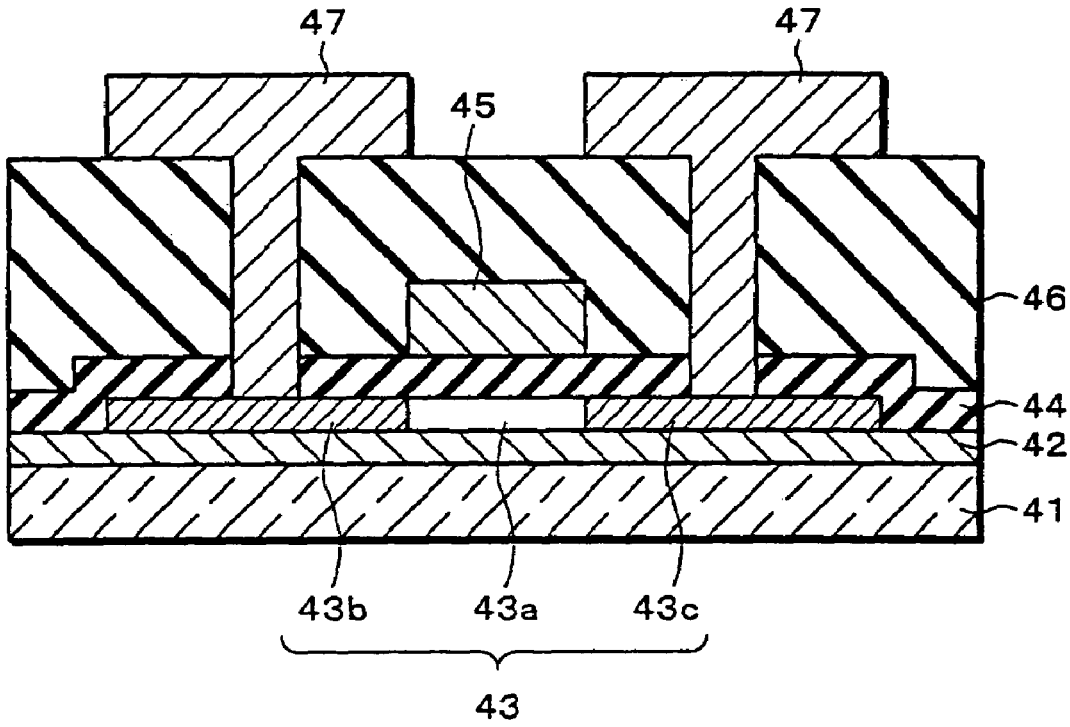
FIG. 15 is a cross-sectional view that shows the construction of a polycrystal silicon thin-film transistor used in the image display device.
Figure 16A:
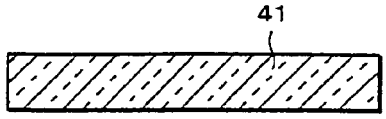
FIG. 16(*a*) through 16(*k*) are cross-sectional views that show structures of the polycrystal silicon thin-film transistor of FIG. 15 at the respective steps of the manufacturing process thereof.
Figure 16B:
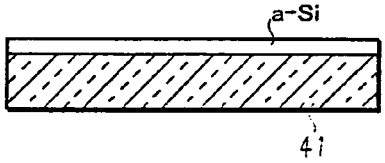
Figure 16C:
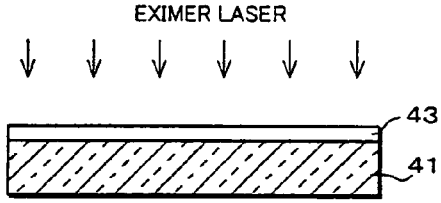
Figure 16D:
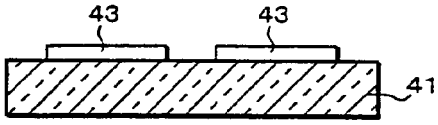
Figure 16E:
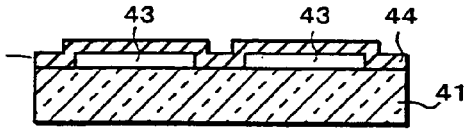
Figure 16F:
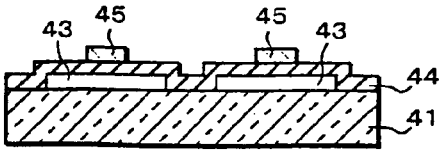
Figure 16G:
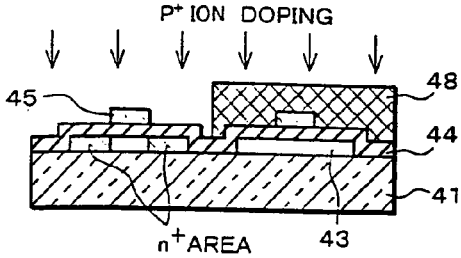
Figure 16H:
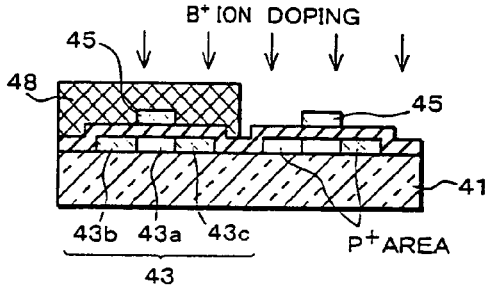
Figure 16I:
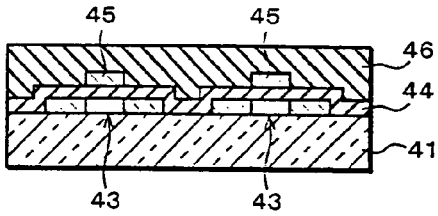
Figure 16J:
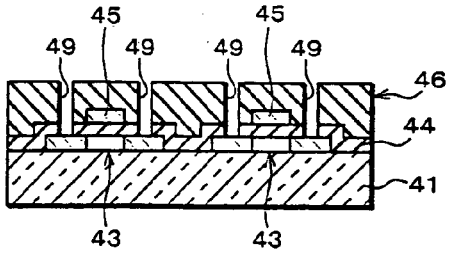
Figure 16K:
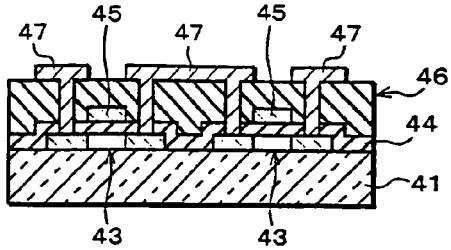

Referring to FIGS. 15 and 16(*a*) through 16(*k*), the following description will discuss the third embodiment of the present invention. Here, in the present embodiment, those members that have the same functions and that are described in Embodiments 1 and 2 are indicated by the same reference numerals, and the description thereof is omitted.

The image display device of the present embodiment has the same structure as the image display device 11 explained in Embodiment 1 except that the scanning signal line driving circuit 13 and the data signal line driving circuit 14 are formed on the same substrate constituted by a plurality of pixels 16 and the display device 12.

In other words, in the image display device of the present embodiment, the scanning signal line driving circuit 13 and the data signal line driving circuit 14 are formed on an insulating substrate, that is, for example, a glass substrate 41 (driver monolithic construction), together with the, display section 12. With respect to the insulating substrate (substrate), in most cases, a sapphire substrate, a quartz substrate, non-alkaline glass, etc. are used.

In this manner, the scanning signal line driving circuit 13 and the data signal line driving circuit 14 are monolithically formed on the same glass substrate 41 as the display section 12 so that it is possible to cut time consuming tasks and wiring capacitance. Moreover, as compared with the image display device using externally added ICs as a driver, the number of input terminals to the glass substrate 41 is reduced. Consequently, it is possible to reduce assembling costs for parts on the glass substrate 41 and also to reduce defects occurring in the assembling processes. Therefore, it becomes possible to reduce production costs and assembling costs of the driving circuit and consequently to improve the reliability of the driving circuit.

Moreover, in the present image display device, thin-film transistors are used as pixel transistors SW (see FIG. 3) and thin-film transistors are used so as to construct the scanning signal line driving circuit 13 and the data signal line driving circuit 14; and in order to integrate more pixels 16 and to expand the display area, polycrystal silicon thin-film transistors are adopted as these thin-film transistors.

The above-mentioned polycrystal silicon thin-film transistor has a construction, for example, as shown in FIG. 15, and in this structure, a silicon oxide film 42 for preventing contamination is deposited on the glass substrate 41, and on this is formed a field effect transistor.

The above-mentioned thin-film transistor is constituted by a channel area 43*a* film 42, a polycrystal silicon thin-film 43, formed on the silicon oxide, consisting of a source area 43*b*, a drain area 43*c*, etc., a gate insulating film 44 formed thereon, a gate electrode 45, an interlayer insulating film 46 and metal wires 47.

The above-mentioned polycrystal silicon thin film has a forward stagger (top gate) construction in which the polycrystal silicon thin-film on the insulating substrate serves as an active layer; however, the present embodiment is not limited by this construction, and a transistor having another construction such as a reverse stagger construction may be adopted. Moreover, in the present image display device, monocrystal silicon thin-film transistors, amorphous silicon thin-film transistors or thin-film transistors made from another materials may be adopted.

The application of the above-mentioned polycrystal silicon thin-film transistor makes it possible to assemble the scanning signal line driving circuit 13 and the data signal line driving circuit 14 having practical driving capabilities on the glass substrate 41 on which the display section 12 is formed, through virtually the same manufacturing processes as the pixels 16.

FIG. 16(*a*) through FIG. 16(*k*) are cross-sectional views that show manufacturing processes of the above-mentioned polycrystal silicon thin-film transistor. In the present manufacturing processes, an amorphous silicon thin-film a-Si is first deposited on a glass substrate 41 shown in FIG. 16(*a*) (FIG. 16(*b*)). Next, the amorphous silicon thin film a-Si is irradiated with an eximer laser to form a polycrystal silicon thin-film 43 (FIG. 16(*c*)). This polycrystal silicon thin-film 43 is patterned into a desired shape (FIG. 16(*d*)), and on this is formed a gate insulating film 44 made from silicon dioxide (FIG. 16(*e*)).

Further, a gate electrode 45 is formed by using aluminum, etc. (FIG. 16(*f*)). Thereafter, impurities (phosphor in n-type area and boron in p-type area) are injected into areas that are to form a source area 43*b* and a drain area 43*c* on the polycrystal silicon thin film 43 (FIGS. 16(*g*) and 16(*h*)). Upon injecting the impurity in the n-type area, the p-type area is masked by resist 48 (FIG. 16(*g*)), and upon injecting the impurity in the p-type area, the n-type area is masked by resist 48 (FIG. 16(*h*)).

Then, an interlayer insulating film 46, made from silicon dioxide, silicon nitride, etc., is deposited thereon (FIG. 16(*i*)) to form contact holes 49 in the interlayer insulation film 46 (FIG. 16(*j*)). Lastly, metal wires 47, made of aluminum, etc., are formed in the contact holes 49 (FIG. 16(*k*)).

The highest temperature in the above-mentioned process is not more than 600° C. that is required at the time when the gate insulating film 44 is formed. Therefore, even when a normal glass substrate (glass substrate having a point of strain of not more than 600° C.) is used, neither warping nor deflection due to processes having a temperature not less the point of strain occurs. In other words, this eliminates the need of using an expensive quartz substrate having very high heat resistance, and makes it possible to use inexpensive glass having high heat resistance. Thus, it becomes possible to provide an inexpensive image display device.

Here, in the manufacturing process of the image display device, a transparent electrode (in the case of a light-transmission-type liquid crystal display) or a reflective electrode (in the case of a reflection-type liquid crystal display) is formed on the thin-film transistor formed as described above with another interlayer insulation film interpolated in between.

The application of the above-mentioned process makes it possible to form a polycrystal silicon thin film transistor on a glass substrate that is inexpensive and provides a large display area. Therefore, it becomes possible to easily achieve a large-size image display device at low costs.

As described above, the shift register, described in Embodiment 2 or 3 of the present invention, is provided with flip-flops of a plurality of stages to which a clock signal is inputted and switching means that is installed in each of the flip-flops of a plurality of stages and that controls the input of the clock signal. In this arrangement, in response to the output signal of the flip-flop on the i-numbered stage (where i is an arbitrary integer) among the flip-flops of the stages, the switching means on the (i+1)-numbered stage is controlled so that the input of the clock signal to the flip-flop on the (i+1)-numbered stage is controlled and an output pulse having the same width as the pulse width of the clock signal is generated.

For this reason, the output of the flip-flop that is operated in synchronism with the clock signal controls the clock signal to be supplied to the flip-flop on the next stage through the switching means. Here, this controlled clock signal forms an output on the corresponding stage, and the output is allowed to have the same pulse width as the clock signal.

Conventionally, the output of the flip-flop on the preceding stage and the output of that of the present stage have been subjected to a logical operation so as to generate a signal having the same pulse width as the clock signal; however, in the shift register of the present invention, it is not necessary to install the circuit for carrying out the above-mentioned logical operation. Moreover, in the logical operation section, the output from the logical operation section tends to have a partially overlapped portion due to delay (delay in the rising-edge or trailing-edge of the signal) of signals occurring in the logical operation section; however, the shift register of the present invention makes it possible to eliminate the partially overlapped portion of the output of the logical operation section. Furthermore, it is possible to eliminate a special circuit and a transmission line for a special signal for preventing the overlapped portion of the output pulse; therefor, it becomes possible to greatly reduce the size of the shift register.

Therefore, it is possible to provide a shift register which has no overlapped portion in the output pulses from the respective stages and which achieves a simplified circuit construction.

Moreover, in the shift register of the present invention, more preferably, with respect to the clock signal, M (where M is an integer of not less than 2) kinds of clock signals are inputted to the flip-flops on every M-number of stages among the flip-flops on a plurality of stages; thus, a plurality of clock signals can be used so that it is possible to reduce the frequency. Consequently, upon inputting a clock signal from an external circuit, the frequency is reduced to a low level so that it is possible to assist to reduce the voltage consumption of the external circuit.

Moreover, in the shift register of the present invention, the M kinds of clock signals are allowed to have such phases that their high-level periods or low-level periods do not overlap each other; thus, it is possible to obtain an output signal from each stage that does not overlap an output signal from an adjacent stage.

Moreover, in the shift register of the present invention, the duty ratio of each of the M kinds of clock signals is set to not more than (100×1/M) %; thus, it is possible to obtain an output signal from each stage that does not overlap an output signal from an adjacent stage, and it is also possible to desirably change the pulse width.

Here, "duty ratio" is a ratio in terms of time between the active period and the non-active period of a signal waveform. Here, for example, supposing that the signal waveform going high is active (which refers to an operating state of the signal) and that the signal waveform going low is inactive, the one cycle of the waveform is represented by a sum of the active time and the inactive time. For example, a duty ratio of 40% represents that the active time accounts for 40% of one cycle. The low period is defined as "active" depending on circuits.

Moreover, in the shift register of the present invention, it is preferable to install an input stabilizing means for stabilizing the input to the flip-flops on a plurality of stages during a period in which the switching means is opened. Consequently, when the switching means is opened, the input to the flip-flops is set to a predetermined electric potential, thereby making it possible to prevent the flip-flops from malfunctioning.

Furthermore, in the shift register of the present invention, the flip-flop on each of the stages is a set-reset type flip-flop, and an output pulse of the (i+k×M)-numbered stage (where k is an integer of not less than 1) may be inputted to the reset terminal of the flip-flop on the i-numbered stage; thus, it becomes possible to adjust the pulse width of the signal outputted from each flip-flop to a desired period.

Here, in general, the "set-reset type flip-flop" refers to a circuit in which transition occurs between two stable states each time a signal is applied in certain synchronized timing, and while the signal is not applied, the state, as it is, is maintained. In the set-reset type flip-flop, for example, the output is set to High Level by an inputted set signal, and even when the set signal becomes inactive, the output state is maintained. Thereafter, the reset signal becomes active while the set signal is inactive, the output is set to Low Level, and even when the reset signal becomes inactive, this state is maintained until the set signal becomes active.

Moreover, in the shift register of the present invention, more preferably, the flip-flop on each of the stages is a set-reset type flip-flop, and an output signal of the flip-flop on the (i+k×M)-numbered stage (where k is an integer of not less than 1) may be inputted to the reset terminal of the flip-flop on the i-numbered stage; thus, it becomes possible to adjust the pulse width of the signal outputted from each flip-flop to a desired period.

Moreover, the image display device described in Embodiment 3 of the present invention, which is provided with a display section constituted by a plurality of pixels arranged in a matrix format, a data signal line driving circuit, connected to a plurality of data signal lines, for supplying to the respective data signal lines image data to be written in the pixels, and a scanning signal line driving circuit, connected to a plurality of scanning signal lines, for supplying to the scanning signal lines a scanning signal for controlling a writing operation of the image data to the pixels, is characterized in that the shift register of the present invention is installed at least in either the data signal line driving circuit or the scanning signal line driving circuit.

In the above-mentioned arrangement, the application of the shift register of the present invention makes it possible to minimize the circuit scale of the driving circuit and consequently to provide an image processing apparatus which can achieve a narrower frame width.

Moreover, the image display device of the present invention is preferably arranged so that at least either the data signal line driving circuit or the scanning signal line driving circuit is formed on the same substrate as the pixels; thus, the wiring between the data signal line driving circuit and the respective pixels or the wiring between the scanning signal line driving circuit and the respective pixels is arranged on the same substrate, and does not need to be installed outside the substrate. As a result, even when the number of the data signal lines and the number of the scanning signal lines are increased, the number of signal lines to be placed outside is not changed, and no assembling process is required. Therefore, it is possible to prevent an undesired increase in the capacitance of each signal line and a reduction in the degree of integration. Moreover, it is possible to eliminate time-consuming tasks during the manufacturing process.

Furthermore, in the image display device of the present invention, it is preferable to provide an arrangement in which a switching element consisting of at least either the data signal line driving circuit or the scanning signal line driving circuit is provided as a polycrystal silicon thin-film transistor; thus, it is possible to easily expand the display area.

As compared with the monocrystal silicon, the polycrystal silicon thin-film is easily expanded in its area; however, the polycrystal silicon transistor is inferior to the monocrystal transistor in transistor characteristics, such as the mobility and threshold value. Therefore, in the case when each circuit is manufactured by using monocrystal silicon transistors, it becomes difficult to expand the display area; in contrast, in the case when each circuit is manufactured by using polycrystal silicon transistors, there is a reduction in the driving function in the circuit. Moreover, in the case when the two driving circuits and the pixels are formed on respectively different substrates, the two substrates need to be connected by signal lines, resulting in time-consuming tasks during the manufacturing process and an increase in the capacitance of each signal line.

Therefore, the application of the arrangement using the switching element constituted by polycrystal silicon thin-film transistors, it becomes possible to easily expand the display area. Moreover, the application of the shift register of the present invention makes it possible to minimize the circuit scale, and consequently to provide a thinner frame and a reduction in power consumption.

Further more, in the image display device of the present invention, the switching element is preferably formed at a temperature not more than 600° C.; thus, even when a normal glass substrate (glass substrate having a point of strain of not more than 600° C.) is used as a substrate bearing the switching elements, neither warping nor deflection due to processes having a temperature not less the point of strain occurs. As a result, it becomes possible to achieve an image display device which can be easily assembled and has a wider display area.

[Embodiment 4]

The following description will discuss still another embodiment of the present invention. Here, the present invention is generally applied to shift registers, and the following description exemplifies a preferable case in which they are applied to an image display device.

The shift register of the present embodiment is preferably applied to, for example, a driving circuit of an image display device, and makes it possible to reduce the size of the driving circuit. The shift register also makes the pulse width of the clock signal variable, even when the amplitude of the clock input signal is lower than the driving voltage, so that the pulse width of the output signal of the shift register is desirably changed.

Figure 18:
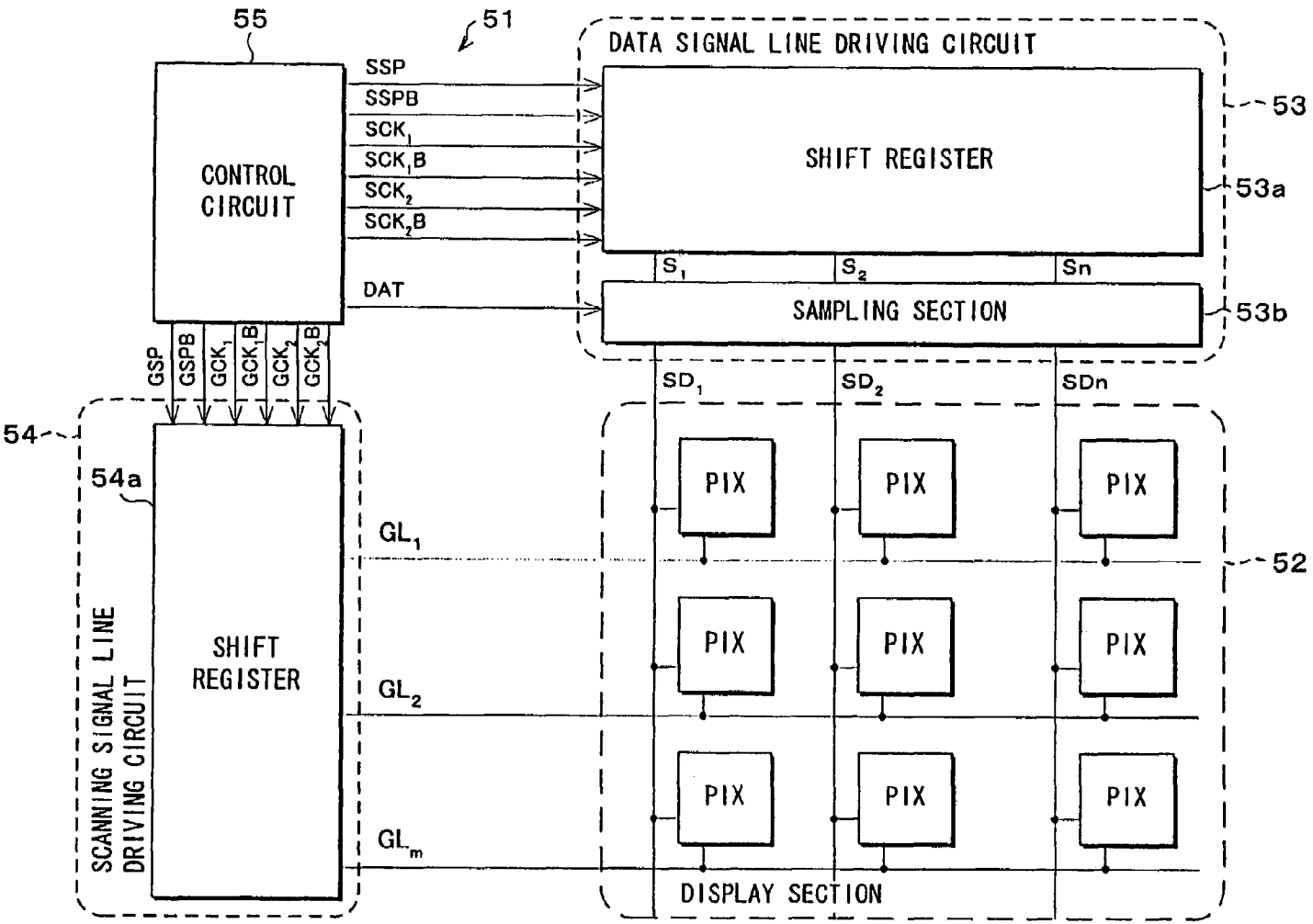
FIG. 18 is a circuit diagram that shows the construction of an essential part of an image display device provided with the above-mentioned shift register.

As illustrated in FIG. 18, the image display device 51 in accordance with the present embodiment is provided with a display section 52 having pixels PIX arranged in a matrix format, a data signal line driving circuit 53 and a scanning signal line driving circuit 54 which drive the respective pixels PIX. Thus, when a control circuit 55 generates a video signal DAT representative of a display state of each of the pixels PIX, the display device 51 displays a video image in accordance with the video signal DAT.

The display section 52 and the two driving circuits 53 and 54 are placed on the same glass substrate so as to reduce time-consuming tasks during the manufacturing process and the wiring capacitance. Moreover, in order to integrate more pixels PIX and to expand the display area, respective switching elements, which are installed in the display section 52 and the two driving circuits 53 and 54 and which control the conduction of each signal by turning it on and off, are all constituted by polycrystal silicon thin-film transistors formed on the glass substrate. Moreover, the polycrystal silicon transistors are manufactured at a process temperature of not more than 600° C. so that neither warping nor deflection due to processes having a temperature not less the point of strain occurs even when a normal glass substrate (glass substrate having a point of strain of not more than 600°) is used.

Figure 19:
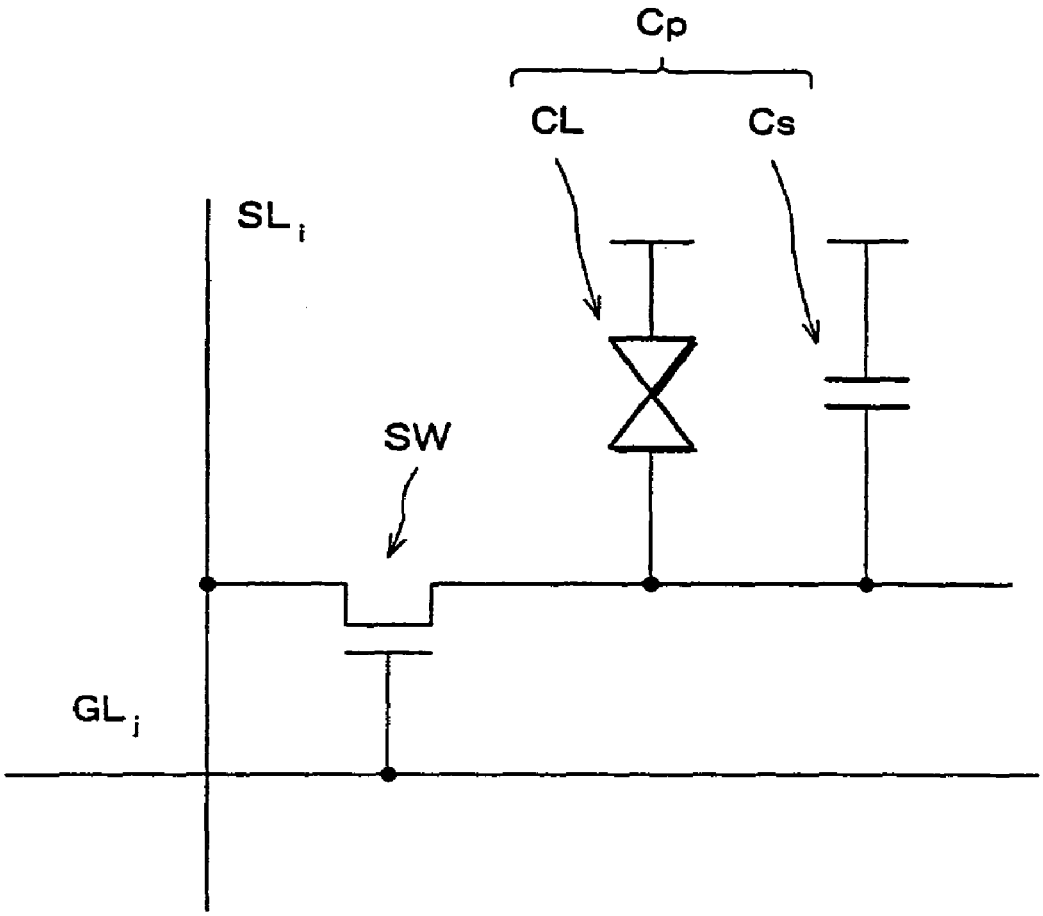
FIG. 19 is a circuit diagram that shows a structural example of a pixel in the above-mentioned image display device.

Here, the display section 52 is provided with n number of data signal lines $SL_1$ to $SL_n$, and m number of scanning signal lines $GL_1$ to $GL_m$ that are respectively allowed to intersect the data signal lines SL1 to $SL_n$. Here, the respective output signals of the data signal lines $SL_1$ to $SL_n$ are also referred to as $SL_1$ to $SL_n$ unless otherwise need to be defined. The same is true for the scanning signal lines. Supposing that an arbitrary positive integer not more than n is i and that an arbitrary positive integer not more than m is j, a pixel PIX (i, j) is placed in each of the combinations of the data signal line $SL_i$ and $GL_j$, and each pixel PIX (i, j) is placed at a portion surrounded by two adjacent data signal lines $SL_i$, $SL_{i+1}$ and two adjacent scanning signal lines $GL_j$ $GL_{j+1}$ For example, as illustrated in FIG. 19, the above-mentioned pixel PIX (i, j) is provided with a field effect type transistor (switching element) SW having its gate connected to the scanning signal line $GL_j$ and its drain connected to the data signal line $SL_i$, and a pixel capacitor Cp with one of its electrodes being connected to the source of the field effect type transistor SW. Moreover, the other end of the pixel capacitor Cp is connected to a common electrode line that is commonly connected to all the pixels PIX. The pixel capacitor Cp is constituted by a liquid crystal capacitance CL and an assist capacitor Cs that is added, if necessary.

In the above-mentioned pixels PIX (i, j), when a scanning signal line $GL_j$ is selected, the field effect type transistor SW is allowed to conduct so that a voltage which has been applied to a data signal line $SL_i$ is applied to the pixel capacitor Cp. Thus, the transmittance or reflectance of the liquid crystal is changed by the voltage applied to the liquid crystal capacitance CL. Therefore, by applying a signal voltage corresponding to image data to a data signal line $SL_i$ while selecting a scanning signal line $GL_j$, the display state of the corresponding PIX (i, j) can be changed in accordance with the image data.

In the image display device 51 shown in FIG. 18, the scanning signal line driving circuit 54 selects a scanning signal line GL and video image data to be sent to the pixel PIX corresponding to the combination of the scanning signal line GL and the data signal line SL as selected is outputted to the respective data signal lines SL by the data signal line driving circuit 53.

Thus, the respective video image data is written in the pixels PIX connected to the scanning signal line GL. Moreover, the scanning signal line driving circuit 54 successively selects the scanning signal lines GL, and the data signal line driving circuit 53 outputs image data to the data signal lines SL. As a result, the respective pieces of image data are written in all the pixels of a display section 52.

The image data to the respective pixels PIX is transmitted from the control circuit 55 to the data signal line driving circuit 53 as a video signal DAT in a time-divided manner, and the data signal line driving circuit 53 extracts respective pieces of image data from the video signal DAT in synchronized timing with a clock signal $SCK_1$ having a fixed cycle with a duty ratio of less than 50% (in the present embodiment, High period is shorter than Low period), a clock signal $SCK_2$ having a 180°-phase difference from the clock signal $SCK_1$ and a start signal SSP, which are timing signals. Here, in addition to the clock signals $SCK_1$ and $SCK_2$, inversion signals $SCK_1B$ and $SCK_2B$ that are signals having the respectively inverted phases of these are also inputted to the data signal line driving circuit 53 from the control circuit 55. Moreover, a signal SSPB that is an inversion signal having the inverted phase of the start signal SSP is also inputted to the data signal line driving circuit 53 from the control circuit 55.

More specifically, the data signal line driving circuit 53 is provided with (1) a shift register 53*a* which successively outputs pulses each having a half-cycle of the clock while successively shifting the pulses, by inputting the start signal SSP in synchronism with the rising-edges of the clock signal $SCK_1$ and the clock signal $SCK_2$, so that output signals $SL_1$ to $SL_n$, each having a difference in synchronized timing by one clock, are generated and (2) a sampling section 53*b* which extracts video image data from the video signal DAT in synchronized timing with the respective output signals $SL_1$ to $SL_n$.

In the same manner, the scanning signal driving circuit 54 is provided with a shift register 54*a* which successively outputs pulses each having a half-cycle of the clock while successively shifting the pulses, by inputting the start signal GSP of the scanning signal in synchronism with the clock signals $GCK_1$ and the clock signal $GCK_2$, so that scanning signals, each having a difference in synchronized timing by one clock, are outputted to the respective scanning signal lines $GL_1$ to $GL_n$. Here, in addition to the clock signals $GCK_1$ and $GCK_2$, inversion signals $GCK_1B$ and. $GCK_2B$ that are signals having the respectively inverted phases of these are also inputted to the scanning signal line driving circuit 54 from the control circuit 55.

In the image display device 51 of the present embodiment, the display section 52 and the two driving circuits 53 and 54 are formed by polycrystal silicon thin-film transistors, and the driving voltage Vcc of the display section 52 driving circuits 53 and 54 is set to, for example, approximately 15 V. The control circuit 55 is formed on a substrate different from that of the respective circuits 52, 53 and 54 by monocrystal silicon transistors, and the driving voltage is set to a value lower than the driving voltage Vcc, such as 5 V or not more than 5V. Here, although the respective circuits 52, 53 and 54 and the control circuit 55 are formed on the respectively different substrates, the number of signals transferred between the two substrates is much smaller than the number of signals among the respective circuits 52, 53 and 54, and those signals only include, for example, the video signal DAT, the start signal SSP and the clock signals $SCK_1$, $SCK_2$, ($GCK_1$, $GCK_2$). Moreover, since the control circuit 55 is formed by monocrystal silicon transistors, it is possible to ensure a sufficient driving capability. Therefore, even when they are formed on the respectively different substrates, it is possible to limit the increases in time-consuming tasks during the manufacturing process, wiring capacitance and power consumption to a level without raising any problem.

Figure 17:
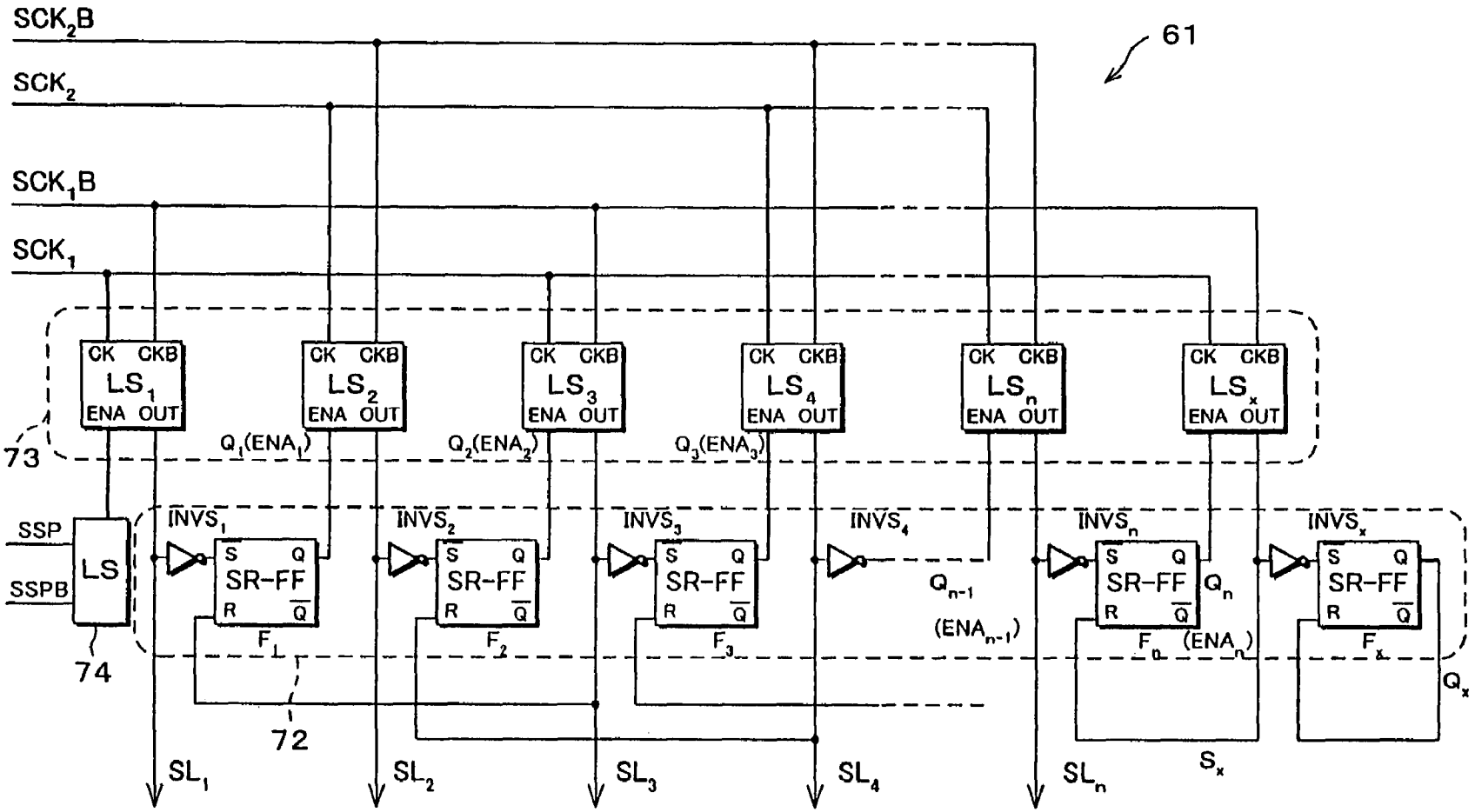
FIG. 17, which shows still another embodiment of the present invention, is a circuit diagram that shows the construction of an essential part of a shift register that contains a set•reset•flip-flop, and is suitable for a data signal line driving circuit.

Here, in the present embodiment, a shift register 61 shown in FIG. 17 is used as the above-mentioned shift register 53*a*. In the following description, the number of the stages L(m) of the shift register is denoted by n, and the output signals are denoted by $SL_1$ to $SL_n$.

More specifically, the shift register 61 is provided with a flip-flop section 72 containing set-reset flip-flops (SR flip-flops) $F_1, \ldots, F_n$ of n stages and a dummy SR flip-flop $F_x$; a level shifter section 73 containing level shifters $LS_1, \ldots, LS_n, LS_x$ that raise voltages of clock signals $SCK_1$, $SCK_2$ having an amplitude smaller than the driving voltage Vcc, supplied from the control circuit 55, so as to input the resulting signals to the respective SR flip-flops; and a level shifter 74 used for the start signal.

In the present embodiment, each of the level shifters $LS_1, \ldots, LS_n, LS_x$ inside the level shifter 73 is installed so as to have a one-to-one correspondence with each of the SR flip-flop $F_1, \ldots, F_n, F_x$ and, as will be described later, the level shifter section 73 is designed as a current-driving-type level shifter so that, even when the amplitude of the clock signals $SCK_1 \bullet SCK_2$ is smaller than the driving voltage Vcc, the voltage raising operation is carried out without causing-any problem. While the control signal ENA specifies the corresponding operation, each level shifter is allowed to apply a clock signal having a raised voltage to the corresponding SR flip-flop (referred to as F) based upon the clock signal $SCK_1$ or $SCK_2$. Moreover, while the control signal ENA specifies the stop of the operation, each level shifter stops its operation so that it stops the application of the clock signal to the corresponding SR flip-flop F, and during the stoppage of the operation, blocks an input switching element, which will be described later, thereby making it possible to reduce the power consumption in the level shifter section 73 caused by a penetration current.

The flip-flop section 72 is arranged so that a start signal SSP having a width of one clock cycle is transferred to the next stage each time the clock signal $SCK_1$ or $SCK_2$ rises. More specifically, the output Q (SSP in the case of the first stage) allows the corresponding one ($LS_1$ in the case of the first stage) of the level shifters $LS_1, LS_2, \ldots LS_x$ to operate so that $SCK_1$ or $SCK_2$ ($SCK_1$ in the case of the first stage) is applied to the corresponding SR flip-flop ($F_1$ in the case of the first stage) as a set signal S bar of negative logic through the corresponding one ($INVS_1$ in the case of the first stage) of inversion sections $INVS_1, INVS_2, \ldots INVS_n, INVS_x$, and is also outputted as an output of the level shifter 61 ($SL_1$ in the case of the first stage). The output signal $Q_1$ of the SR flip-flop $F_1$ is applied as a signal $ENA_1$ for operating the level shifter $LS_2$ on the next stage. Moreover, to each SR flip-flop $F_n$ is sent as a reset signal R a signal having a delay corresponding to the width of a pulse to be transferred as compared with the output of the shift register $SL_n$ among the set signals to the SR flip-flop on a stage located thereafter.

In the present embodiment, since a pulse having a width of one clock cycle is transferred, a signal having a delay of one clock cycle, that is, an output signal $SL_{n+2}$ of the shift register 61, which has been raised in its voltage by the level shifter $LS_{n+2}$ (for example, $LS_3$ with respect to $LS_1$), is applied as a reset signal of positive logic to the flip-flop $F_n$.

Moreover, the clock signal $SCK_1$ is inputted to the level shifters $LS_1, LS_3, \ldots$ on the odd stages so that the SR flip-flops $F_1, F_3, \ldots$ on the odd stages are set upon receipt of the rising-edge of the clock signal $SCK_1$. On the other hand, the clock signal $SCK_2$ is inputted to the level shifters $LS_2, LS_4, \ldots$ on the even stages so that the SR flip-flops $F_2, F_4, \ldots$ on the even stages are set upon receipt of the rising-edge of the clock signal $SCK_2$.

Here, as illustrated in FIG. 17, in the level shifter of the present embodiment, a dummy-use level shifter $LS_x$ and flip-flop $F_x$ are placed on the final stage (the stage next to the n stage) Here, the output $S_x$ of the level shifter $LS_x$ is inputted to the reset terminal of the flip-flop $F_n$ on the n stage so that the output $Q_x$ of the flip-flop $F_x$, is inputted to the reset terminal of the flip-flop $F_x$ on the final stage. Consequently, the flip-flop $F_x$ on the final stage is set so as to generate an output signal $Q_x$, and also simultaneously reset so that the output signal $Q_x$ has a waveform shown in FIG. 20. Here, instead of the arrangement in which the output signal $S_x$ is inputted to the reset terminal of the flip-flop $F_n$, on the n stage, the output signal $Q_x$ of the flip-flop $F_x$ on the final stage may be inputted to the reset terminal of the flip-flop $F_n$ on the n stage.

Figure 20:
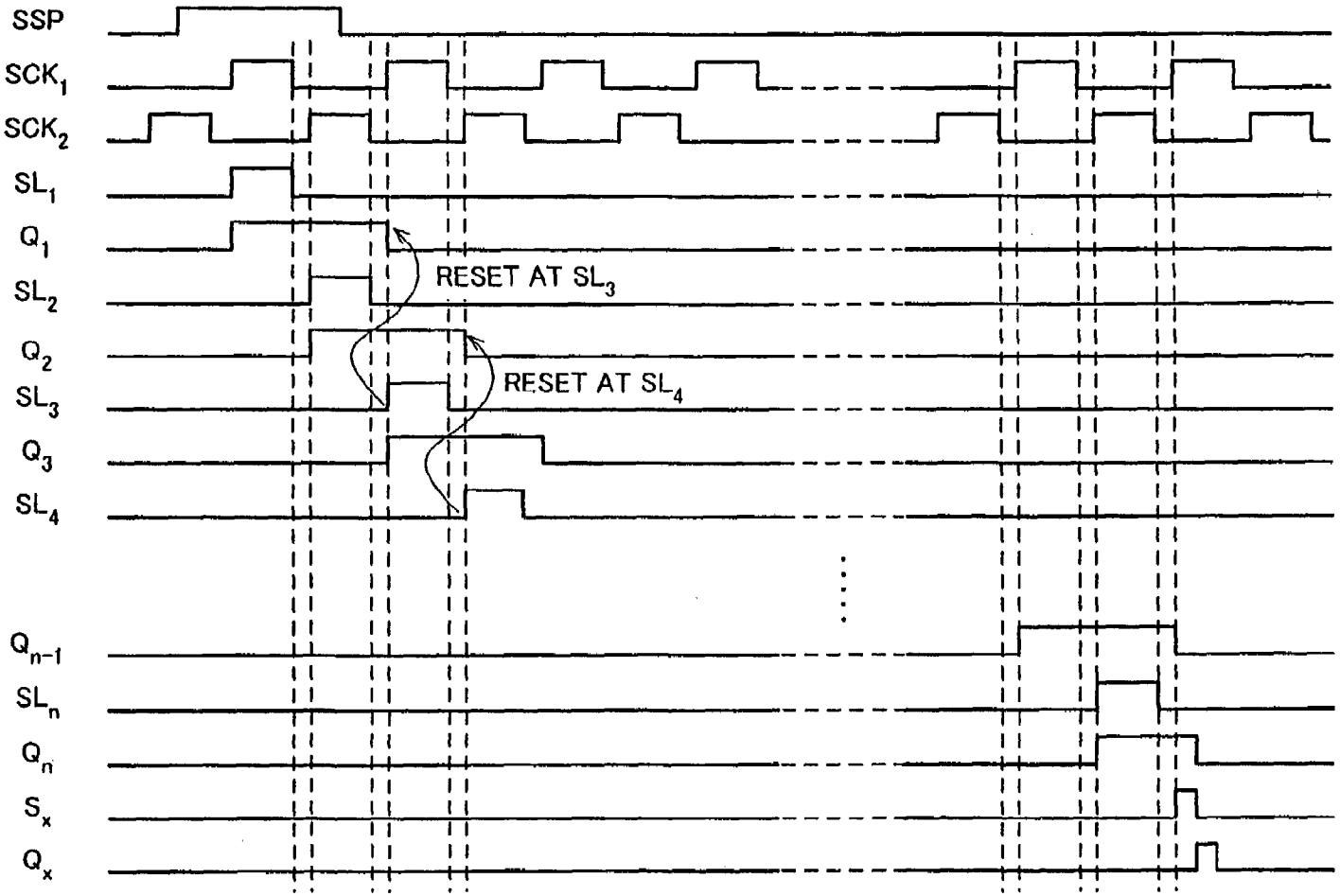
FIG. 20 is a timing chart that shows the operation of the above-mentioned shift register.

Next, referring to a timing chart as shown in FIG. 20, a specific explanation will be given of the operation. In this case, supposing that M is an integer of not less than 2, M kinds of clock signals are successively inputted to the flip-flops on every M-number of stages among the flip-flops on a plurality of stages; and in this case, it is assumed that M=2. Moreover, in this case, the inversion signals $SCK_1B$ and $SCK_2B$ of the respective timing signals are not shown in the Figure.

In the above-mentioned arrangement, as illustrated in FIG. 20, while the pulses of the start signal SSP are being inputted thereto, the level shifter $LS_1$ on the first stage is operated so that the clock signal $SCK_1$ (represented by $SCK_1a$) having a raised voltage is applied to the SR flip-flop $F_1$; thus, this signal forms an output signal $SL_1$ from the shift register. With this arrangement, the SR flip-flop $F_1$ is set when, after the start of the pulse inputs, the clock signal rises, thereby allowing the output $Q_1$ to go high.

The above-mentioned $Q_n$ is applied to the terminal ENA of the level shifter $LS_2$ on the second stage as a control signal $ENA_1$. Thus, the level shifter $LS_2$ outputs the clock signal $SCK_2$ (more specifically, $SCK_2a$ obtained by raising the voltage thereof) from the terminal OUT while the SR flip-flop $F_1$ is outputting pulses (during $ENA_1=Q_1$ is in High Level). Thus, after the output $Q_1$ on the preceding stage has gone high, the SR flip-flop $F_2$ is set upon receipt of the first trailing-edge of the clock $SCK_2$, thereby allowing the output $Q_2$ to go high. Here, $SCK_2a$ is outputted as an output signal $SL_2$ of the shift register.

Here, supposing that i is an integer in the range of not less than 1 to not more than n, the output signal $Q_i$ of each SR flip-flop is applied to the level shifter $LS_{i+1}$ on the next stage as the control signal $ENA_i$; therefore, each of the SR flip-flops $F_{i+1}$ on the second stage and thereafter is allowed to provide an output $Q_{i+1}$ having a delay corresponding to a phase difference of $SCK_1$ and $SCK_2$ from the output $Q_i$ of the preceding stage.

Here, to the shift register $F_i$, the output of the level shifter $LS_{i+2}$ on the second stage from the present is applied as a reset signal R. Therefore, each of the outputs $Q_i$ is allowed to go low after having gone high only for one clock cycle. With this arrangement, the flip-flop section 72 is allowed to transfer a start signal SSP having a width of one clock cycle to the next stage, each time it receives the rising-edge of the clock signal $SCK_1$ or $SCK_2$.

Here, each of the level shifters (LS1, LS2, . . . ) is installed in one-to-one correspondence with each of the SR flip-flops; therefore, even in the case of SR flip-flops with many stages, as compared with a case in which, after the clock signal $SCK_1$ or $SCK_2$ has been raised in its voltage by using a single level shifter, the resulting signal is applied to all the flip-flops, this arrangement makes it possible to shorten the distance between the corresponding level shifter and flip-flop. Therefore, the transfer distance of the clock signal $SCK_1a$ or $SCK_2a$ having a raised voltage can be shortened, and the load capacitance of each level shifter can be reduced. Moreover, since the load capacitance is small, it is not necessary to install a buffer even in the case when it is difficult to ensure a sufficient driving capability as in the case of level shifters constituted by polycrystal silicon thin-film transistors. As a result, it becomes possible to reduce the power consumption of the shift register. Moreover, since it is not necessary to provide a signal that is, for example, two times as great as the frequency of $SCK_1$ as in the case of the pulse-width controlling signal SPWC as described in the Prior Art; therefore, this also makes it possible to reduce the power consumption.

Moreover, in the case when each SR flip-flop $F_i$ does not need an input of a clock signal as in the case of Low Levels of the start signal SSP or the output $Q_{i-1}$ on the preceding stage, the level shifter $LS_i$ stops its operation. In this state, since no clock signal is driven, there is no power consumption required for driving. Moreover, as will be described later, a power supply to a voltage-raising section 73*a* (see FIG. 21) installed in each level shifter is stopped, and an input switching element (P11 and P12, which will be described later) (see FIG. 21) is cut off so that no penetration current is allowed to flow. Therefore, in spite of a number (n) of level shifters of the current-driving type installed, power is consumed only in operating level shifters. Consequently, it is possible to greatly reduce the power consumption of the shift register.

Here, in the same manner as the fact that the output of the SR flip-flop $F_{i-1}$ on the preceding stage is referred to as "$Q_{i-1}$" with respect to the output "$Q_i$" of the SR flip-flop $F_i$ on the i-numbered stage ($2 \leqq i \leqq n$), supposing that, for convenience of explanation, the start signal SSP is referred to as the output $Q_0$ on the preceding stage with respect to the SR flip-flop $F_i$ on the first stage, the level shifter $LS_i$ ($1 \leqq i \leqq n$) in accordance with the present embodiment is allowed to judge the period in which the clock signal is required for the SR flip-flop $F_i$, that is, the period from the start of the pulse output of the output $Q_{i-1}$ on the preceding stage to the set of the SR flip-flop $F_i$, only based upon the output $Q_{i-1}$ on the preceding stage. As a result, each of the level shifter $LS_i$ can be operated or stopped simply by directly applying the output $Q_{i-1}$ on the preceding stage, with the result that it becomes possible to simplify the circuit construction of the shift register, as compared with a case in which a circuit has to be installed so as to form a new control signal.

Moreover, in the present embodiment, while each of the level shifters $LS_i$ is stopped, the clock input to each of the SR flip-flops Fi is cutoff. Therefore, it is possible to properly transfer the start signal SSP without the need for installing a switch that conducts in response to the necessity or unnecessity of a clock input in a separated manner from the level shifter $LS_i$.

Here, the construction and operation of the SR flip-flop are the same as those described in Embodiment 1 by reference to FIGS. 5 and 6.

Figure 21:
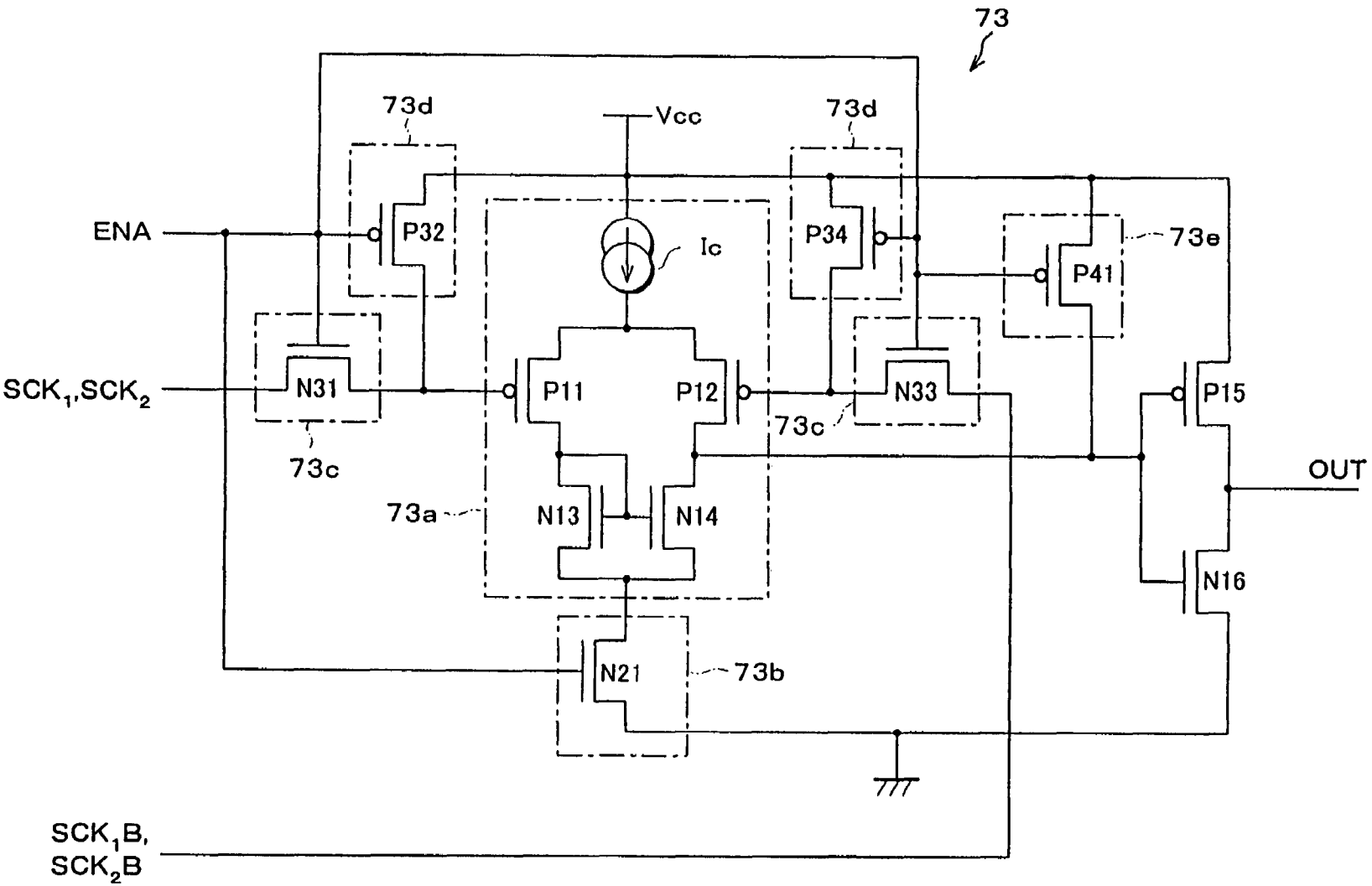
FIG. 21 is a circuit diagram that shows a structural example of a level shifter in the above-mentioned shift register.

For example, as illustrated in FIG. 21, the level shifter of the present Embodiment is provided with a voltage-raising section 73*a* for level-shifting the clock signal $SCK_1$ or $SCK_2$, a power supply control section 73*b* for stopping the power supply to the voltage-raising section 73*a* during the stoppage period in which no clock signal is required, an input control section 73*c* serving as a switch for cutting the voltage-raising section 73*a* off the signal line through which the clock signal is transferred, during the stoppage period; an input signal control section 73*d* serving as an input switching element cutoff control section for cutting off the input switching element (P11, P12) of the voltage-raising section 73*a* during the stoppage period, and an output stabilizing section (output stabilizing means) 73*c* for maintaining the output of the voltage-raising section 73*a* to a predetermined value during the stoppage period.

The voltage-raising section 73*a* is provided with P-type MOS transistors P11 and P12 the sources of which are connected to each other and which serve as input switching elements provided as paired differential inputs on the input stage, a constant current source Ic for supplying a predetermined current to the sources of the two transistors P11 and P12, N-type MOS transistors N13 and N14 which constitute a current mirror circuit and provide active loads to the two transistors P11 and P12, and transistors P15 and N16 of the CMOS construction for amplifying the output of the paired differential inputs.

The clock signal $SCK_1$ is inputted to the gate of the transistor P11 through a transistor N31 which will be described later, and the inversion signal $SCK_1$ B ($SCK_1$ BAR) of the clock signal $SCK_1$ is inputted to the gate of the transistor P12 through a transistor N33 which will be described later. Moreover, the gates of the transistors N13 and N14 are connected to each other, and further connected to the drains of the transistors P11 and N13. The drains of the transistors P12 and N14, connected to each other, are connected to the gates of the transistors P15 and N16. Here, the sources of the transistors N13 and N14 are connected to grounds through the N-type MOS transistor N21 serving as the power supply control section 73*b*.

The N-type MOS transistor N31 is placed between the clock signal and the gate of the transistor P11 in the input control section 73*c* on the transistor P11 side. Moreover, in the input signal control section 73*d* on the transistor P11 side, the P-type MOS transistor P32 is installed between the gate of the transistor P11 and the driving voltage Vcc. In the same manner, the inversion signal $SCK_1$ B ($SCK_2$B) of the clock signal is applied to the gate of the transistor P12 through the transistor N33 serving as the input control section 73*c*; thus, the driving voltage Vcc is applied thereto through the transistor P34 serving as the input signal control section 73*d*.

Moreover, the output stabilizing section 73*e* is designed to stabilize the output voltage OUT of the level shifter section 73 to the ground level during the stoppage period, and a P-type MOS transistor P41 is placed between the driving voltage Vcc and the gates of the transistors P15 and N16.

Here, in the present embodiment, the control signal ENA is set so as to operate the level shifter section 73 when it goes high. Therefore, the control signal ENA is applied to the gates of the transistors N21, N31, N33, P32, P34 and P41.

In the level shifter section 73 having the above-mentioned arrangement, while the control signal ENA is active (high level), the transistors N21, N31 and N33 are allowed to conduct and the transistors P32, P34 and P41 are cut off. In this state, the current of the constant current source Ic is allowed to flow through the transistor N21 after passing through the transistors P11 and N13 or the transistors P12 and N14. Moreover, the clock signals $SCK_1$, $SCK_2$ or the inversion signals $SCK_1$B and $SCK_2$B of the clock signals are applied to the gates of the two transistors P11 and P12. As a result, currents the amounts of which are proportional to the rate of the respective gate-source voltages are allowed to flow through the two transistors P11 and P12. Here, since the transistors N13 and N14 serve as active loads, the voltage of the junction of the transistors P12 and N14 is set to a voltage that corresponds to the voltage level difference of $SCK_1$ and $SCK_2$ or $SCK_1$B and $SCK_2$B. The resulting voltage serves as the gate voltage of the CMOS transistors P15 and N16, and after having been power-amplified by the transistors P15 and N16, is outputted as an output voltage OUT.

The above-mentioned level shifter section 73 is not of a voltage-driving type in which the transistors P11 and P12 on the input stage are switched in their conduction/cutoff by the clock signals $SCK_1$ and $SCK_2$, but of a current-driving type in which the transistors P11 and P12 on the input stage are always allowed to conduct during operation; thus, the current of the constant current source Ic is divided in proportion to the rate of the gate-source voltages of the two transistors P11 and P12 so that, even in the case when the amplitudes of the clock signals $SCK_1$ and $SCK_2$ are lower than the threshold values of the transistors P11 and P12 on the input stage, it is possible to level-shift the clock signals $SCK_1$ and $SCK_2$ without causing any problem.

Consequently, as illustrated in FIG. 20, during the high-level period of the corresponding control signal $ENA_{i-1}$, that is, $Q_{i-1}$, each of the level shifters is allowed to output the output signal OUT which has the same shape as the clock signals $SCK_1$ and $SCK_2$ obtained at the time when the amplitudes of the clock signals $SCK_1$ and $SCK_2$ are lower than the driving voltage Vcc (for example, approximately 5 V), and which also has an amplitude raised to the driving voltage Vcc (for example, approximately 15V), that is, the output signal ($SL_i$) of the i-numbered data signal line $SL_i$.

In contrast, when the control signal $ENA_i$ is not operated (low level), the currents flowing through the transistors P11 and N13 or the transistors P12 and N14 from the constant current source Ic is cut off by the transistor N21. In this state, since the current supply from the constant current supply Ic is cut off by the transistor N21, the power consumption due to the corresponding current is reduced. Moreover, in this state, the current is not supplied to the two transistors P11 and P12, the two transistors P11 and P12 are not allowed to function as the paired differential inputs, with the result that it is not possible to determine the electric potential of the output terminal, that is, the junction between the two transistors P12 and N14.

Moreover, the transistors N31 and N33 of the respective input control sections 73*c* are cut off. Consequently, the signal line for transmitting the clock signal $SCK_1$, $SCK_2$ is cut off from the gates of the two transistors P11 and P12 on the input stage so that the gate capacitance, which forms the load capacitance of the signal line, is limited to that corresponding to each of the level shifters in operation. Consequently, even when a plurality of level shifters are connected to the signal line, the load capacitance of the signal line is reduced so that in the same manner as the control circuit 55 of FIG. 18, the power consumption of the circuit for driving the clock signals $SCK_1$, $SCK_2$, $SCK_1$B and $SCK_2$B is reduced.

Moreover, during the stoppage, the transistors P32 and P34 of the respective input signal control sections 73*d* are allowed to conduct so that the gate voltages of the two transistors P11 and P12 are set to the driving voltage Vcc, thereby cutting off the two transistors P11 and P12. Thus, in the same manner as the cutoff of the transistor N21, the current consumption is cut by an amount corresponding to the current outputted from the constant current source Ic. Here, in this state, since the two transistors P11 and P12 are not allowed to function as the paired differential inputs, it is not possible to determine the electric potential of the output terminal.

In addition, when the control signal ENA is not operated, the transistor P41 of the output stabilizing section 73*e* is allowed to conduct. Consequently, the above-mentioned output terminal, that is, the gate electric potential of the CMOS transistors P15 and N16 is set to the driving voltage Vcc, thereby allowing the output voltage OUT to go low. Thus, as illustrated in FIG. 20, in the case when the control signal $ENA_{i-1}$, that is, $Q_{i-1}$, is not operated, the output voltage OUT of the level shifter, that is, the output signal $SL_i$ of the shift register, is maintained in Low Level independent of the clock signal. As a result, different from the case in which the output voltage OUT is undetermined during the stoppage of the level shifter, it is possible to prevent malfunction of the SR flip-flop, and consequently to achieve a shift register which is operated in a stable manner.

Figure 22:
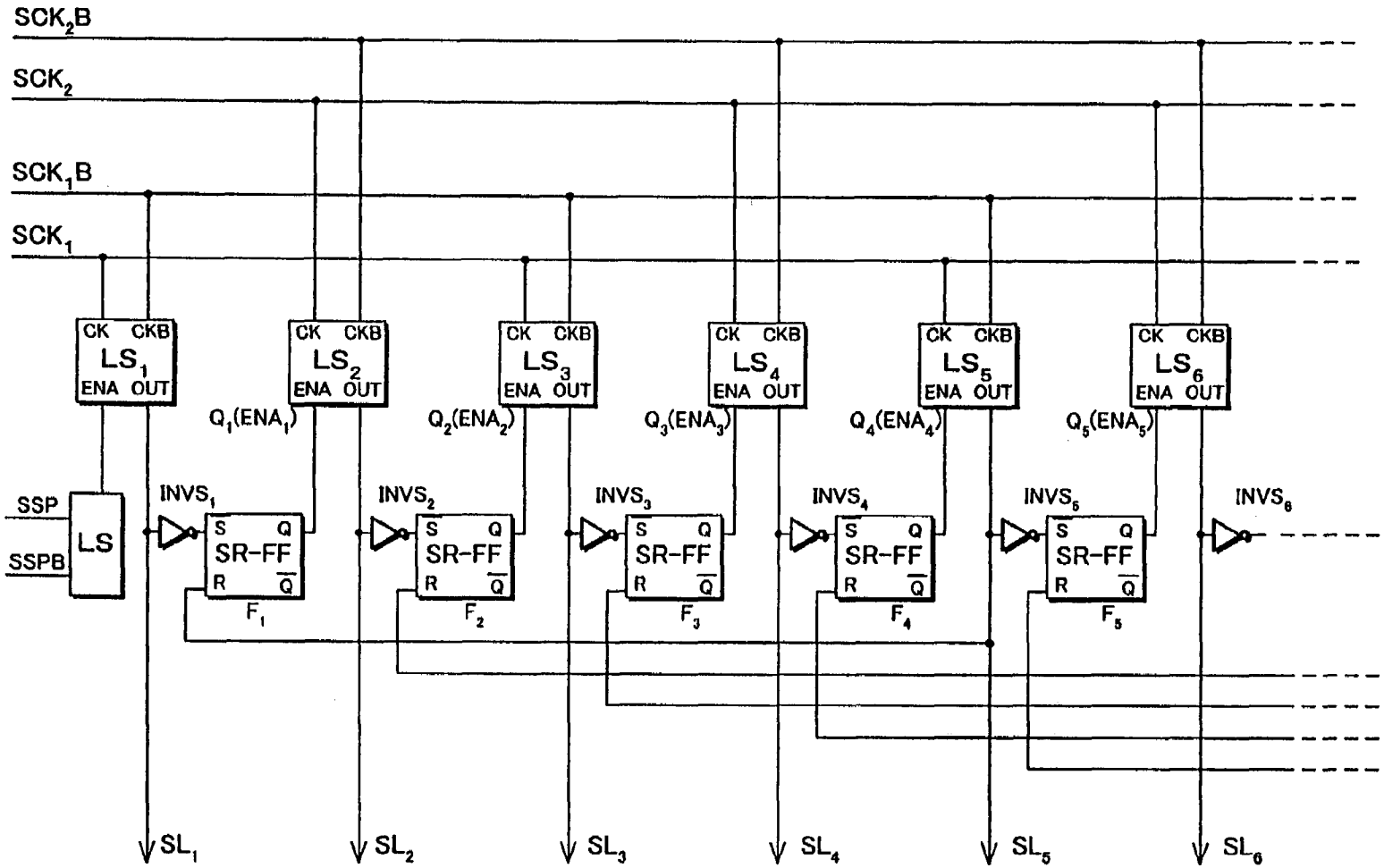
FIG. 22, which shows still another embodiment of the present invention, is a circuit diagram that shows the construction of an essential part of a shift register that contains a set and reset and flip-flop, and is suitable for a data signal line driving circuit.
Figure 23:
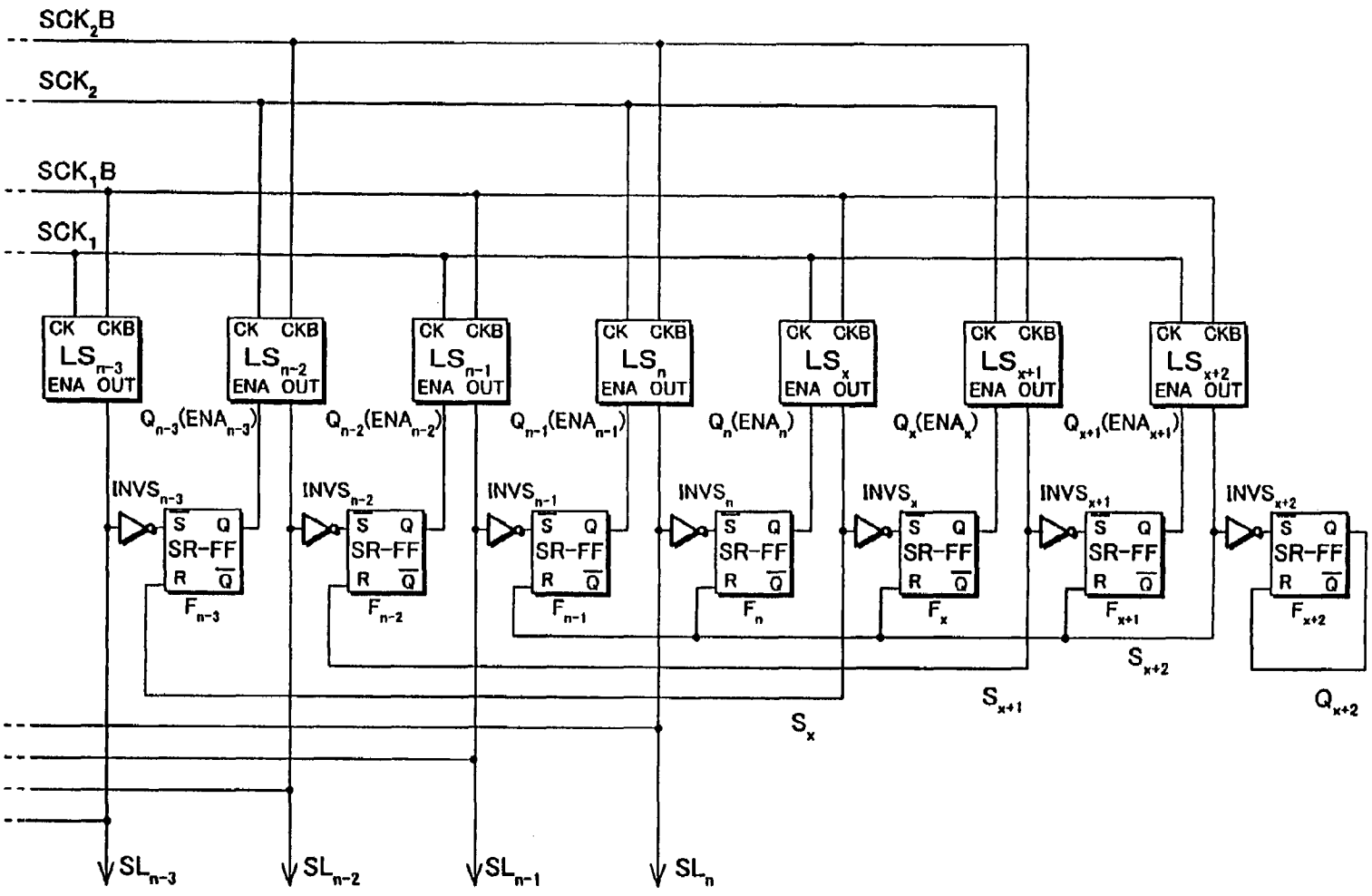
FIG. 23 is a circuit diagram that shows one example of a portion connected to the right side of FIG. 22.
Figure 24:
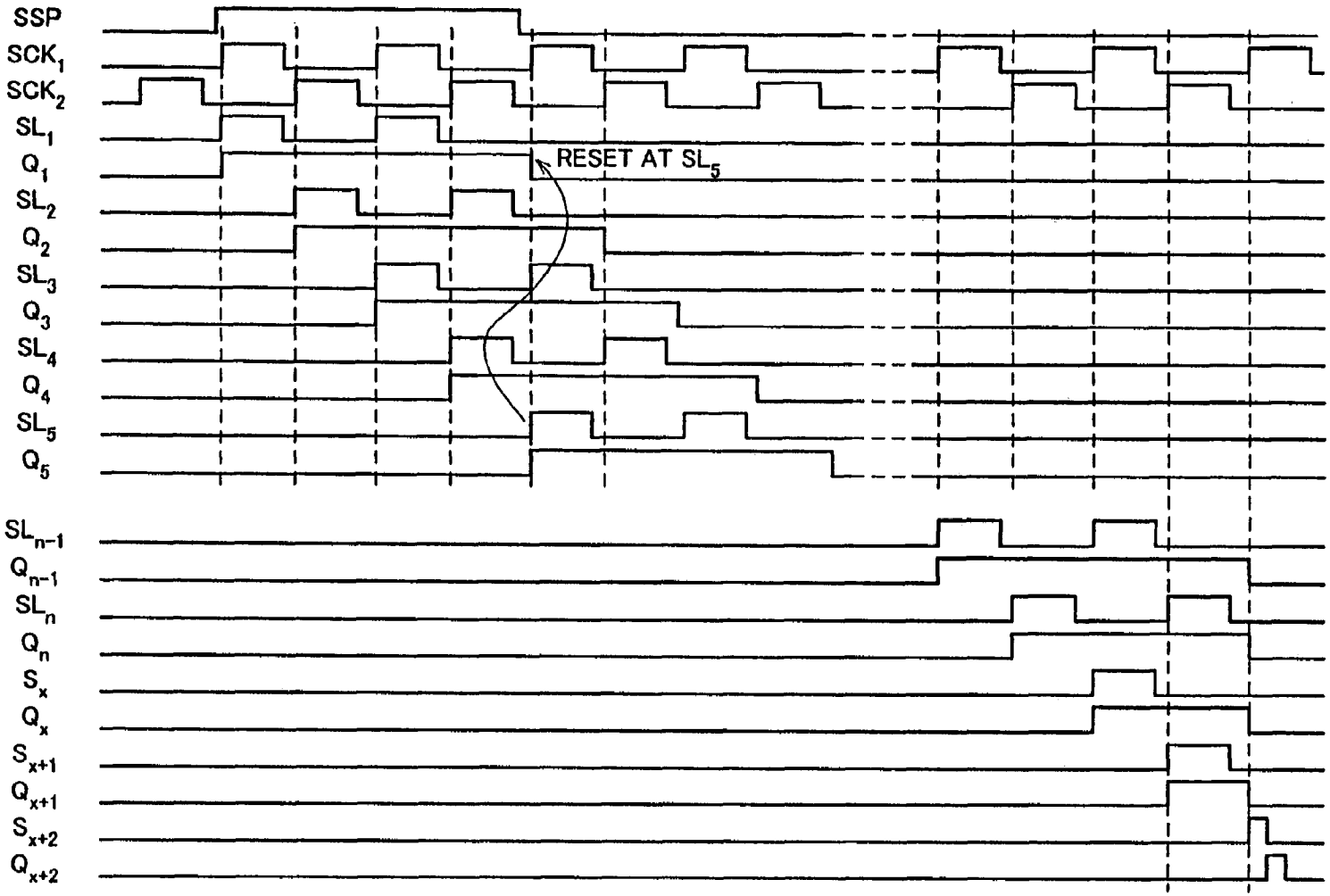
FIG. 24 is a timing chart that shows the operation of the above-mentioned shift register.

In an example shown in FIG. 17, flip-flops of a plurality of steps are provided as set-reset type flip-flops, and supposing that i and k are arbitrary integers not less than 1, an output pulse of the (i+k×M)-numbered stage is inputted to the reset terminal of the flip-flop on the i-numbered stage, and in this case, M=2 and k=1. The following description will discuss an example in which M=2 and k=2. FIGS. 22 and 23 show an example of a circuit in this case, and FIG. 24 shows a timing chart thereof. FIG. 23 shows a portion connected to the right side of FIG. 22. In other words, FIG. 22 shows the first stage of the shift register and the vicinity thereof, and FIG. 23 shows the last stage of the shift register and the vicinity thereof. As shown in these Figures, for example, the output pulse $SL_5$ on the fifth stage is used as a reset signal for the flip-flop $F_1$ on the first stage. In the example where M=2 and k=1, each of the signal lines outputs an output pulse only once; however, in the above-mentioned example where M=2 and k=2, it is possible to obtain an output pulse twice from each signal line. Thus, it is possible to obtain the same effect as in the case of precharging in the data signal line driving circuit.

In particular, in the case of a one-horizontal-period inversion driving (1H inversion driving) system that is one voltage application method to liquid crystal, of the two output pulses, in synchronized timing with the second output pulse, the source bus line is allowed to sample desired video image data to be sampled. Prior to the sampling at the time of the first output pulse, the electric potential of the source bus line is allowed to maintain an electric potential having a polarity reversed from the electric potential of video image data to be sampled at the time of the second output pulse. In the sampling at the time of the first output pulse, the source bus line is allowed to sample an electric potential having the same polarity as the electric potential of the video image data to be sampled at the time of the second output pulse, that is, the electric potential that was sampled by the source bus line two stages before the present. Therefore, the pulse width control (pulse control) of this type makes it possible to charge desired video image data to the source bus line more easily as compared with the case in which the source bus line having an electric potential of a reversed polarity is charged by an output pulse only once.

Here, the following description will discuss the precharging process. In the data signal line driving circuit, the output pulse is inputted to the sampling section, and video image data is successively sampled by the source bus line in accordance with the output pulse. In other words, the electric potential of the video image data is charged to the capacitance possessed by the source bus line. In this case, when the capability of the sampling section is low, it is sometimes not possible to charge a desired electric potential. In particular, in the case of a liquid crystal display, since an AC electric potential is used so as to prevent degradation in the liquid crystal, the width of fluctuations in the electric potential is relatively large. The application of the AC electric potential results in a polarity inversion, such as a one-horizontal-period inversion (1H inversion, also referred to as gate inversion), a frame inversion, a dot inversion or a source inversion. The reason that the AC electric potential is used because, with respect to a certain pixel, in general, the positive polarity and negative polarity need to be alternately applied thereto for each frame. For this reason, the charging capability required for the sampling section is relatively high. However, there have been increasing demands for high precision and a narrower frame width in image display devices, and the sampling time and the size of the sampling section are therefore limited. For this reason, in conventional devices, prior to sampling video image data, a precharging process for charging a predetermined electric potential having a polarity to be next sampled is carried out by using the following arrangements: A precharging circuit is attached to the data signal line driving circuit through a source bus line so as to be located on the display panel opposite thereto, or the data signal line driving circuit is allowed to have a precharging function that is driven by a control signal that needs to be prepared separately.

In this example, k is set to not less than 2 as described above, and a plurality of (that is, k number of) output pulses are outputted from each signal line. The fact that a plurality of output pulses are released is regarded as an increase in the operation time with respect to the circuit receiving the output pulses; therefore, this provides virtually the same effect as a lengthened pulse width in the output pulse.

In the example shown in FIG. 23, the last effective signal is $SL_n$, and in order to output the $SL_n$, dummy flip-flops $F_x$, $F_{x+1}$, $F_{x+2}$ and dummy level shifters $LS_x$, $LS_{x+1}$, $LS_{x+2}$ are used. In this case, the flip-flop $F_{x+2}$ on the final stage is reset by its own output. The output of the $LS_{x+2}$ is allowed to form a set signal for $F_{x+2}$ through $INVS_{x+2}$, and also to form reset signals for $F_{n-1}$, $F_n$. Moreover, the dummy flip-flops $F_x$, $F_{x+1}$ are also reset by using this signal.

Figure 25:
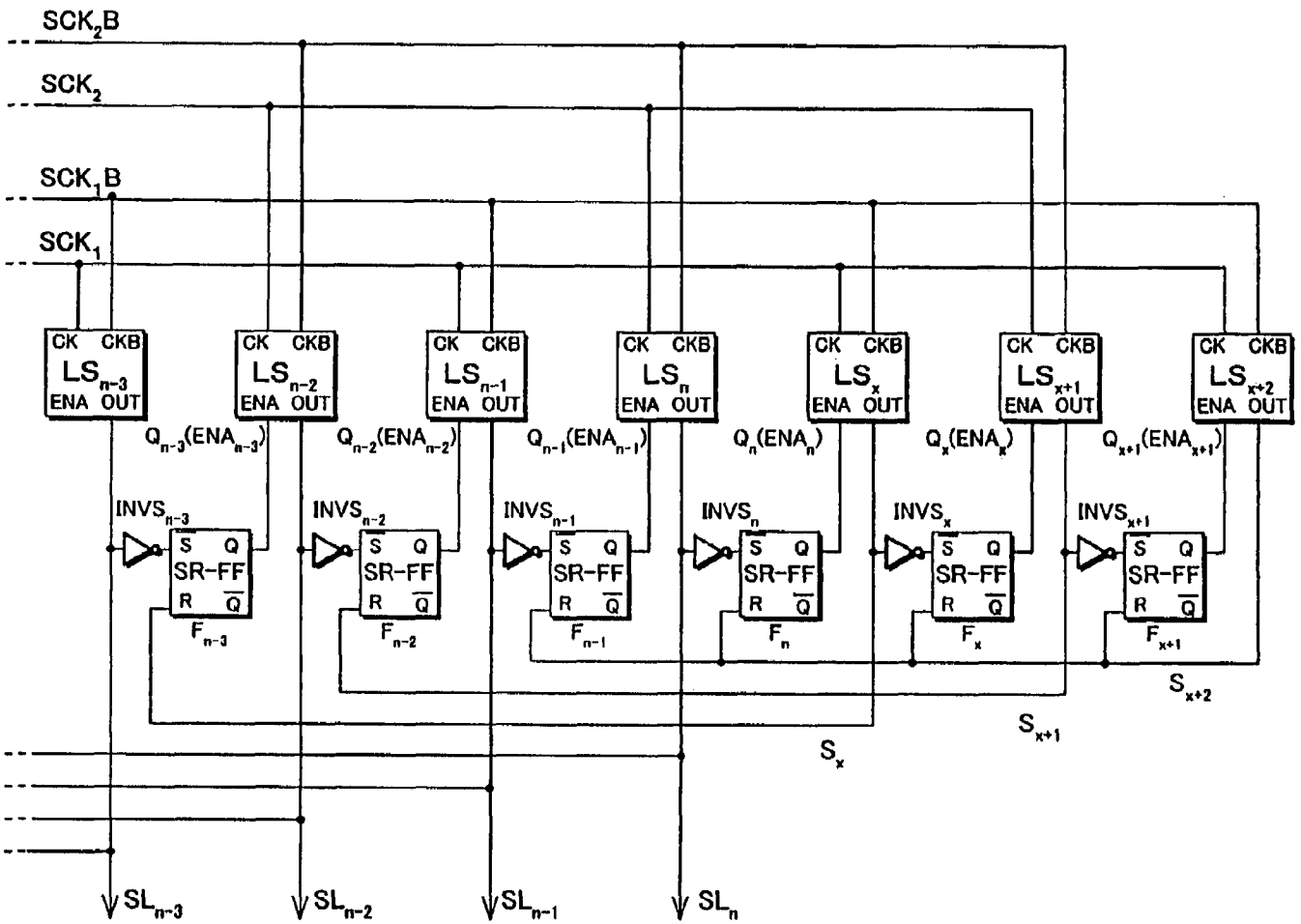
FIG. 25 is a circuit diagram that shows another example of a portion connected to the right side of FIG. 22.
Figure 26:
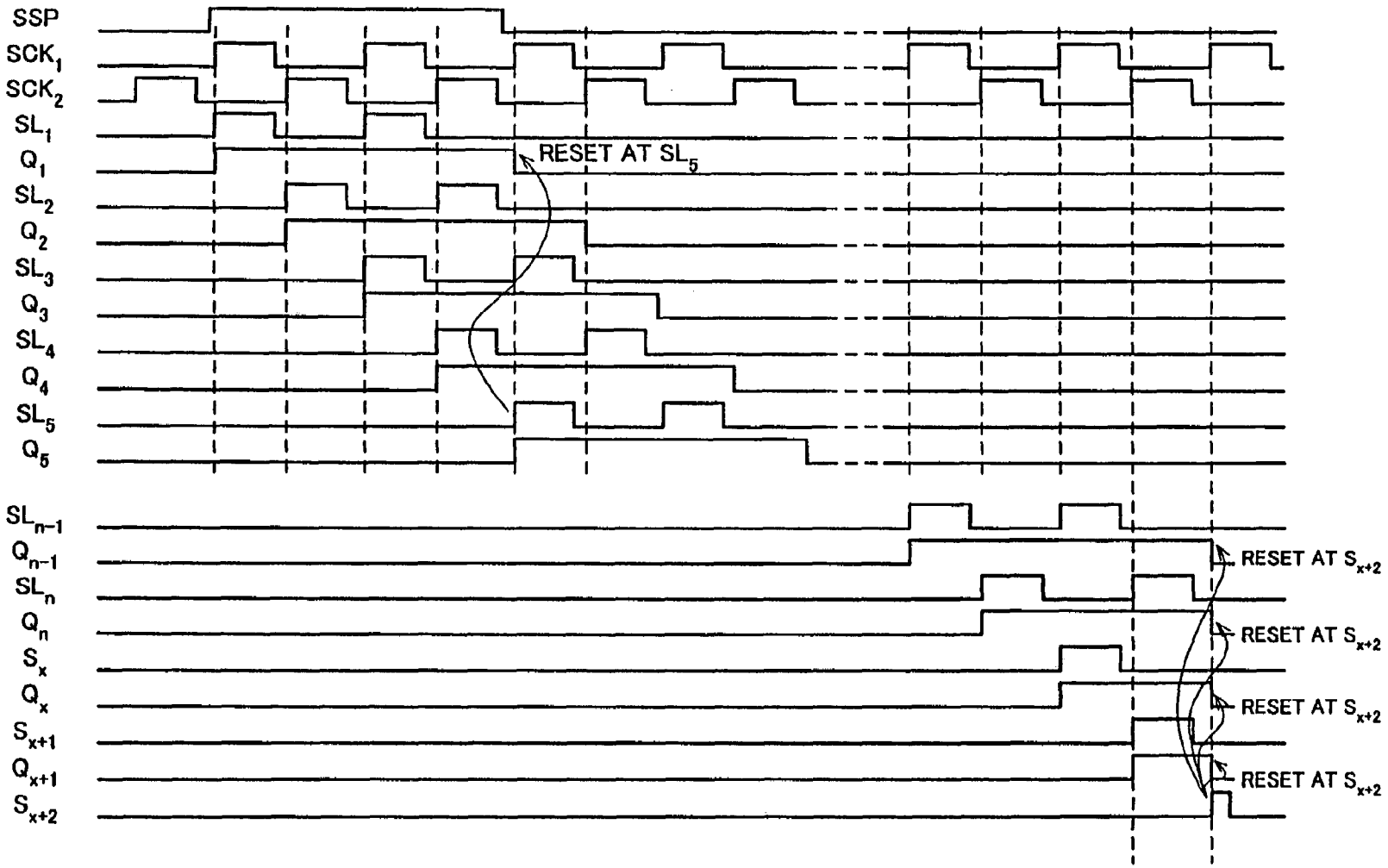
FIG. 26 is a timing chart that shows the operation of the above-mentioned shift register.

Here, in place of the arrangement shown in FIG. 23, another arrangement as shown in FIG. 25 may be used. The portion shown in FIG. 22 is commonly used. This arrangement is explained by a timing chart shown in FIG. 26. In this example, the flip-flop $F_{x+2}$ on the final stage is eliminated, and the output pulse of the level shifter $LS_{x+2}$ on the final stage is used as a reset signal; thus, this arrangement makes it possible to provide the same operation as shown in FIG. 23.

Figure 27:
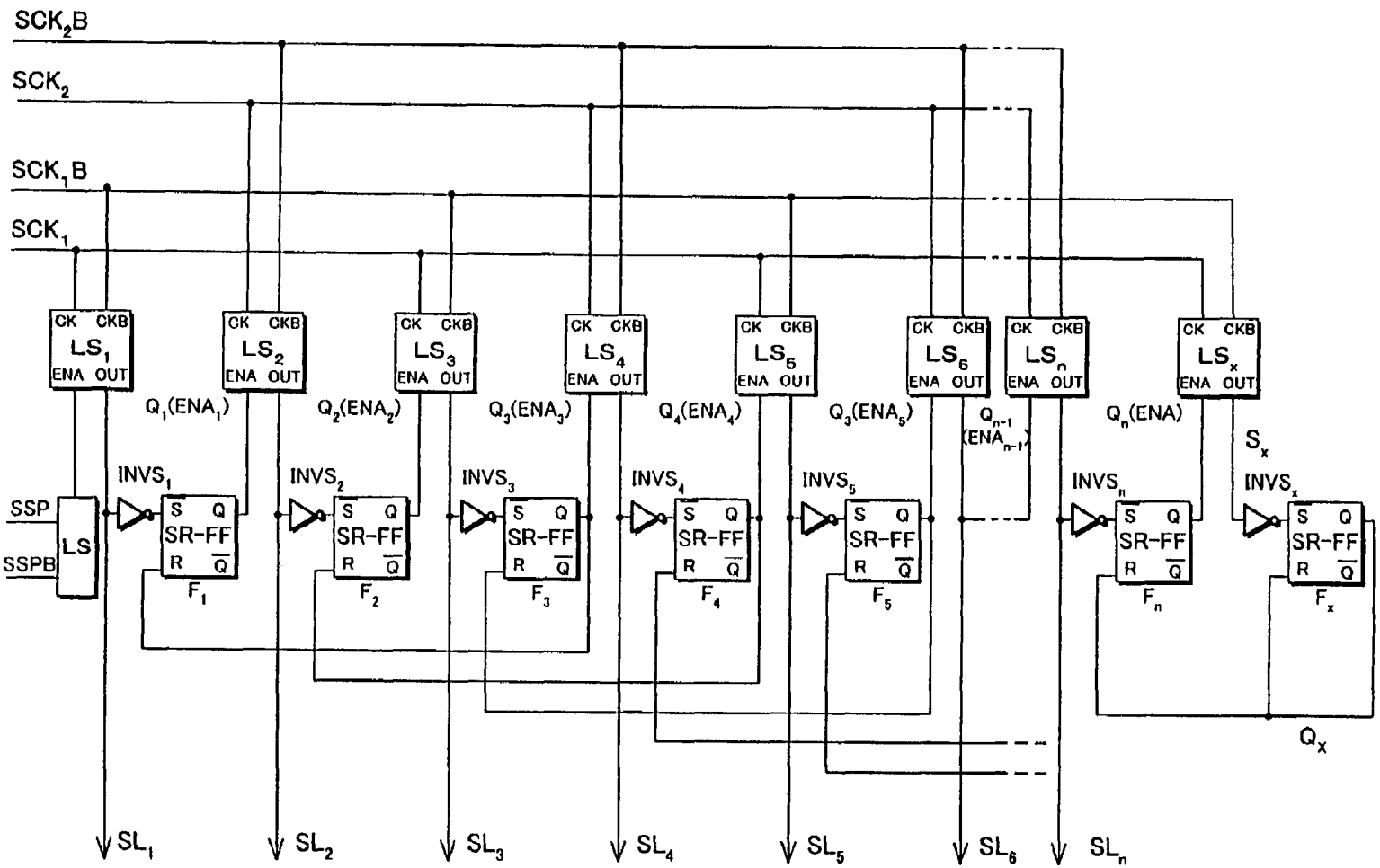
FIG. 27, which shows still another embodiment of the present invention, is a circuit diagram that shows the construction of an essential part of a shift register that contains a set/reset/flip-flop and is suitable for a data signal line driving circuit.
Figure 28:
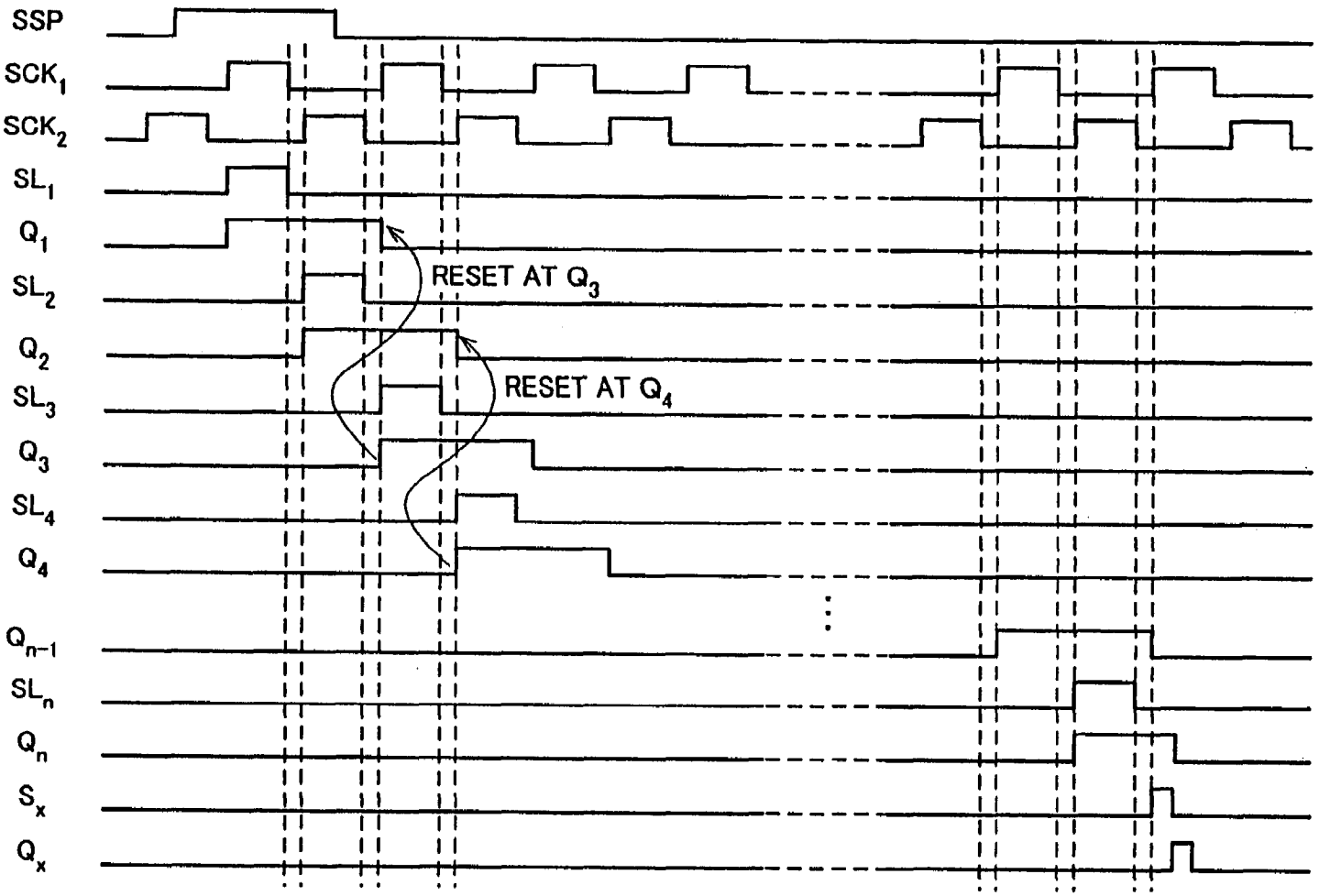
FIG. 28 is a timing chart that shows the operation of the above-mentioned shift register.

In examples shown in FIG. 17 and FIGS. 22 through 26, flip-flops of a plurality of stages are provided as flip-flops of the set-reset type, and supposing that i and k are arbitrary integers not less than 1, an output pulse of the (i+k×M)-numbered stage is inputted to the reset terminal of the flip-flop on the i-numbered stage. Different from these examples, another arrangement may be proposed in which an output signal of the (i+k×M)-numbered stage of the flip-flop is inputted to the reset terminal of the flip-flop on the i-numbered stage. FIG. 27 shows an example of a circuit diagram at this time, and FIG. 28 shows a timing chart thereof. As shown in these Figures, for example, the output signal $Q_3$ ($ENA_3$) of the flip-flop on the third stage is used as a reset signal for the flip-flop $F_1$ on the first stage. In this case, M=2 and k×1; however, k may be set to not less than 2 in the same manner as described earlier.

These arrangements make it possible to provide the same effects as obtained in the examples of FIG. 17 and FIGS. 22 through 26. Moreover, different from these examples, another arrangement may be proposed in which not an output pulse of a shift register, but an output of a flip-flop is used as a reset signal for a flip-flop; thus, it is possible to reduce the load of an output pulse of a shift register.

[Embodiment 5]

The following description will discuss still another embodiment of the present invention. Here, in the present embodiment, those members that have the same functions and that are described in the drawings of the above-mentioned Embodiments are indicated by the same reference numerals, and the description thereof is omitted.

Figure 29:
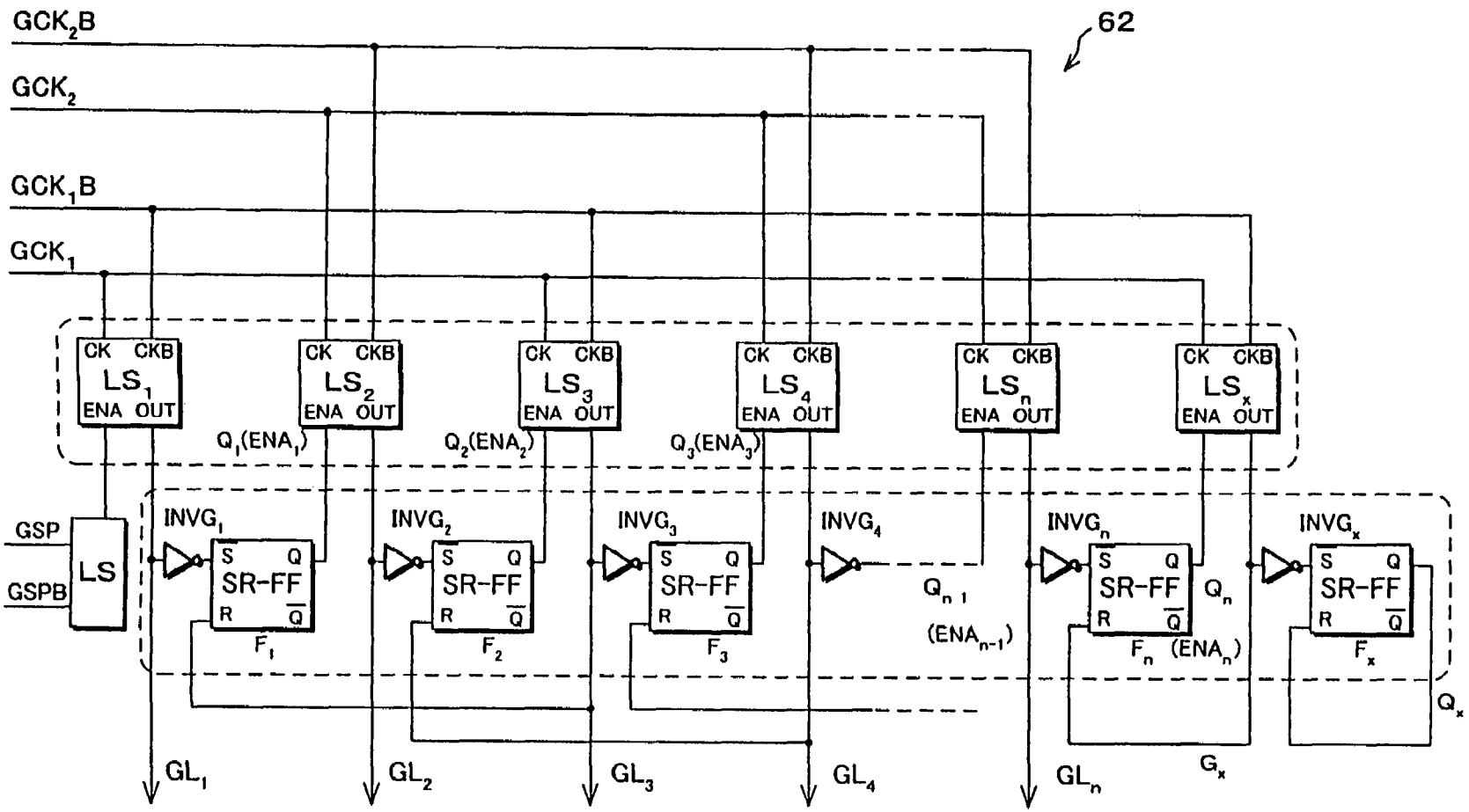
FIG. 29, which shows one embodiment of the present invention, is a circuit diagram that shows the construction of an essential part of a shift register that contains a set/reset/flip-flop, and is suitable for a scanning signal line driving circuit.

In the present embodiment, referring to FIGS. 29 and 30, an explanation will be given of a case in which the present invention is applied to a scanning signal line driving circuit. FIG. 29 shows the scanning signal line driving circuit, and the circuit construction and circuit functions are the same as those of the data signal line driving circuit discussed in Embodiment 4. Therefore, the description of the operation principle thereof is omitted.

As described above, a shift register 62 related to the present embodiment is a shift register used in the scanning signal line driving circuit 54 of FIG. 18, and as illustrated in FIG. 29, it has the same construction as the shift register 61 of Embodiment 4 except that two kinds of clock signals $GCK_1$ and $GCK_2$ are inputted thereto as clock signals and that a start signal GSP serving as a start pulse is inputted thereto.

In addition to the above-mentioned clock signals $GCK_1$ and $GCK_2$, inversion signals $GCK_1B$ and $GCK_2B$ that are signals having the respectively inverted phases of these are also inputted to the scanning signal line driving circuit 54 from the control circuit 55. Moreover, a signal GSPB that is an inversion signal having the inverted phase of the start signal GSP is also inputted to the scanning signal line driving circuit 54 from the control circuit 55.

Figure 30:
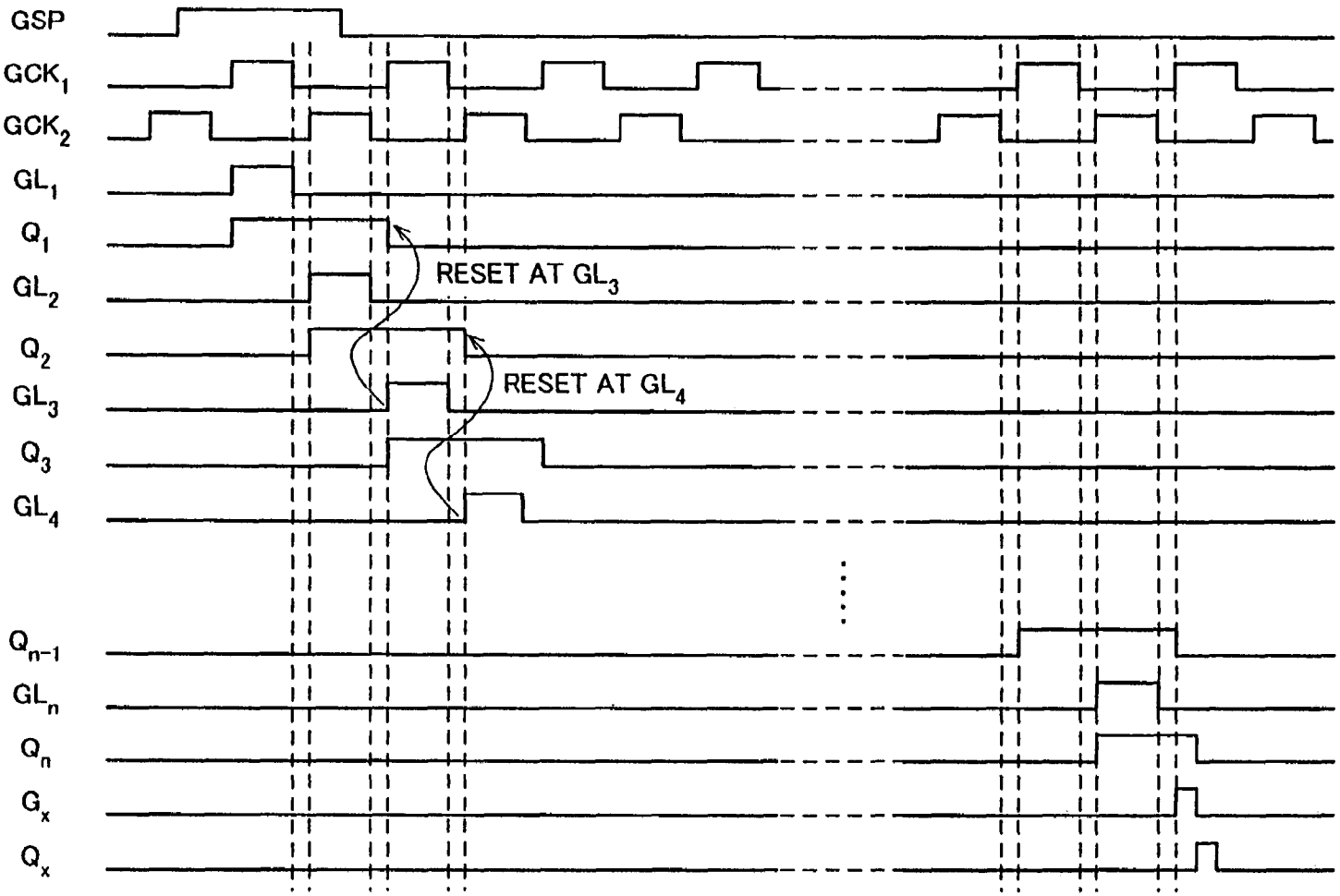
FIG. 30 is a timing chart that shows the operation of the above-mentioned shift register.

In a timing chart shown in FIG. 30, the clock signals $GCK_1$ and $GCK_2$ (where inversion signals $GCK_1B$ and $GCK_2B$ are not shown) are set in their phases so as not to have overlapped high periods; and in the present embodiment, the clock signals $GCK_1$ and $GCK_2$ have their phases offset by 180° from each other.

In the present embodiment, the above-mentioned clock signals $GCK_1$ and $GCK_2$ are used, and $GCK_1$ and $GCK_2$ are voltage-raised by the level shifters LS so as to control inputs to the flip-flops through $INVG_1$ and $INVG_n$, and the resulting signals are outputted therefrom as $GL_1$ through $GL_n$. For this reason, the scanning signals become free from overlapped portions. Moreover, neither GPWC signal nor logic circuits described in the Prior Art section are required so that it is possible to easily achieve a narrower frame width. Here, in the case of the scanning signal line driving circuit, overlapped portions of the consecutive scanning signals would cause serious degradation in the display quality; therefore, in order to avoid overlapped portions of the scanning signals, the pulse width control signal GPWC used for eliminating overlapped portions of the scanning signals, described in the Prior Art section, may be adopted.

Figure 31:
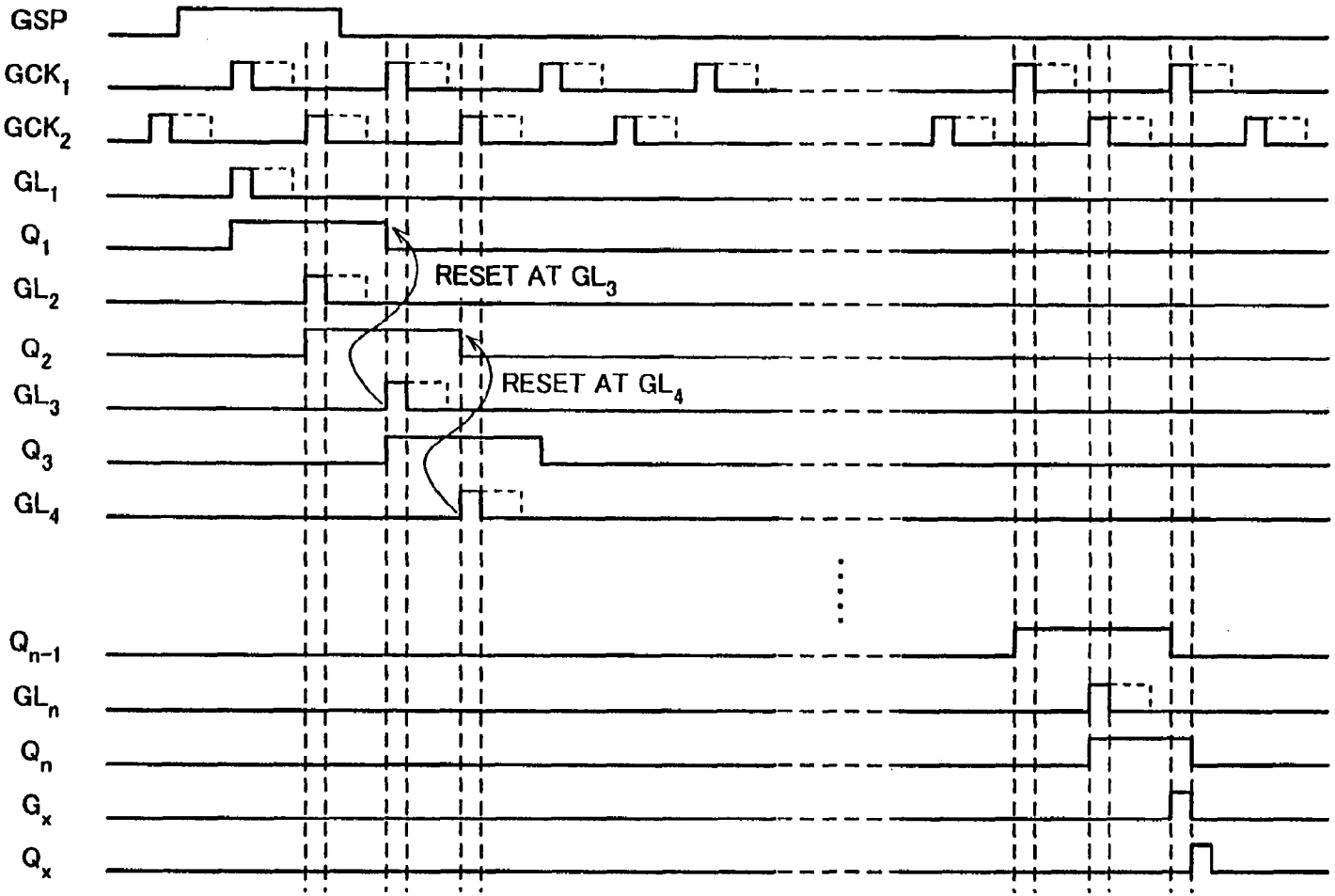
FIG. 31 is a timing chart that shows the operation of the above-mentioned shift register.

Moreover, in Embodiment 4 and examples of FIGS. 29 and 30, the duty ratio of each clock signal of M kinds is preferably set to not more than (100×1/M) %, more preferably, less than (100×1/M) %. In other words, in these examples, M=2 so that the duty ratio of each of the clock signals $SCK_1$, $SCK_2$, $GCK_1$ and $GCK_2$ is set to less than 50%. For this reason, the M kinds of clock signals are allowed to have at least either of the phase having no overlapped portions in the high level period and the phase having no overlapped portions in the low level period. In other words, in these examples, two kinds of clock signals ($SCK_1$ and $SCK_2$, or $GCK_1$ and $GCK_2$) are set to have waveforms whose phases have no overlapped portions in their high level period that is a period for instructing the activation of the level shifter section 73. Next, FIG. 31 shows a timing chart of an example in which the duty ratio is changed from the value in the example shown FIGS. 29 and 30. In this timing chart, rectangular waveforms indicated by dotted lines in waveforms of the clock signals $GCK_1$ and $GCK_2$, output pulses $GL_1$, $GL_2$, . . . , output signals of the flip-flops $Q_1$, $Q_2$, . . . , are the same waveforms in the example shown in FIGS. 29 and 30, and rectangular waveforms indicated by solid lines are waveforms obtained by changing these waveforms. In the example shown in FIG. 31, the duty ratio is further reduced from the value in the example of FIGS. 29 and 30. The example of FIG. 31 indicates that the output pulses $GL_1$, $GL_2$, . . . , outputted in response to the clock signals $GCK_1$ and $GCK_2$, are narrowed in their pulse widths as compared with the corresponding output pulses in the example of FIGS. 29 and 30. In this manner, it is possible to desirably change the pulse width of the output pulses.

As described above, in the present invention, in the shift register constituted by SR flip-flops that operate in synchronism with CK signals ($SCK_1$, $SCK_2$, $GCK_1$ and $GCK_2$) and level shifters for voltage-raising the clock signals, each level shifter is operated in accordance with the output of the SR flip-flop on the preceding stage, and the shift register is operated by the output thereof, and the output signal of the corresponding level shifter is allowed to form a shift register output. Moreover, by using not less than two kinds of CK signals that have a duty ratio of less than 50% and have no overlapped portions in their high (or low) period, it becomes possible to prevent the respective outputs of the shift registers from overlapping each other. Moreover, the level shifters are allowed to operate only when they are necessary. As a result, it is not necessary to provide a circuit for preventing the overlaps, and it is therefore possible to miniaturize the driving circuit. Moreover, since the output width of the shift registers is desirably changed, it is possible to reduce the power consumption of a shift register that is properly operated even when the clock signal amplitude is small. Therefore, it is possible to achieve a shift register which is desirably used for a driving circuit of an image display device, and properly operated even in the case of a small clock signal, and which also miniaturizes the driving circuit, desirably changes the pulse width of the output signal and reduces the power consumption, and consequently to realize an image display device having such a shift register.

As described above, the shift register of the present invention described in Embodiment 4 or 5, which is provided with flip-flops of a plurality of stages that operate in synchronism with clock signals and level shifters for voltage-raising the clock signals to be inputted to the flip-flops on a plurality of stages, is characterized in that the level shifter is installed in each of the flip-flops on a plurality of stages, and in that supposing that n is an integer not less than 1, in accordance with the output signal of the flip-flop on the n-numbered stage, a pulse that is voltage-raised with the same width of the pulse width of the clock signal by the level shifter on the (n+1)-numbered stage is inputted to the flip-flop on the (n+1)-numbered stage, and is also outputted as an output signal of the shift register.

For example, the present shift register is provided with flip-flops of a plurality of stages that operate in synchronism with clock signals, level shifters, each of which, in the case when the clock signal has a voltage value lower than the power supply voltage, voltage-raises the clock signal for each of the flip-flops on a plurality of stages, and control means for controlling the operation of the level shifter, each of the level shifters and the control means being placed for each of the flip-flops on a plurality of stages. In this arrangement, in accordance with the output signal of the flip-flop on the n-numbered stage of a plurality of stages, the level shifter is controlled by the control means on the (n+1)-numbered stage and the clock signal is voltage-raised and inputted thereto so that the flip-flop on the (n+1) numbered stage is operated, and a pulse which has been voltage-raised so as to have the same width as the pulse width of the clock signal, is outputted.

In the above-mentioned arrangement, the output of each of the flip-flops, which is operated in synchronism with the clock signal, is allowed to activate a level shifter that voltage-raises the clock signal to be supplied to the flip-flop on the next stage; thus, it is possible to activate only one portion of the level shifters installed inside the shift register. This voltage-raised clock signal is allowed to form an output (SL1, etc.) of the shift register, which has the same pulse width as the clock signal.

Conventionally, level shifters are installed outside a shift register, and the clock signal is once voltage-raised to a driving voltage, and this is supplied to a plurality of flip-flops constituting the shift register. Moreover, a large buffer is provided so as to prevent the voltage-raised clock signal from being subjected to rounding and delay due to the capacitance of transmission lines, the gate capacitance of transistors connected thereto, etc.; therefore, due to these capacitances and high electric potential after having been raised, as also described in the Prior Art section, the power consumption increases in accordance with the expression, Power P=Capacitance C×Frequency f×a square of Voltage V, resulting in a great increase in the power consumption of the circuit.

In contrast, in accordance with the construction of the present invention, a low-voltage clock signal is transferred and each flip-flop is installed immediately after a level shifter so that one portion of the level shifters placed inside the shift register are operated; thus, it becomes possible to greatly reduce the power consumption.

In addition, since it is not necessary to install a circuit (NOR, etc.) for carrying out logical operations, the size of the driving circuit can be reduced. Moreover, in the logical operation section, the output from the logical operation section tends to have a partially overlapped portion due to delay (delay in the rising-edge or trailing-edge of the signal) of signals occurring in the logical operation section; however, the present invention makes it possible to eliminate the partially overlapped portion of the output of the logical operation section. Furthermore, it is possible to eliminate a special circuit and a transmission line for a special signal for eliminating the overlapped portion of the output pulse; therefore, it becomes possible to greatly reduce the size of the driving circuit.

Moreover, in the shift register of the present invention, each of the shift registers may be designed so as to include a current-driving type voltage-raising section.

In the above-mentioned arrangement, while the level shifter is being operated, the input switching element of the level shifter is always allowed to conduct. Therefore, different from a voltage-driving type level shifter that is allowed to conduct/cut off the input switching element based upon the level of the input signal, even in the case when the amplitude of the input signal is lower than the threshold value of the input switching element; consequently, it becomes possible to level-shift the input signal without causing any problem, in addition to the effects obtained by the above-mentioned arrangement.

Moreover, in the case of the current-driving type level shifter, since the input switching element is allowed to conduct in operation, the power consumption is greater than the voltage-driving type level shifter; however, in the present arrangement, among the level shifters installed in the shift register, some of them are operated only when the output signal from the flip-flop is active, and are stopped in the other cases. Thus, in addition to the effects obtained by the above-mentioned arrangement, even in the case when the input signal is low, it is possible to carry out the level shift, and also to greatly reduce the power consumption.

Moreover, in the shift register of the present invention, the output signal of the flip-flop on the n-numbered stage is inputted to the voltage-raising section of the level shifter on the (n+1)-numbered stage so that the corresponding level shifter may be stopped by applying a signal having a level so as to cut off the input switching element.

For example, a control means is allowed to apply the signal having a level so as to cut off the input switching element as an input signal to each of the voltage-raising sections so that the corresponding level shifter is stopped.

An explanation will be given of the above-mentioned arrangement by exemplifying a case in which the input switching element is an MOS transistor. For example, in the case when the input signal is applied to the gate, the input signal having a level so as to cut off the drain and source is applied to the gate so that the input switching element is cut off. Moreover, in the case when the input signal is applied to the source, for example, a method for applying virtually the same signal as that of the drain or other methods may be used to cut off the input switching element.

In any of the cases, the control means controls the level of the input signal so that the input switching element is cut off; thus, the operation of the current-driving type level shifter is stopped. Thus, in addition to the effects of the aforementioned arrangements, it is possible to stop the level shifter, and consequently to reduce the power consumption by an amount corresponding to the current flowing through the input switching element during the stoppage.

Moreover, the level shifter of the present invention may be arranged so that the output signal of the flip-flop on the n-numbered stage is allowed to stop the power supply to the level shifter on the (n+1) numbered stage so that the corresponding level shifter is stopped.

For example, the control means may stop supplying power to each level shifter so as to stop the corresponding level shifter.

In the above-mentioned arrangement, the control means stops supplying power to each level shifter so as to stop the corresponding level shifter. Thus, in addition to the effects obtained by the aforementioned arrangement, it is possible to stop the level shifter, and consequently to reduce the power consumption by an amount corresponding to power consumed by the level shifter in operation.

Moreover, the shift register of the present invention may be arranged so that the level shifter is provided with an output stabilizing means which maintains the output voltage to a predetermined value at the time of the stoppage.

In general, when the output voltage of the level shifter becomes unstable during the stoppage of the level shifter, the operation of the flip-flop to which the corresponding level shifter is connected might become unstable.

In contrast, the above-mentioned arrangement of the present invention makes it possible to maintain the output voltage of the corresponding level shifter to a predetermined value by using the output stabilizing means while the stoppage of the level shifter.

As a result, in addition to the effects of the aforementioned arrangement, it becomes possible to prevent malfunction of the flip-flop due to an unstable output voltage, and consequently to realize a shift register which is operated in a stable manner.

Moreover, in the shift register of the present invention, the gate capacitance of a transistor which is installed in the level shifter on the (n+1)-numbered stage and to which a clock signal is inputted may be separated from the transmission line of the clock signal by using an output signal from the flip-flop on the n-numbered stage.

For example, the control means is arranged to control the gate capacitance of the transistor which is installed in the voltage-raising section and to which the clock signal in inputted so that it may be separated from the transmission line of the clock signal.

In general, the input signal to each level shifter is transferred to the level shifter through a transmission line, and since the transmission line is placed on the circuit together with wires, etc. other than the transmission line through an insulating film, the overlapped portion comes to have a capacitance. Moreover, the capacitance related to the transmission line is not limited to this. In other words, in the case of an MOS transistor, the input signal is inputted to the gate electrode of the transistor, and there is a capacitance at the gate of a transistor which is referred to as a gate capacitance, and the value increases in proportion to the size of the transistor. Therefore, the capacitance of the transmission line contains the capacitance derived from the overlapped portion of the wires and the gate capacitance of the transistor.

In the case of the circuit for voltage-raising a low input voltage, such as a level shifter, it tends to be connected to the gate electrode of a comparatively large transistor, and the gate capacitance tends to become greater, with the result that the capacitance of the transmission line as a whole becomes greater. Consequently, in order to externally supply a signal, greater power is required so as to drive the capacitance of the transmission line, resulting in an increase in the power consumption of the external circuit.

In contrast, in accordance with the arrangement of the present invention, even when a plurality of level shifters are installed, the control means controls the input signal so that the input signal is supplied to the level shifter only when required. For this reason, even when the input signal is connected to the gate electrode of a comparatively large transistor inside the level shifter, it is separated from the gate electrodes of the transistors except for those that are required. For this reason, in addition to the effects obtained by the aforementioned arrangement, the capacitance of the transmission line of the input signal is reduced, large power for driving the capacitance of the transmission line is not required, and it is possible to prevent the power consumption of the external circuit from becoming larger.

Moreover, in the shift register of the present invention, supposing that M is an integer of not less than 2, M kinds of clock signals may be used, and the respective clock signals may be successively inputted to the flip-flops on a plurality of stages.

For example, the M ($M \geqq 2$) kinds of clock signals are successively inputted to every M number of the flip-flops.

In the above-mentioned arrangement, the frequency can be reduced by using a plurality of clock signals. Moreover, upon inputting the clock signal from the external circuit, the frequency can be regulated to a low level; therefore, in addition to the effects obtained by the aforementioned embodiments, it becomes possible to reduce the power consumption of the external circuit.

Moreover, in the shift register of the present invention, the M kinds of clock signals are allowed to have at least either of the phase having no overlapped portions in the high level period and the phase having no overlapped portions in the low level period.

In other words, the M kinds of clock signals are set to have waveforms whose phases have no overlapped portions in their high level period or low level period.

In accordance with the above-mentioned arrangement, the clock signal which has been voltage-raised by the level shifter is allowed to form an output of the shift register, and the output has the same pulse width as the clock signal. Therefore, in addition to the effects obtained by the aforementioned embodiments, it becomes possible to obtain a voltage-raised output signal adjacent to the voltage-raised output signal without having any overlapped portions.

Moreover, in the shift register of the present invention, the duty ratio of each clock signal of M kinds is preferably set to not more than $(100 \times 1/M)$ %.

In this arrangement, the clock signal which has been voltage-raised by the level shifter is allowed to form the output of the shift register, and the output has the same pulse width as the clock signal. Therefore, in addition to the effects obtained by the aforementioned embodiments, it becomes possible to obtain a voltage-raised output signal adjacent to the voltage-raised output signal without having any overlapped portions, and also to change the pulse width desirably.

Here, "duty ratio" is a ratio in terms of time between the active period and the non-active period of a signal waveform. Here, active refers to a state in which the signal is active and inactive refers to a state in which the signal is inactive. The one cycle of the waveform is represented by a sum of the active time and the inactive time. For example, a duty ratio of 40% represents that the active time accounts for 40% of one cycle. For example, the state in which the signal waveform is high is referred to as "active" and the state in which the signal waveform is low is referred to as "inactive". The low period is defined as "active" depending on circuits.

Moreover, in the shift register of the present invention, the above-mentioned flip-flops on a plurality of stages may be provided as set-reset type flip-flops; and supposing that k is an arbitrary integer not less than 1, an output pulse of the $(i+k \times M)$-numbered stage may be inputted to the reset terminal of the flip-flop on the i-numbered stage.

In this arrangement, in addition to the effects obtained by the aforementioned embodiments, it becomes possible to adjust the pulse width of a signal outputted from each flip-flop so as to have a desired period.

Here, an explanation will be given of the "set-reset type flip-flop".

In general, the flip-flop refers to a circuit in which transition occurs between two stable states each time a signal is applied in certain synchronized timing, and while the signal is not applied, the state, as it is, is maintained. In the set-reset type flip-flop, for example, the output is set to High Level by an inputted set signal, and even when the set signal becomes inactive, the output state is maintained. Thereafter, the reset signal becomes active while the set signal is inactive, the output is set to Low Level, and even when the reset signal becomes inactive, this state is maintained until the set signal becomes active.

Moreover, in the shift register of the present invention, the flip-flop on each of the stages is a set-reset type flip-flop, and supposing that i and k are integers not less than 1, an output signal of the flip-flop on the $(i+k \times M)$-numbered stage may be inputted to the reset terminal of the flip-flop on the i-numbered stage.

In this arrangement, in addition to the effects obtained by the aforementioned embodiments, it becomes possible to adjust the pulse width of a signal outputted from each flip-flop so as to have a desired period.

Furthermore, different from the case in which the output pulse of the shift register is used as a reset signal, the application of the output of the flip-flop as the reset signal makes it possible to prevent an increase in the load of the output pulse of the shift register.

Moreover, the image display device of the present invention is provided with a display section which is provided with: a plurality of pixels arranged in a matrix format; a plurality of data signal lines placed on the respective columns of the pixels and a plurality of scanning signal lines placed on the respective rows of the pixels and which displays an image on the pixel by a data signal that is sent from the data signal line to each pixel in synchronism with a scanning signal supplied from each scanning signal line so as to form an image; a scanning signal line driving circuit for successively supplying scanning signals having different timing from each other to the scanning signal lines in synchronism with a first clock having a predetermined cycle; and a data signal line driving circuit for extracting data signals applied onto the respective pixels on the scanning signal line to which the scanning signal has been applied, from a video image signal that has been successively applied in synchronism with a second clock having a predetermined cycle and is representative of a display state of each pixel, and for outputting the resulting data to each of the data signal lines. In the image display device having the above-mentioned arrangement, at least either the data signal line driving circuit and the scanning signal line driving circuit is provided with either of the above-mentioned shift registers having the first or second clock signal as a clock signal.

For example, the above-mentioned scanning signal driving circuit successively outputs the scanning signal to the scanning signal lines in synchronism with a predetermined timing signal. Further, the data signal line driving circuit successively outputs the video image signal to the data signal lines in synchronism with a predetermined timing signal.

In general, in the image display device, as the number of data signal lines or the number of scanning signal lines increases, the number of the flip-flops for generating timing for each signal line increases, thereby making the distance between the two ends of the flip-flop longer. Here, in the shift register of each of the above-mentioned arrangements, the driving capability of the level shifter is small, and even when the distance between the two ends of the flip-flop is long, it is possible to eliminate a buffer, and consequently to reduce the power consumption. Therefore, by installing the shift register having any one of the above-mentioned arrangements in at least either the data signal line driving circuit or the scanning signal line driving circuit, it is possible to reduce the power consumption, to miniaturize the circuit scale of the shift register and also to provide a narrower frame width in the image display device.

Moreover, in the image display device of the present invention, either the data signal line driving circuit or the scanning signal line driving circuit may be formed on the same substrate as the pixels.

In the above-mentioned arrangement, at least either the data signal line driving circuit or the scanning signal line driving circuit is formed on the same substrate as the pixels. Therefore, wiring between the data signal line driving circuit and the respective pixels or wiring between the scanning signal line driving circuit and the respective pixels is formed on the corresponding substrate and it is not necessary to place it outside of the substrate. As a result, even when the number of the data signal lines or the number of the scanning signal lines increases, the number of signal lines that have to be placed outside the substrate need not be changed, and no assembling process is required.

For example, the data signal line driving circuit, the scanning signal line driving circuit and the pixels are formed on the same substrate. As a result, the data signal line driving circuit, the scanning signal line driving circuit and the pixels are formed on the same substrate; thus, the wiring between the data signal line driving circuit and the respective pixels and the wiring between the scanning signal line driving circuit and the respective pixels are arranged on the same substrate, and need not be installed outside the substrate. Consequently, even when the number of the data signal lines and the number of the scanning signal lines are increased, the number of signal lines to be placed outside is not changed, and no assembling process is required.

Therefore, in addition to the effects obtained by the aforementioned embodiments, it becomes possible to eliminate time-consuming tasks during the manufacturing process and also to prevent an undesired increase in the capacitance of each signal line and a reduction in the degree of integration.

Moreover, in the image display device of the present invention, the data signal line driving circuit, the scanning signal line driving circuit and the respective pixels may be designed so as to contain switching elements made of polycrystal silicon thin-film transistors.

In other words, the respective switching elements constituting the data signal line driving circuit, the scanning signal line driving circuit and the respective pixels are made of polycrystal silicon thin-film transistors.

In general, as compared with the monocrystal silicon, the polycrystal silicon thin-film is easily expanded in its area; however, the polycrystal silicon transistor is inferior to the monocrystal transistor in transistor characteristics, such as the mobility and threshold value. Therefore, in the case when each circuit is manufactured by using monocrystal silicon transistors, it becomes difficult to expand the display area; in contrast, in the case when each circuit is manufactured by using polycrystal silicon transistors, there is a reduction in the driving function in the circuit. Moreover, in the case when the two driving circuits and the pixels are formed on respectively different substrates, the two substrates need to be connected by signal lines, resulting in time-consuming tasks during the manufacturing process and an increase in the capacitance of each signal line.

In contrast, in accordance with the arrangement of the present invention, all the data signal line driving circuit, the scanning signal line driving circuit and the respective pixels are constituted by switching elements made of polycrystal silicon thin-film transistors. For this reason, in addition to the effects obtained by the aforementioned arrangements, it becomes possible to easily expand the display area. Moreover, since these members are easily formed on the same substrate, it is possible to reduce time-consuming tasks during the manufacturing process and the capacitance of the respective signal line.

In addition, since the above-mentioned shift register is used, it is possible to reduce the circuit scale and consequently to provide a thinner frame, and it is also possible to reduce the power consumption even when the shift register is controlled by using a clock signal having a low amplitude.

Furthermore, in the image display device of the present invention, the data signal line driving circuit, the scanning signal line driving circuit and the respective elements may contain switching elements that are formed at a temperature not more than 600° C.

In other words, the respective switching elements constituting the data signal line driving circuit, the scanning signal line driving circuit and the respective pixels are manufactured at a process temperature of not more than 600° C.

In the above-mentioned arrangement, the process temperature of the switching elements is set at not more than 600° C.; therefore, even when a normal glass substrate (glass substrate having a point of strain of not more than 600° C.) is used as a substrate bearing the switching elements, neither warping nor deflection due to processes having a temperature not less the point of strain occurs. Consequently, in addition to the effects obtained by the aforementioned arrangements, it becomes possible to achieve an image display device which can be easily assembled and has a wider display area.

Additionally, the shift register of the present invention may be provided with: flip-flops on a plurality of stages that operate in synchronism with clock signals, level shifters each of which voltage-raises each of the clock signals to be inputted to each of the flip-flops on a plurality of stages in the case when the clock signal has a voltage value lower than the power supply voltage and a control means for controlling the operation of the level shifter, and in this arrangement, the level shifter is controlled by the control means on the (n+1)-numbered stage in response to the output signal of the flip-flop on the n-numbered stage among those on a plurality of stages, and the clock signal is voltage-raised and inputted thereto so that the flip-flop on the (n+1)-numbered stage may be operated and allowed to output a pulse having the same width as the pulse width of the clock signal.

Moreover, in the shift register of the present invention, in addition to the above-mentioned arrangement, each level shifter may include a level shift section (voltage-raising section) of a current-driving type.

Furthermore, in addition to the above-mentioned arrangement, the shift register of the present invention may have another arrangement in which the control means supplies a signal having a level so as to cut off the input switching element to the level shift section (voltage-raising section) as an input signal so that the corresponding level shifter is stopped.

Here, in addition to the above-mentioned arrangement, the shift register of the present invention may have another arrangement in which the control means stops the power supply to the level shifter so that the corresponding level shifter is stopped.

Moreover, in addition to the above-mentioned arrangement, the shift register of the present invention may have another arrangement in which the level shifter is provided with an output stabilizing means for maintaining the output voltage at a predetermined value at the time of the stoppage.

Moreover, in addition to the above-mentioned arrangement, in the shift register of the present invention, the control means may have another input control in which the gate capacitance of the transistor to which the clock signal is inputted is separated from the transmission line of the clock signal so that the capacitance of the transmission line is reduced.

Furthermore, in addition to the above-mentioned arrangement, in the shift register of the present invention, at least M ($M \geqq 2$) kinds (M number) of clock signals are successively inputted to every M number of flip-flops on a plurality of stages.

Here, in the shift register of the present invention, in addition to the above-mentioned arrangement, another arrangement may be provided in which the M kinds of clock signals are allowed to have either of a phase having no overlapped portions in the high level period and a phase having no overlapped portions in the low level period.

Moreover, in addition to the above-mentioned arrangement, in the shift register of the present invention, the duty ratio of each clock signal of M kinds may be set to not more than $(100 \times 1/M)$ %.

Furthermore, in addition to the above-mentioned -arrangement, in the shift register of the present invention, the above-mentioned flip-flops on a plurality of stages may be provided as set-reset type flip-flops; and an output pulse of the $(i+k \times M)$-numbered stage ($k \geqq 1$) may be inputted to the reset terminal of the flip-flop on the i-numbered stage.

Here, in addition to the above-mentioned arrangement, in the shift register of the present invention, the above-mentioned flip-flops on a plurality of stages may be provided as set-reset type flip-flops; and an output signal of pulse of the flip-flop on the $(i+k \times M)$-numbered stage ($k \geqq 1$) may be inputted to the reset terminal of the flip-flop on the i-numbered stage.

Moreover, the image display device of the present invention is provided with a display section which is provided with: a plurality of pixels arranged in a matrix format; a plurality of data signal lines placed on the respective columns of the pixels and a plurality of scanning signal lines placed on the respective rows of the pixels and which displays an image on the pixel by a data signal that is sent from the data signal line to each pixel in synchronism with a scanning signal supplied from each scanning signal line so as to form an image; a scanning signal line driving circuit (a scanning signal line driving circuit for successively outputting scanning signals to the scanning signal lines in synchronism with a predetermined timing signal) for successively supplying scanning signals having different timing from each other to the scanning signal lines in synchronism with a first clock having a predetermined cycle; and a data signal line driving circuit (a data signal line driving circuit for successively outputting video image signals to the data signal lines in synchronism with a predetermined timing signal) for extracting data signals applied onto the respective pixels on the scanning signal line to which the scanning signal has been applied, from a video image signal that has been successively applied in synchronism with a second clock having a predetermined cycle and is representative of a display state of each pixel, and for outputting the resulting data to each of the data signal lines. In the image display device having the above-mentioned arrangement, at least either the data signal line driving circuit and the scanning signal line driving circuit is provided with either of the above-mentioned shift registers having the first or second clock signal as a clock signal.

Moreover, in the image display device of the present invention, either the data signal line driving circuit or the scanning signal line driving circuit may be formed on the same substrate as the pixels.

Furthermore, in the image display device of the present invention, the data signal line driving circuit, the scanning signal line driving circuit and the respective elements may contain switching elements that are formed at a temperature not more than 600° C.

What is claimed is:

1. A shift register comprising:

flip-flops of a plurality of stages; and switching means of a plurality of stages, and wherein:

the switching means on each of the stages is such that an input of a clock signal is controlled by the flip-flop on an immediately preceding stage controlling an open/closed state of that switching means through an output signal from that flip-flop; and a clock signal inputted to the switching means which is ON is a set input to the flip-flop on an immediately succeeding stage and an output pulse from that succeeding stage in the shift register.

2. The shift register as defined in claim 1, wherein M(M≧2) kinds of clock signals are successively inputted to every M number of the flip-flops on a plurality of stages.

3. The shift register as defined in claim 2, wherein the M kinds of clock signals are allowed to have such phases that their high-level periods or low-level periods do not overlap each other.

4. The shift register as defined in claim 3, wherein the duty ratio of each of the M kinds of clock signals is preferably set to not more than (100×1/M) %.

5. The shift register as defined in claim 2, wherein the flip-flop on each of the stages is a set-reset-type flip-flop, and an output pulse of the switching means controlled by the flip-flop on each one of the stages is inputted to a reset terminal of a flip-flop on a stage which precedes that stage by (k×M−1) stages (k≧1).

6. The shift register as defined in claim 2, wherein: the flip-flop on each of the stages is a set-reset-type flip-flop; and an output signal of a flip-flop on each one of the stages is inputted to a reset terminal of a flip-flop on a stage which precedes that stage by (k×M) stages (k≧1).

7. The shift register as defined in claim 1, further comprising:

an input stabilizing section for stabilizing an input to each of the flip-flops on the plural stages which the switching means is opened.

8. The shift register as defined in claim 7, wherein the flip-flop on each of the stages is a set-reset-type flip-flop, and an output pulse of the switching means controlled by the flip-flop on each one of the stages is inputted to a reset terminal of a flip-flop on a stage which precedes that stage by (k×M−1) stages (k≧1).

9. The shift register as defined in claim 7, wherein: the flip-flop on each of the stages is a set-reset-type flip-flop; and an output signal of a flip-flop on each one of the stages is inputted to a reset terminal of a flip-flop on a stage which precedes that stage by (k×M) stages (k≧1).

10. An image display device comprising:

a display section constituted by a plurality of pixels arranged in a matrix format;

a data signal line driving circuit, connected to a plurality of data signal lines, for supplying to the respective data signal lines image data to be written in the pixels; and a scanning signal line driving circuit, connected to a plurality of scanning signal lines, for supplying to the scanning signal lines a scanning signal for controlling a writing operation of the image data to the pixels, wherein the shift register as defined in claim 1 is installed at least in either the data signal line driving circuit or the scanning signal line driving circuit.

11. The image display device as defined in claim 10, wherein at least either the data signal line driving circuit or the scanning signal line driving circuit is formed on a substrate on which the pixels are formed.

12. The image display device as defined in claim 10, wherein a switching element constituting at least either the data signal line driving circuit or the scanning signal line driving circuit is a polycrystal silicon thin-film transistor.

13. The image display device as defined in claim 12, wherein the switching element is formed at a temperature of not more than 600° C.

14. A shift register comprising:

flip-flops of a plurality of stages; and level shifters of a plurality of stages, each for voltage-raising a clock signal, wherein:

each of the level shifters is such that a clock signal voltage raising operation thereof is controlled by the flip-flop on an immediately preceding stage to that level shifter through an output signal from that flip-flop; and the clock signal voltage-raised by that level shifter is an input to the flip-flop on an immediately succeeding stage and an output pulse from that succeeding stage in the shift register.

15. The shift register as defined in claim 14, wherein each of the level shifter is provided with a current-driving type voltage-raising section.

16. The shift register as defined in claim 15, wherein the output signal of the flip-flop on each one of the stages is inputted to the voltage-raising section of the level shifter on an immediately succeeding stage so that the corresponding level shifter is stopped by applying a signal having a level so as to cut off an input switching element.

17. The shift register as defined in claim 15, wherein the output signal of the flip-flop on each one of the stages stops a power supply to the level shifter on an immediately succeeding stage so that the corresponding level shifter is stopped.

18. The shift register as defined in claim 14, wherein the level shifter comprises an output stabilizing means for maintaining an output voltage at a predetermined value at the time of stoppage.

19. The shift register as defined in claim 14, wherein, supposing that M is an integer not less than 2, M kinds of clock signals are successively inputted to every M number of the flip-flops on a plurality of stages.

20. The shift register as defined in claim 19, wherein each of the M kinds of clock signals is allowed to have either a phase in which high-level periods do not overlap each other or a phase in which low-level periods do not overlap each other.

21. The shift register as defined in claim 19, wherein the flip-flop on each of the stages is a set-reset-type flip-flop, and an output pulse of the switching means controlled by the flip-flop on each one of the stages is inputted to a reset terminal of a flip-flop on a stage which precedes that stage by (k×M−1) stages (k≧1).

22. The shift register as defined in claim 19, wherein: the flip-flop on each of the stages is a set-reset-type flip-flop; and an output signal of a flip-flop on each one of the stages is inputted to a reset terminal of a flip-flop on a stage which precedes that stage by (k×M) stages (k≧1).

23. An image display device comprising:

a display section which includes a plurality of pixels arranged in a matrix format, a plurality of data signal lines placed on the respective columns of the pixels and a plurality of scanning signal lines placed on the respective rows of the pixels and which displays an image on the pixel by a data signal that is sent from the data signal line to each pixel in synchronism with a scanning signal supplied from each scanning signal line so as to form an image;

a scanning signal driving circuit for successively supplying scanning signals having different timing from each other to the scanning signal lines in synchronism with a first clock having a predetermined cycle; and a data signal line driving circuit for extracting data signals applied onto the respective pixels on the scanning signal line to which the scanning signal has been applied, from a video image signal that has been successively applied in synchronism with a second clock having a predetermined cycle and is representative of a display state of each pixel, and for outputting the resulting data to each of the data signal lines, wherein at least either the data signal line driving circuit and the scanning signal line driving circuit includes the shift register having the first or second clock signal as a clock signal as defined in claim 14.

24. The image display device as defined in claim 23, wherein at least either the data signal line driving circuit or the scanning signal line driving circuit is formed on a substrate on which the pixels are formed.

25. The image display device as defined in claim 23, wherein the data signal line driving circuit, the scanning signal line driving circuit and the respective pixels include switching elements made of polycrystal silicon thin-film transistors.

26. The image display device as defined in claim 25, wherein the data signal line driving circuit, the scanning signal line driving circuit and the respective pixels include switching elements that are formed at a temperature of not more than 600° C.

27. The shift register as defined in claim 14, wherein a transistor, which is installed in the level shifter on each one of the stages and to which a clock signal is inputted, has a gate capacitance that is separated from a transmission line of the clock signal by the output signal of the flip-flop on the immediately preceding stage.

28. The shift register as defined in claim 19, wherein the duty ratio of each of the M kinds of clock signals is set to not more than (100×1/M) %.

* * * * *

UNITED STATES PATENT AND TRADEMARK OFFICE

CERTIFICATE OF CORRECTION

PATENT NO. : 7,212,184 B2
APPLICATION NO. : 10/800352
DATED : May 1, 2007
INVENTOR(S) : Hajime Washio It is certified that error appears in the above-identified patent and that said Letters Patent is hereby corrected as shown below:

On the Title Page Item (62) should read,

Domestic Priority data as claimed by applicant
This application is a DIV of 09/703,918 11/01/2000 PAT 6,724,361

On the Title Page Item (30) should read,

Foreign Applications
JAPAN 11-311191 11/01/1999
JAPAN 2000-117073 04/18/2000

Signed and Sealed this

Twentieth Day of October, 2009

David J. Kappos

David J. Kappos
*Director of the United States Patent and Trademark Office*